US008172740B2

(12) United States Patent
El Dorry et al.

(10) Patent No.: US 8,172,740 B2
(45) Date of Patent: May 8, 2012

(54) CONTROLLED CENTRIFUGE SYSTEMS

(75) Inventors: Khaled El Dorry, The Woodlands, TX (US); George Edward Smith, Missouri City, TX (US); Mallappa Ishwarappa Guggari, Cedar Park, TX (US); William L. Koederitz, Cedar Park, TX (US)

(73) Assignee: National Oilwell Varco L.P., Houston, TX (US)

( * ) Notice: Subject to any disclaimer, the term of this patent is extended or adjusted under 35 U.S.C. 154(b) by 809 days.

(21) Appl. No.: 12/231,293

(22) Filed: Aug. 29, 2008

(65) Prior Publication Data

US 2009/0105059 A1 Apr. 23, 2009

Related U.S. Application Data

(63) Continuation-in-part of application No. 11/253,067, filed on Oct. 18, 2005, now abandoned, and a continuation-in-part of application No. 11/096,192, filed on Mar. 31, 2005, now abandoned, and a continuation-in-part of application No. 10/949,882, filed on Sep. 25, 2004, now Pat. No. 7,278,540, and a continuation-in-part of application No. 10/835,256, filed on Apr. 29, 2004, now Pat. No. 7,331,469, and a continuation-in-part of application No. 10/512,372, filed on Oct. 25, 2004, now Pat. No. 7,581,647, and a continuation-in-part of application No. 10/373,216, filed on Feb. 24, 2003, now Pat. No. 6,907,375.

(60) Provisional application No. 60/424,262, filed on Nov. 6, 2002.

(51) Int. Cl.
*B04B 1/20* (2006.01)
*B04B 13/00* (2006.01)

(52) U.S. Cl. ..... 494/8; 494/9; 494/10; 494/37; 494/42; 494/53; 494/84; 700/273

(58) Field of Classification Search ..... 494/1, 5, 494/7–10, 12, 27, 30, 37, 42, 52–54, 84; 210/97, 103, 134, 143, 380.3; 700/273
See application file for complete search history.

(56) References Cited

U.S. PATENT DOCUMENTS 1,885,154 A 11/1932 Strezynski et al.
(Continued)

FOREIGN PATENT DOCUMENTS

DE 4127929 A1 2/1993
(Continued)

OTHER PUBLICATIONS

Guggari et al., "Design and Application Considerations for Inverters in FLuid Flow Control", Oct. 1988, Conference Record of the 1988 IEEE, vol. 2, pp. 1779-1783.

(Continued)

*Primary Examiner* — Charles E Cooley
(74) *Attorney, Agent, or Firm* — Williams, Morgan & Amerson, P.C.

(57) ABSTRACT

The present disclosure is generally directed to centrifuge systems and methods for controlling centrifuge systems, wherein the systems in certain aspects are adapted for processing material, e.g., but not limited to drilling fluids with solids therein. One illustrative method includes providing a centrifuge system that is made up of, among other things, a bowl, a bowl motor system, a bowl variable frequency drive, a conveyor, a conveyor motor, a conveyor variable frequency drive, a pump, a pump motor, and a pump variable frequency drive. Additionally, the centrifuge system includes a control system that is adapted to control the bowl variable frequency drive, the conveyor variable frequency drive, and the pump variable frequency drive. The method includes controlling the centrifuge system in the G-force differential control mode by controlling the G-force on the bowl as the bowl is rotated by the bowl motor system so that the G-force on the bowl does not exceed a pre-set maximum G-force.

34 Claims, 57 Drawing Sheets

U.S. PATENT DOCUMENTS

| | | | | |
|---|---|---|---|---|
| 2,082,513 | A | | 6/1937 | Roberts |
| 2,112,784 | A | | 3/1938 | McNitt |
| 2,341,169 | A | | 2/1944 | Wilson et al. |
| 2,418,529 | A | | 4/1947 | Stern |
| 2,578,456 | A | | 12/1951 | Smith |
| 2,711,854 | A | | 6/1955 | Kjellgren |
| 2,961,154 | A | | 11/1960 | Bergey |
| 3,012,674 | A | | 12/1961 | Hoppe |
| 3,070,291 | A | | 12/1962 | Bergey |
| 3,219,107 | A | | 11/1965 | Brown et al. |
| 3,268,159 | A | | 8/1966 | Kern |
| 3,302,720 | A | | 2/1967 | Brandon |
| 3,498,393 | A | | 3/1970 | West et al. |
| 3,629,859 | A | | 12/1971 | Copland et al. |
| 3,640,344 | A | | 2/1972 | Brandon |
| 3,726,136 | A | | 4/1973 | McKean et al. |
| 3,795,361 | A | | 3/1974 | Lee |
| 3,796,299 | A | | 3/1974 | Musschoot |
| 3,855,380 | A | | 12/1974 | Gordon et al. |
| 3,874,733 | A | | 4/1975 | Poundstone et al. |
| 3,885,734 | A | | 5/1975 | Lee |
| 3,900,393 | A | | 8/1975 | Wilson |
| 3,934,792 | A | | 1/1976 | High et al. |
| 3,955,411 | A | | 5/1976 | Lawson, Jr. |
| 3,993,146 | A | | 11/1976 | Poundstone et al. |
| 4,000,074 | A | | 12/1976 | Evans |
| 4,033,865 | A | | 7/1977 | Derrick, Jr. |
| 4,038,152 | A | | 7/1977 | Atkins |
| 4,085,888 | A | | 4/1978 | Jager |
| 4,208,906 | A | | 6/1980 | Roberts, Jr. |
| 4,222,988 | A | | 9/1980 | Barthel |
| 4,224,821 | A | | 9/1980 | Taylor et al. |
| 4,228,949 | A | | 10/1980 | Jackson |
| 4,233,181 | A | | 11/1980 | Goller et al. |
| 4,240,578 | A | | 12/1980 | Jackson |
| 4,297,225 | A | | 10/1981 | Hartley |
| 4,298,160 | A | | 11/1981 | Jackson |
| 4,298,162 | A | | 11/1981 | Hohne |
| 4,298,572 | A | | 11/1981 | Moffet et al. |
| 4,319,482 | A | | 3/1982 | Bunner |
| 4,339,072 | A | | 7/1982 | Hiller |
| 4,369,915 | A | | 1/1983 | Oberg et al. |
| 4,378,906 | A | | 4/1983 | Epper et al. |
| 4,411,074 | A | | 10/1983 | Daly |
| 4,432,064 | A | | 2/1984 | Barker et al. |
| 4,482,459 | A | | 11/1984 | Shiver |
| 4,526,687 | A | | 7/1985 | Nugent |
| 4,573,115 | A | | 2/1986 | Halgrimson |
| 4,575,336 | A | | 3/1986 | Mudd et al. |
| 4,624,417 | A | | 11/1986 | Gangi |
| 4,635,735 | A | | 1/1987 | Crownover |
| 4,650,687 | A | | 3/1987 | Willard et al. |
| 4,668,213 | A | | 5/1987 | Kramer |
| 4,696,353 | A | | 9/1987 | Elmquist et al. |
| 4,696,751 | A | | 9/1987 | Eifling |
| 4,729,548 | A | | 3/1988 | Sullins |
| 4,743,226 | A | | 5/1988 | Day et al. |
| 4,751,887 | A | | 6/1988 | Terry et al. |
| 4,770,711 | A | | 9/1988 | Deal, III et al. |
| 4,783,057 | A | | 11/1988 | Sullins |
| 4,791,002 | A | | 12/1988 | Baker et al. |
| 4,799,987 | A | | 1/1989 | Sullins |
| 4,805,659 | A | | 2/1989 | Gunnewig et al. |
| 4,809,791 | A | | 3/1989 | Hayatdavoudi |
| 4,832,853 | A | | 5/1989 | Shiraki et al. |
| 4,889,733 | A | | 12/1989 | Willard et al. |
| 4,889,737 | A | | 12/1989 | Willard et al. |
| 4,895,665 | A | | 1/1990 | Colelli et al. |
| 4,895,731 | A | | 1/1990 | Baker et al. |
| 4,896,835 | A | | 1/1990 | Fahrenholz |
| 4,915,452 | A | | 4/1990 | Dibble |
| 4,942,929 | A | | 7/1990 | Malachosky et al. |
| 4,961,722 | A | | 10/1990 | Taylor et al. |
| 5,010,966 | A | | 4/1991 | Stokley et al. |
| 5,053,082 | A | | 10/1991 | Flanigan et al. |
| 5,066,350 | A | | 11/1991 | Sullins |
| 5,080,721 | A | | 1/1992 | Flanigan et al. |
| 5,107,874 | A | | 4/1992 | Flanigan et al. |
| 5,109,933 | A | | 5/1992 | Jackson |
| 5,129,469 | A | | 7/1992 | Jackson |
| 5,145,256 | A | | 9/1992 | Wiemers et al. |
| 5,147,277 | A | | 9/1992 | Shapiro |
| 5,156,751 | A | * | 10/1992 | Miller ..... 210/787 |
| 5,181,578 | A | | 1/1993 | Lawler |
| 5,190,645 | A | | 3/1993 | Burgess |
| 5,200,372 | A | | 4/1993 | Kuroyama et al. |
| 5,203,762 | A | * | 4/1993 | Cooperstein ..... 494/7 |
| 5,221,008 | A | | 6/1993 | Derrick, Jr. et al. |
| 5,227,057 | A | | 7/1993 | Lundquist |
| 5,253,718 | A | | 10/1993 | Lawler |
| 5,278,549 | A | | 1/1994 | Crawford |
| 5,314,058 | A | | 5/1994 | Graham |
| 5,329,465 | A | | 7/1994 | Arcella et al. |
| 5,337,966 | A | | 8/1994 | Francis et al. |
| 5,378,364 | A | | 1/1995 | Welling |
| 5,385,669 | A | | 1/1995 | Leone, Sr. |
| 5,403,260 | A | | 4/1995 | Hensley |
| 5,488,104 | A | | 1/1996 | Schulz |
| 5,489,204 | A | | 2/1996 | Conwell et al. |
| 5,494,584 | A | | 2/1996 | McLachlan et al. |
| 5,516,348 | A | | 5/1996 | Conwell et al. |
| 5,534,207 | A | | 7/1996 | Burrus |
| 5,547,479 | A | | 8/1996 | Conwell et al. |
| 5,566,889 | A | | 10/1996 | Preiss |
| 5,567,150 | A | | 10/1996 | Conwell et al. |
| 5,570,749 | A | | 11/1996 | Reed |
| 5,632,714 | A | | 5/1997 | Leung et al. |
| 5,643,169 | A | | 7/1997 | Leung et al. |
| 5,653,674 | A | | 8/1997 | Leung |
| 5,669,941 | A | | 9/1997 | Peterson |
| 5,681,256 | A | * | 10/1997 | Nagafuji ..... 494/9 |
| D386,874 | S | | 11/1997 | Glaun |
| D387,534 | S | | 12/1997 | Glaun |
| D388,583 | S | | 12/1997 | Glaun |
| 5,695,442 | A | | 12/1997 | Leung et al. |
| D388,924 | S | | 1/1998 | Glaun |
| 5,732,828 | A | | 3/1998 | Littlefield, Jr. |
| 5,771,601 | A | | 6/1998 | Veal et al. |
| 5,772,573 | A | | 6/1998 | Hao |
| 5,791,494 | A | | 8/1998 | Meyer |
| 5,814,230 | A | | 9/1998 | Willis et al. |
| 5,819,952 | A | | 10/1998 | Cook et al. |
| 5,857,955 | A | * | 1/1999 | Phillips et al. ..... 494/5 |
| 5,868,125 | A | | 2/1999 | Maoujoud |
| 5,896,998 | A | | 4/1999 | Bjorklund et al. |
| 5,899,844 | A | | 5/1999 | Eberle, Sr. |
| 5,913,767 | A | | 6/1999 | Feldkamp et al. |
| 5,919,123 | A | * | 7/1999 | Phillips ..... 494/7 |
| 5,942,130 | A | | 8/1999 | Leung |
| 5,944,197 | A | | 8/1999 | Baltzer et al. |
| 5,948,256 | A | | 9/1999 | Leung |
| 5,948,271 | A | | 9/1999 | Wardwell et al. |
| 5,958,235 | A | | 9/1999 | Leung |
| 5,971,307 | A | | 10/1999 | Davenport |
| 5,975,204 | A | | 11/1999 | Tubel et al. |
| 6,012,016 | A | | 1/2000 | Bilden et al. |
| 6,013,158 | A | | 1/2000 | Wootten |
| 6,045,070 | A | | 4/2000 | Davenport |
| 6,063,292 | A | | 5/2000 | Leung |
| 6,102,310 | A | | 8/2000 | Davenport |
| 6,105,689 | A | | 8/2000 | McGuire et al. |
| 6,109,452 | A | | 8/2000 | Leung et al. |
| 6,110,096 | A | | 8/2000 | Leung et al. |
| 6,123,656 | A | | 9/2000 | Michelsen |
| 6,138,834 | A | | 10/2000 | Southall |
| 6,143,183 | A | | 11/2000 | Wardwell et al. |
| 6,145,669 | A | | 11/2000 | Leung |
| 6,155,428 | A | | 12/2000 | Bailey et al. |
| 6,170,580 | B1 | | 1/2001 | Reddoch |
| 6,192,980 | B1 | | 2/2001 | Tubel et al. |
| 6,217,830 | B1 | | 4/2001 | Roberts et al. |
| 6,223,906 | B1 | | 5/2001 | Williams |
| 6,234,250 | B1 | | 5/2001 | Green et al. |
| 6,267,250 | B1 | | 7/2001 | Leung et al. |
| 6,279,471 | B1 | | 8/2001 | Reddoch |
| D448,488 | S | | 9/2001 | Chaffiotte et al. |
| 6,283,302 | B1 | | 9/2001 | Schulte et al. |

| | | | | |
|---|---|---|---|---|
| 6,290,636 | B1 | 9/2001 | Hiller, Jr. et al. | |
| 6,308,787 | B1 | 10/2001 | Alft | |
| 6,315,894 | B1 | 11/2001 | Wiemers et al. | |
| 6,333,700 | B1 | 12/2001 | Thomeer et al. | |
| 6,368,264 | B1 * | 4/2002 | Phillips et al. | 494/5 |
| 6,378,628 | B1 | 4/2002 | McGuire et al. | |
| 6,393,363 | B1 | 5/2002 | Wilt et al. | |
| 6,408,953 | B1 | 6/2002 | Goldman et al. | |
| 6,461,286 | B1 | 10/2002 | Beatley | |
| 6,506,310 | B2 | 1/2003 | Kulbeth | |
| 6,519,568 | B1 | 2/2003 | Harvey et al. | |
| 6,536,540 | B2 | 3/2003 | deBoer | |
| 6,553,316 | B2 | 4/2003 | Bary et al. | |
| 6,553,336 | B1 | 4/2003 | Johnson et al. | |
| 6,600,278 | B1 * | 7/2003 | Bretzius | 318/34 |
| 6,605,029 | B1 | 8/2003 | Koch et al. | |
| 6,693,553 | B1 | 2/2004 | Ciglenec et al. | |
| 6,763,605 | B2 | 7/2004 | Reddoch | |
| 6,780,147 | B2 | 8/2004 | Koch et al. | |
| 6,783,088 | B1 | 8/2004 | Gillis et al. | |
| 6,790,169 | B2 | 9/2004 | Koch et al. | |
| 6,793,814 | B2 | 9/2004 | Fout et al. | |
| 6,860,845 | B1 * | 3/2005 | Miller et al. | 494/1 |
| 6,905,452 | B1 * | 6/2005 | Kirsch | 494/8 |
| 6,907,375 | B2 | 6/2005 | Guggari et al. | |
| 6,926,101 | B2 | 8/2005 | deBoer | |
| 6,932,169 | B2 | 8/2005 | Wylie et al. | |
| 6,932,757 | B2 | 8/2005 | Beattey | |
| 6,971,982 | B1 * | 12/2005 | Kirsch | 494/8 |
| 6,981,940 | B2 * | 1/2006 | Rafferty | 494/7 |
| 7,001,324 | B2 | 2/2006 | Hensley et al. | |
| 7,018,326 | B2 | 3/2006 | Koch et al. | |
| 7,041,044 | B2 | 5/2006 | Gilbert | |
| D524,825 | S | 7/2006 | Koch et al. | |
| 7,195,084 | B2 | 3/2007 | Burnett et al. | |
| 7,284,665 | B2 | 10/2007 | Fuchs | |
| 7,303,079 | B2 | 12/2007 | Reid-Robertson et al. | |
| 7,316,321 | B2 | 1/2008 | Robertson et al. | |
| 7,373,996 | B1 | 5/2008 | Martin et al. | |
| 7,387,602 | B1 * | 6/2008 | Kirsch | 494/8 |
| 7,514,011 | B2 | 4/2009 | Kulbeth | |
| 7,540,837 | B2 * | 6/2009 | Scott et al. | 494/7 |
| 7,540,838 | B2 * | 6/2009 | Scott et al. | 494/7 |
| 7,581,569 | B2 | 9/2009 | Beck | |
| 7,770,665 | B2 | 8/2010 | Eia et al. | |
| 2001/0032815 | A1 | 10/2001 | Adams et al. | |
| 2002/0000399 | A1 | 1/2002 | Winkler et al. | |
| 2002/0018399 | A1 | 2/2002 | Schultz et al. | |
| 2002/0033278 | A1 | 3/2002 | Reddoch | |
| 2002/0035551 | A1 | 3/2002 | Sherwin et al. | |
| 2002/0065698 | A1 | 5/2002 | Schick et al. | |
| 2002/0134709 | A1 | 9/2002 | Riddle | |
| 2003/0038734 | A1 | 2/2003 | Hirsch et al. | |
| 2003/0109951 | A1 | 6/2003 | Hsiung et al. | |
| 2004/0040746 | A1 | 3/2004 | Niedermayr et al. | |
| 2004/0051650 | A1 | 3/2004 | Gonsoulin et al. | |
| 2004/0156920 | A1 | 8/2004 | Kane | |
| 2004/0245155 | A1 | 12/2004 | Strong et al. | |
| 2005/0236305 | A1 | 10/2005 | Schulte, Jr. et al. | |
| 2006/0034988 | A1 | 2/2006 | Bresnahan et al. | |
| 2006/0105896 | A1 * | 5/2006 | Smith et al. | 494/7 |
| 2008/0078704 | A1 | 4/2008 | Carr et al. | |
| 2008/0179090 | A1 | 7/2008 | Eia et al. | |
| 2008/0179096 | A1 | 7/2008 | Eia et al. | |
| 2008/0179097 | A1 | 7/2008 | Eia et al. | |
| 2009/0105059 | A1 * | 4/2009 | Dorry et al. | 494/37 |
| 2009/0286098 | A1 | 11/2009 | Yajima et al. | |
| 2009/0316084 | A1 | 12/2009 | Yajima et al. | |
| 2010/0084190 | A1 | 4/2010 | Eia et al. | |
| 2010/0119570 | A1 | 5/2010 | Potter et al. | |

FOREIGN PATENT DOCUMENTS

| | | | |
|---|---|---|---|
| FR | 2 611 559 | | 9/1988 |
| FR | 2 636 669 | | 3/1990 |
| GB | 2 030 482 | A | 4/1980 |
| GB | 2 327 442 | A | 1/1999 |
| JP | 55112761 | | 8/1980 |
| JP | 59069268 | | 4/1984 |
| JP | 63003090 | | 1/1988 |
| JP | 63283860 | | 11/1988 |
| JP | 63290705 | | 11/1988 |
| JP | 02127030 | | 5/1990 |
| JP | 02167834 | | 6/1990 |
| JP | 03240925 | | 10/1991 |
| JP | 03264263 | | 11/1991 |
| JP | 04093045 | | 3/1992 |
| JP | 04269170 | | 9/1992 |
| JP | 05043884 | | 2/1993 |
| JP | 05301158 | | 11/1993 |
| JP | 06063499 | | 3/1994 |
| JP | 07304028 | | 11/1995 |
| JP | 08039428 | | 2/1996 |
| JP | 08270355 | | 10/1996 |
| JP | 09109032 | | 4/1997 |
| JP | 10337598 | A * | 12/1998 |
| WO | WO98/10895 | | 3/1998 |

OTHER PUBLICATIONS

Clarifying Centrifuge Operation and Selectdion. CEP Magazine. Aug. 2004, pp. 34-39.

SC—35 HS High Speed Decanting Centrifuge. Sweco Oilfield Services, 1995.

Roots XLP Whispair Extra Low Pulse Tri-Lobe Blowers, Roots Dresser, 1998.

Industrial Model 1850 SS FVSI, Brandt/South-West, 1998.

U.S. Appl. No. 12/481,959 Final Office Action dated Oct. 27, 2010.

U.S. Appl. No. 12/481,959 Office Action dated Jun. 7, 2010.

U.S. Appl. No. 12/469,851 Final Office Action dated Nov. 9, 2010.

U.S. Appl. No. 12/469,851 Office Action dated Jun. 28, 2010.

U.S. Appl. No. 12/227,462 Office Action dated Nov. 15, 2010.

U.S. Appl. No. 11/897,976 Final Office Action dated Sep. 1, 2010.

U.S. Appl. No. 11/897,976 Office Action dated Apr. 1, 2010.

U.S. Appl. No. 11/897,975 Final Office Action dated Jul. 21, 2010.

U.S. Appl. No. 11/897,975 Office Action dated Feb. 19, 2010.

U.S. Appl. No. 11/637,615 Final Office Action dated Aug. 2, 2010.

U.S. Appl. No. 11/637,615 Office Action dated Mar. 2, 2010.

Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL: http://web.archive.org/web/20051123025735/http://www.azom.com/details.asp?ArticleID=493>.

* cited by examiner

Rigs in Western Hemisphere - Browser

File Edit View Favorites Tools Help

Back Search Favorites Media

Address http://cp2kneng016/varcoedrill/RigStatus1.aspx?rig**180 Go Links

*Driller Adjustable Parameters*

| Parameter Name | Cujrrent Value | Changed ? | Outside Range ? |
|---|---|---|---|
| Date of Data | 2/22/2002 | | |
| Drill Lo Set Point | 10.5 | | |
| Lo Set Point | 1.7 | | |
| Upper Set Point | 101 | | |
| Swab Speed | 355 | | |
| Tripin Surge Speed | 100 | | |
| Stand Lowering Time | 10 | | |
| Casing Surge Speed | 100 | | |
| Joint Lowering Time | 2 | | |
| Connection Lowering Speed | 15 | | |
| Connection Hoist Speed | 20 | | |
| Kickout Height | 87.2 | | |
| Tripout High Alert | 85 | | |
| ROP Set Point | 150 | | |
| WOB Set Point | 40 | | |
| Torque Set Point | 1500 | | |
| DeltaP Set Point | 280 | | |
| Cut & Slip Engine RPM | 700 | | |
| Lines Strung | 10 | | |
| Ball Height | 11 | | |

710 712 714

*Driller Tuning Parameters*

| Parameter Name | Cujrrent Value | Changed ? | Outside Range ? |
|---|---|---|---|
| Date of Data | 2/22/2002 | | |
| Large Piston Drilling Bias | 0 | | |
| Large Piston Tripping Bias | -5 | | |
| ROP Gain Factor-Driller | 0.6 | | |

Local Intranet

FIG. 16

Rigs in Western Hemisphere - Browser

File Edit View Favorites Tools Help

Back Search Favorites Media

Address http://cp2kdcc001/commandcenter/ShowParams.aspx Go Links

VICIS-ED Configuration Parameters

Changed in last 24 Hours ○
Outside Permissible Range ◉
Invalid Data ○

Driller Adjustments Parameters

810

| Parameter Name \ Rig # | 178 | 179 | 180 | 181 | 182 | 183 | 184 | 185 | 186 | 187 | 188 | 189 |
|---|---|---|---|---|---|---|---|---|---|---|---|---|
| Date of Data | 2/22/2002 | 2/22/2002 | 2/22/2002 | 2/22/2002 | 2/22/2002 | No Data | 2/22/2002 | 2/22/2002 | 2/22/2002 | 2/22/2002 | 2/22/2002 | 2/22/2002 |
| Drill Lo Set Point | 9 | 7 | 10.5 ◉ | 9 | 9 | N/A | 9.6 | -1.5 ◉ | 6.5 ◉ | 8.3 | 8.227 ◉ | 11.4 ◉ |
| Lo Set Point | 1 | 1.5 | 1.7 | 0.5 ◉ | 8.996 ◉ | N/A | 0.1 ◉ | -1.5 ◉ | 1 | 1.6 | 1.3 | 3 ◉ |
| Upper Set Point | 99 ◉ | 100 ◉ | 101 ◉ | 95 ◉ | 96 ◉ | N/A | 90 ◉ | 99 ◉ | 99 ◉ | 99 ◉ | 105.1 ◉ | 95.5 ◉ |
| Swab Speed | 180 | 255 | 355 | 50 | 100 | N/A | 200 | 200 | 30 | 300 | 200 | 30 |
| Tripin Surge Speed | 60 | 160 | 100 | 100 | 50 | N/A | 40 | 200 | 30 | 70 | 200 | 140 |
| Stand Lowering Time | 25 | 40 | 10 | 60 | 5 | N/A | 100 | 27 | 5 | 20 | 25 | 20 |
| Casting Surge Speed | 20 | 155 | 100 | 30 | 50 | N/A | 10 | 100 | 15 | 25 | 100 | .140 |
| Joint Lowering Time | 12 | 60 | 2 | 40 | 40 | N/A | 90 | 14 | 5 | 5 | 5 | 9 |
| Connection Lowering Speed | 20 | 32 | 15 | 50 | 10 | N/A | 50 | 40 | 20 | 20 | 25 | 50 |
| Connection Hoist Speed | 50 | 45 | 20 | 50 | 50 | N/A | 50 | 40 | 30 | 30 | 50 | 50 |
| Kickout Height | 60 | 60 | 87.2 | 47 | 60 | N/A | 75 | 71.2 | 61 | 65 | 88 | 80 |
| Tripout High Alert | 85 | 85 | 85 | 28 ◉ | 60 | N/A | 75 | 65 | 60 | 65 | 88 | 85 |
| ROP Set Point | 150 | 55 | 150 | 50 | 150 | N/A | 250 | 150 | 21 | 175 | 50 | 70 |
| WOB Set Point | 10 | 40 | 40 | 8 | 11 | N/A | 20 | 12 | 13 | 8 | 15 | 43 |
| Torque Set Point | 650 | 300 | 1500 | 500 | 280 | N/A | 660 | 1500 | 650 | 220 | 400 | 400 |
| DeltaP Set Point | 500 | 200 | 280 | 200 | 400 | N/A | 500 | 139 | 500 | 200 | 250 | 200 |
| Cut & Slip Engine RPM | 700 | 715 ◉ | 700 | 700 | 700 | N/A | 700 | 700 | 700 | 700 | 700 | 700 |
| Lines Strung | 10 | 10 | 10 | 10 | 8 | N/A | 10 | 10 | 10 | 10 | 0 | 12 |

Local Intranet

FIG. 17

You have selected to run the centrifuge in the idle mode
This will turn the centrifuge at the following speeds
and will not be able to change the speed
do you wish to proceed?

| | |
|---|---|
| BOWL RPM: | 600 |
| Conveyor VFD RPM: | 400 |
| Conveyor Direction: Reverse | |

YES

BACK

FIG. 31F

Enter Mud's and Solids' Properties for Reference

Mud In

% Solids Content In: 0.00 %

Mud Weight: 0.00 PPG

Mud Out

% Solids Content Out: 0.00 %

Mud Weight: 0.00 PPG

Solids

% Moisture Content of Solids: 0.00 %

% Oil on Cuttings: 0.00 %

UNIT CONVERSION (ENTER PPG VALUE)

0 PPG = 0.00 Kg/m ^ 3

Main Menu

FIG. 31G

| | | | |
|---|---|---|---|
| Bowl Motor Set Point: | 0 RPM | Conveyor Motor Set Point: | 0 RPM |
| Bowl Motor Speed: | 0 RPM | Conveyor Motor Speed: | 0 RPM |
| Bowl Speed: | 0 RPM | Conveyor Speed: | 0 RPM |
| Bowl VFD Current: | 0 A | Conveyor VFD Current: | 0 A |
| Bowl Torque: | 0 % | Conveyor Torque: | 0 % |
| Bowl Pulley Ratio: | 1.00 | Conveyor Motor Direction: | Stopped |
| Gear Box Ratio: | 80 | Differential: | 0 |
| Pump Torque: | 0 % | Pump Motor Set Point: | 0 RPM |
| Pump VFD Current: | 0 A | Pump Motor Set Point: | 0 RPM |

No Active Alarms

Feed Pump Start Set Point: 0 RPM

Main Menu

FIG. 33B

Select Function to Plot

RPM

G FORCE

Feed Rate PDP only

Torque

Differential

Main Menu

No Active Alarms

FIG. 34

No Active Alarms

| Action | | | |
|---|---|---|---|
| Service | Later | Conveyor Coupling | 2 Hrs |
| Service | Later | Main Bearings Lubrication | 2 Hrs |
| Service | Later | Conveyor Bearings lubrication | 2 Hrs |
| Service | Later | Feed tube rubbing | 2 Hrs |
| Service | Later | Oil level and belt tensions | 2 Hrs |
| Service | Later | Baffle gasket | 2 Hrs |
| Service | Later | Case Seal | 2 Hrs |
| Service | Later | Gearbox oil | 2 Hrs |
| Service | Later | Thrust Bearings Lubrication | 2 Hrs |

Main Menu

FIG. 39

The proper procedure of shutting down the centrifuge is:

1) Shut Down Feed Pump

STOP PUMP

Pump Speed

100 RPM

No Active Alarms

2) Wait until Torque Drops Below 40%

| BOWL TORQUE | CONVEYOR TORQUE |
|---|---|
| 3 % | 0 % |

3) Stop Centrifuge

STOP CENTRIFUGE

Main Menu

FIG. 40

CONTROLLED CENTRIFUGE SYSTEMS

CROSS-REFERENCE TO RELATED APPLICATIONS

This is: a continuation-in-part of U.S. application Ser. No. 11/253,067 filed Oct. 18, 2005, now abandoned; a continuation-in-part of U.S. application Ser. No. 11/096,192 filed Mar. 31, 2005, now abandoned; a continuation-in-part of U.S. application Ser. No. 10/949,882 filed Sep. 25, 2004, now U.S. Pat. No. 7,278,540; a continuation-in-part of U.S. application Ser. No. 10/835,256 filed Apr. 29, 2004, now U.S. Pat. No. 7,331,469; a continuation-in-part of U.S. Ser. No. 10/512,372 filed Oct. 25, 2004, now U.S. Pat. No. 7,581,647, which claims priority from U.S. Ser. No. 10/134,027 filed Apr. 26, 2002, now abandoned, and Application Ser. No. PCT/IB03/01031 filed Mar. 12, 2003; and a continuation-in-part of U.S. Ser. No. 10/373,216 filed Feb. 24, 2003, now U.S. Pat. No. 6,907,375, which claims priority from U.S. application Ser. No. 60/424,262 filed Nov. 6, 2002—all of which are incorporated fully herein and with respect to all of which the present invention claims priority under the Patent Laws.

BACKGROUND OF THE INVENTION

1. Field of the Invention

This invention relates generally to centrifuges, to controls for centrifuges, and in certain particular aspects to programmed media useful in such centrifuge control systems.

2. Description of Related Art

In general, a screw decanter centrifuge has a cylindrical bowl rotating in one direction and a screw conveyor disposed concentrically in the bowl and rotating in the same direction as that of the bowl with a differential speed. The bowl creates a centrifugal force to dehydrate a fluid feed mixture. It is rotated at a constant but variable speed to separate the feed mixture into a component containing solids (hereinafter called dehydrated cake) and other components (liquid). As a result of the centrifugal force created by this rotation, the solids which are heavier than water are collected on the inner wall of the bowl. The screw conveyor is rotated at a relative velocity slightly differentiated from the velocity of the bowl. This differential speed creates a relative motion between the series of screw and the bowl inner wall, which causes the solids to be conveyed slowly in the direction of the cylinder axis along the bowl inner wall. The light component or liquid in the feed mixture is separated from the solids due to the centrifugal force, and moves toward the inside in the radial direction. The dehydrated cake which is a separated heavy material, and the liquid which is a separated light material, are usually discharged separately from opposite ends of the bowl.

The differential speed between the screw conveyor and the bowl can be varied during the operation of the centrifuge dependent on several parameters and quality of the feed mixture to be taken out by separation. In actual operation these conditions are well-known factors. Accordingly, maintenance of constant revolutions is generally required for the bowl. On the other hand, regarding the number of revolutions of the screw conveyor, there are two systems, the first of which keeps the number of revolutions of the screw conveyor always constant in response to that of the bowl, and the second of which varies the number of revolutions of the screw conveyor in response to the carrying torque of the screw conveyor.

Many different industries use decanter centrifuges in varied applications. They are used in the oil industry to process drilling mud to separate undesired drilling solids from the liquid mud. Some decanter centrifuges, because of their continuous operation, have the advantage of being less susceptible to plugging by solids. Also, they may be shut down for long or short periods of time and then restarted with minimum difficulty, unlike certain centrifuges which require cleaning to remove dried solids. Often the solids/liquid mixture is processed at extraordinarily high feed rates. To accommodate such feed rates, high torques are encountered, much energy is required to process the mixture, and the physical size of the centrifuge can become enormous.

Various drive systems for creating a differential speed between the bowl and the screw of a centrifuge are available. One is a backdrive system for horizontal centrifuges which uses electric motors and a differential gear.

When such a centrifuge is used to process drilling material (drilling fluid with drilled cuttings therein), changing mud flow conditions often require a human operator to frequently adjust centrifuge motor speeds to optimize centrifuge treating performance. Often, centrifuges operate a compromise between high performance and long intervals between maintenance and repair operations. Problems can occur if the centrifuge's differential gearbox overheats or is damaged from too-high gearbox speed differentials. Gearbox damage and overheating can occur when the backdrive motor is operated in forward or in reverse. High speed differential settings can be important for efficient solids removal from drilling mud which contains an excess of drilled solids and silt. Both gearbox damage and centrifuge plugging should be avoided.

Centrifuge manufacturers often specify gearbox differential speeds that must not be exceeded if safe, efficient, optimal centrifuge operating life is to be achieved; but operators frequently do not manually adjust centrifuge speed differentials optimally, resulting in reduced centrifuge solids removal and/or shortened gearbox life. Centrifuge breakdowns due to non-optimal adjustment and/or operation outside of specified differential speed parameters in remote areas of oil and gas prospecting, and offshore, can be costly and cause expensive delays.

There is a need for a system that makes it easier for a bush human operator to adjust and maintain centrifuge operations at a balance between high performance and optimized gearbox life. There is a need for a system that prohibits damage to a centrifuge due to incorrect manual settings.

BRIEF SUMMARY OF THE INVENTION

The present invention discloses, in certain aspects, methods for controlling a centrifuge system, the centrifuge system including: a bowl; a bowl motor system for rotating the bowl, rotation of the bowl resulting in a G-force applied to the bowl; a bowl variable frequency drive for driving the bowl motor; a conveyor rotatable within the bowl; a conveyor motor for rotating the conveyor; a conveyor variable frequency drive for driving the conveyor motor; a pump for pumping material to be centrifuged in the bowl; a pump motor for driving the pump; a pump variable frequency drive for driving the pump motor; a control system for controlling the bowl variable frequency drive, the conveyor variable frequency drive, and the pump variable frequency drive, the control system including computer apparatus; the computer apparatus configured to control the centrifuge system in a G-force differential control mode, the computer apparatus programmed with a pre-set maximum G-force to be applied to the bowl; the G-force differential control mode including controlling the G-force on the bowl as the bowl is rotated by the bowl motor system driven by the bowl VFD so that the G-force on the bowl does not exceed the pre-set maximum G-force; and this controlling of the G-force accomplished by one of adjusting the G-force on the bowl and adjusting the speed of the bowl. The present invention also discloses a computer readable medium containing instructions that when executed by a computer implement such a method for processing material with a centrifuge system.

The present invention, in certain embodiments, discloses, a centrifuge system for processing material and methods for using it, the centrifuge system in certain aspects including: a housing; a bowl rotatably mounted within the housing; a bowl motor for rotating the bowl; a bowl motor variable frequency drive apparatus for providing power to the bowl motor, the bowl motor variable frequency drive apparatus including a bowl motor on-board controller for controlling the bowl motor variable frequency drive apparatus; a screw conveyor rotatably mounted within the housing; a screw motor for rotating the screw conveyor; a screw motor variable frequency drive apparatus for providing power to the screw motor, the screw motor variable frequency drive apparatus including a screw motor on-board controller for controlling the screw motor variable frequency drive apparatus; and pump apparatus for pumping material into the bowl.

In one aspect, in such a system the screw on-board controller apparatus checks a manually-set screw motor speed and, if the manually-set screw motor speed is unacceptable, automatically overrides the manually-set screw motor speed with an acceptable screw motor speed; and, optionally, such a system includes alarm apparatus in communication with the on-board controller apparatus for providing an alarm signalling that a manually-set screw motor speed has been overridden and/or alert apparatus for alerting personnel on-site operating the centrifuge system in the event of the screw on-board controller automatically overriding a manually-set screw motor speed.

In certain aspects the screw on-board controller maintains screw motor speed slower than bowl motor speed or it maintains screw motor speed between a pre-set minimum speed and a pre-set maximum speed.

In certain aspects the present invention discloses a centrifuge system with sensor for sensing a parameter indicative of operation of the centrifuge system for providing a signal corresponding to said parameter; control apparatus for receiving signals from the sensor apparatus, for controlling the centrifuge system based on said signals; the centrifuge system on a drilling rig, the control apparatus for monitoring and analyzing a plurality of signals from the sensor apparatus and for transmitting signals indicative of information related to operation of the centrifuge system to a processor on the drilling rig, the processor including a set of health check rules for health checks comprising logical rules, inputs and outputs for defining events associated with the status of the centrifuge system; the processor for determining a severity code for each event and for reporting the events and severity codes to a central server, the events reported by the processor to the central server in a protocol defining a data structure, the data structure comprising a hierarchical tree node structure wherein results from application of the health check rules are a bottommost node of the tree node structure; and displaying the event severity codes on a display.

In certain aspects, centrifuge systems according to the present invention process material that includes drilling fluid and drilled cuttings.

Accordingly, the present invention includes features and advantages which are believed to enable it to advance control system technology for VFD-driven systems, e.g. centrifuge systems. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious centrifuge systems; control systems for centrifuges; and programmed media useful with such control systems.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 16 is an alternative tabular status display for an oil recover system.

FIG. 17 is an alternative tabular status display for an oil recover system.

FIG. 31F is a view of a touch screen apparatus of the control system regarding selection of system idle mode.

FIG. 31G is a view of a touch screen apparatus.

FIG. 33B is a view of a touch screen apparatus of the control system.

FIG. 34 is a view of a touch screen apparatus of the control system regarding selection of data to display regarding system operation.

FIG. 39 is a view of a touch screen apparatus of the control system regarding maintenance status of various system parts.

FIG. 40 is a view of a touch screen apparatus of the control system regarding system shut down.

Figure 1:
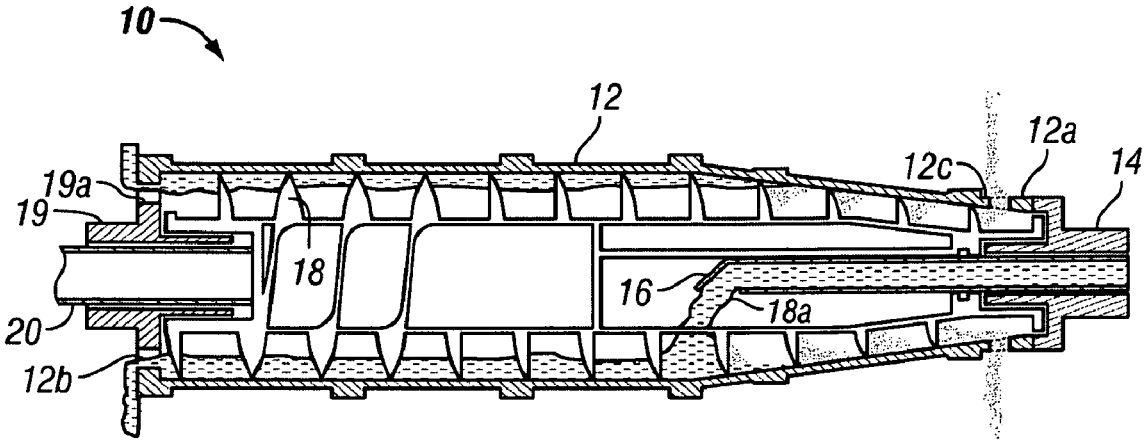
FIG. 1 (Prior Art)
FIG. 1 is a sectional view of a prior art centrifuge which is controlled by systems and methods according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 2:
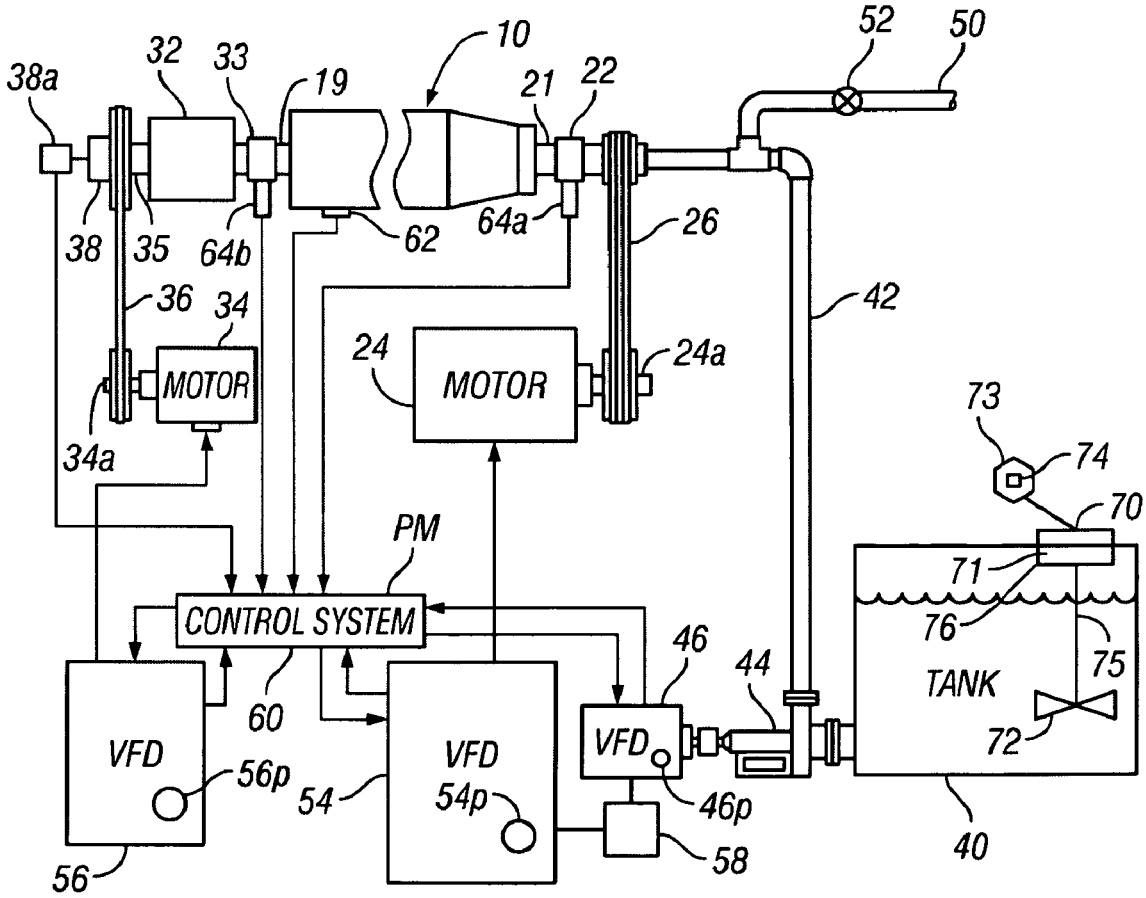
FIG. 2 is a schematic view of the centrifuge of FIG. 1 along with a control system apparatus according to the present invention.

As shown in FIGS. 1 and 2, a centrifuge system 10 according to the present invention has a bowl 12, supported for rotation about its longitudinal axis, has two open ends 12*a* and 12*b*, with the open end 12*a* receiving a drive flange 14 which is connected to a drive shaft for rotating the bowl. The drive flange 14 has a longitudinal passage which receives a feed tube 16 for introducing a feed slurry, e.g. drilling material, into the interior of the bowl 12. A screw conveyor 18 extends within the bowl 12 in a coaxial relationship thereto and is supported for rotation within the bowl. A hollow flanged shaft 19 is disposed in the end 12*b* of the bowl and receives a drive shaft 20 of an external planetary gear box for rotating the screw conveyor 18 in the same direction as the bowl at a selected speed.

The wall of the conveyor 18 has one or more openings 18*a* near the outlet end of the tube 16 so that the centrifugal forces generated by the rotating bowl 12 move the slurry radially outwardly and pass through the openings 18*a* and into the annular space between the conveyor and the bowl 12. The liquid portion of the slurry is displaced to the end 12*b* of the bowl 12 while entrained solid particles in the slurry settle towards the inner surface of the bowl due to the G forces generated, and are scraped and displaced by the screw conveyor 18 back towards the end 12*a* of the bowl for discharge through a plurality of discharge ports 12*c* formed through the wall of the bowl 12 near its end 12*a*.

Weirs 19*a* (two of which are shown) are provided through the flanged portion of the shaft 19 for discharging the separated liquid. The centrifuge as shown in FIG. 1 is known in the prior art and is enclosed in a housing or casing (not shown) in a conventional manner.

As shown in FIG. 2, a drive shaft 21 forms an extension of, or is connected to, the drive flange 14 and is supported by a bearing 22. A variable speed AC main drive motor 24 has an output shaft 24*a* which is connected to the drive shaft 21 by a drive belt 26 and therefore rotates the bowl 12 of the centrifuge at a predetermined operational speed. The flanged shaft 19 extends from the interior of the conveyor 18 to a planetary gear box 32 and is supported by a bearing 33. A variable speed AC back drive motor 34 has an output shaft 34*a* which is connected to a sun wheel 35 by a drive belt 36 and the sun wheel is connected to the input of the gear box 32. The motor 34 rotates the screw conveyor 18 of the centrifuge through the planetary gear box 32 which functions to establish a differential speed of the conveyor 18 with respect to the bowl 12. A coupling 38 is provided on the shaft of the sun wheel 35, and a limit switch 38*a* is connected to the coupling which functions in a conventional manner to shut off the centrifuge when excessive torque is applied to the gearbox 32.

For receiving and containing the feed slurry being processed, there is a tank 40 and a conduit 42 connected to an outlet opening formed in the lower portion of the tank to the feed tube 16. An internal passage through the shaft 21 receives the conduit 42 and enables the feed slurry to pass through the conduit and the feed tube 16 and into the conveyor 18.

The slurry is pumped from the tank 40 by a variable frequency drive pump 44 which is connected to the conduit 42 and is driven by a drive unit 46, e.g. an electric motor, which pumps the slurry through the conduit 42 and the feed tube 16, and into the centrifuge. A control valve 52 disposed in the conduit 50 controls flow in the conduit. Two variable frequency ("VFD") drives 54 and 56 are respectively connected to the motors 24 and 34 for driving the motors at variable frequencies and at variable voltages. The VFD 54 is also electrically connected to the input of a magnetic starter 58, the output of which is connected to the drive unit 46. The VFD 54 supplies a control signal to the starter 58 for starting and stopping the drive unit 46, and therefore the pump 44. The drive unit 46 may also be a variable frequency drive.

A control system 60 is provided which contains computer programs stored on computer-readable media and containing instructions for controlling the operation of the centrifuge and the pump 44. To this end, the control system 60 has several input terminals two of which are respectively connected to the VFDs 54 and 56 for receiving data from the VFDS, and two output terminals for respectively sending control signals to the VFDS. The control system 60 thus responds to the input signals received and controls the VFDs 54 and 56 in a manner so that the drive units can continuously control the system and vary the frequency and the voltage applied to the respective AC motors 24 and 34, to continuously vary the rotation and the torque applied to the drive shaft 21 and to the sun wheel 35, respectively.

The control system 60 has another input terminal connected to the drive unit 46 with a motor 46*a* for receiving data from the drive unit 46. Another output terminal of the control system 60 is connected to the drive unit 46 for sending control signals to the drive unit 46. The control system 60 thus responds to the input signals received from at least one the VFDs 54 and 56 and can send corresponding signals to the drive unit 46 to for varying the operation of the pump 44. Another input terminal of the control system 60 is connected to the limit switch 38*a* which provides a signal in response to excessive torque being applied to the gear box 32.

Mounted on the outer surface of the bowl 12 is a vibration detector 62 which is connected to the control system 60, and responds to excessive vibrations of the centrifuge for generating an output signal that causes the control system to send signals to the VFDs 54 and 56 to turn off the motors 24 and 34, respectively and therefore shut down the centrifuge.

Near the bearings 22 and 33 are connected a pair of accelerometer sets 64*a* and 64*b*, each set including two accelerometers for respectively measuring certain operational characteristics of the drive shafts 21 and 20 and their associated bearings. The accelerometer sets 64*a* and 64*b* are connected to the control system 60 for passing their respective output signals to the control system 60 for processing. The accelerometer sets 64*a* and 64*b* can be of the type disclosed in U.S. Pat. No. 4,626,754, the disclosure of which is hereby incorporated by reference.

Each accelerometer set includes two or more accelerometers having orthogonal axes that are placed on the frames of the bearings 22 and 33 for detecting vibrations caused by the rotating bowl 12 and screw conveyor 18, as well as the drive shaft 21 and the sun wheel 35. The signals provided by the accelerometers of each set 64*a* and 64*b* are passed to the control system 60 where a computer program contained therein analyzes the signals for the presence of specific predetermined frequency signatures corresponding to particular components and their status, which could include a potentially malfunctioning condition. The computer program is designed to provide instructions to produce an output in response to any of these frequency signatures being detected. The back current to the drive units 24 and 34, are proportional to the loading of the bowl 12 and the conveyor, respectively, the values of which is fed back to the control system 60.

The control system 60 has conventional devices including, but not limited to, programmable media, computer(s), processor(s), memory, mass storage device(s), video display(s), input device(s), audible signal(s), and/or programmable logic controller(s). Optionally, e.g. in field applications, a generator is provided which generates electrical power and passes it to a breaker box which distributes the power to the VFDs 54, 56, and 46. Optionally, the VFD 54 (and any VFD of the system 10 and any VFD disclosed herein) can have a manual potentiometer apparatus 54*a* for manually controlling a motor; a torque display apparatus 54*b*; an rpm/speed display apparatus 54*c;* and/or an HMI apparatus (human-machine interface, e.g. a touch screen system) 54*d* which provides a visual display of the system operation and a tactile means of control.

In one method according to the present invention, the storage tank 40 receives the slurry, (which, in one particular aspect, is a mixture of drilling fluid and drilled cuttings). The control system 60 sends an appropriate signal, via the VFD 54, to the starter 58 which functions to start the VFD 46 and activate the pump 44. The slurry is pumped through the conduit 42 and into the interior of the bowl 12 under the control of the control system 60. The motor 24 is activated and controlled by the VFD 54 to rotate the drive shaft 21, and therefore the bowl 12, at a predetermined speed. The motor 34 is also activated and driven by the VFD 56 to rotate the sun wheel 35, and therefore the screw conveyor 18, through the planetary gear box 32, in the same direction as the bowl 12 and at a different speed. As a result of the rotation of the bowl 12, the centrifugal force thus produced forces the slurry radially outwardly so that it passes through the openings 18*a* in the conveyor and into the annular space between the conveyor and the bowl 12. The drilling fluid portion of the slurry is displaced to the end 12*b* of the bowl 12 for discharge from the weirs 19*a* in the flanged shaft 19. The entrained solid particles (drilled cuttings) in the slurry settle towards the inner surface of the bowl 12 due to the G forces generated, and are scraped and displaced by the screw conveyor 18 back towards the end 12*a* of the bowl for discharge through the discharge ports 12*c*.

The control system 60 receives signals from the VFD 46 corresponding to the pumping rate of the pump 44, and signals from the VFDs 54 and 56 corresponding to torque and speed of the motors 24 and 34, respectively. The control system 60 contains instructions which enables it to process the above data and control the VFDS. The control system 60 controls the VFDs 54 and 56 to vary the frequency and voltage applied to the motors 24 and 34, as needed to control and/or continuously vary the rotational speed of, and the torque applied to, the drive shaft 21 and the sun wheel 35, to maintain predetermined optimum operating conditions. The control system 60 also monitors the torque applied to the sun wheel 35 from data received from the VFD 56 and maintains the torque at a desired level. In the event one of the inputs to the control system 60 changes, the system contains instructions to enable it to change one or more of its output signals to the VFDs 54 and 56 and/or the VFD 46, to change their operation accordingly. The accelerometer sets 64*a* and 64*b* respond to changes in rotational speed of the drive shaft 21 and the sun wheel 35, and therefore the bowl 12 and the conveyor 18, in terms of frequency, as well as changes in the drive current to the motors 24 and 34 in terms of amplitude which corresponds to load, and generate audible beats corresponding to frequency changes that occur as the loading on the bowl and the conveyor change. These audible beats are processed by the control system 60 and enable the predetermined optimum operating conditions to be attained. In the event the centrifuge becomes jammed for whatever reason the control system 60 will receive corresponding input signals from the VFDs 54 and/or 56 and will send a signal to the starter 58 to turn off the pump 44 and thus cease the flow of the feed slurry to the centrifuge.

FIGS. 4-7 illustrate one method according to the present invention for automatically controlling the speed of the motor 34, the speed of the motor 24, and the differential between these speeds. In one aspect, each VFD has its own on-board controller with programmable media, e.g. a programmable logic controller ("PLC"), 54*p*, 56*p*, 46*p*, respectively, for controlling the VFDs and for communicating with all the system's apparatuses and devices (as indicated, e.g., by the dash-dot lines to each PLC). Any VFD can initiate any command for any apparatus or device and each VFD can communicate with the other VFD's. In one particular aspect as shown in FIG. 1, the control system 60 is deleted. FIGS. 4-7 show a program for programming the PLCs 54*p*, 56*p*, and 46*p* which, in certain aspects, can all intercommunicate and which, in certain aspects, have programmable media programmable to recognize and operate a certain size and type of motor, to perform a certain task or tasks, and/or to communicate with other items or apparatuses. Alternatively, programmable media PM in the control system is programmed in this way. Optionally, in any system herein the tank 40 (and any known container, tank, reservoir or cuttings box) can have an agitator system 70 according to the present invention which includes an agitator 71 with a housing 76 and with a blade or blades 72 on a rotatable shaft 75 for agitating material and a VFD variable frequency drive 73 for controlling the system 70 (and/or the system 70 can be controlled by the system 60). Optionally, the VFD 73 may have its own on-board programmable logic controller 74. In one aspect, the control system 60 and/or one, two, or three, of the on-board controllers (e.g. one or more of the on-board PLCs) includes recording media for recording inputs made by personnel so that a record is provided of personnel efforts to control the centrifuge system and/or to change its operating parameters. In one particular aspect such a record is provided which identifies each individual operator.

Figure 2A:
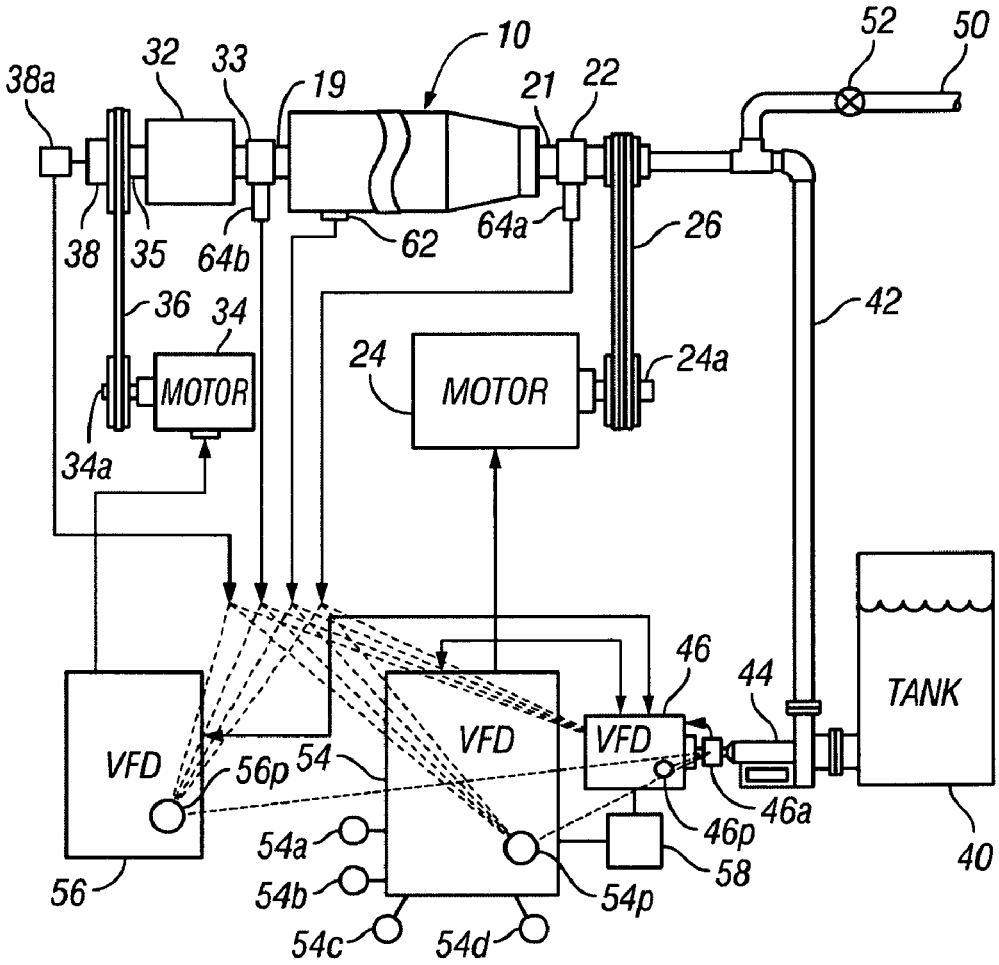
FIG. 2A is a schematic view of a system according to the present invention.
Figure 3:
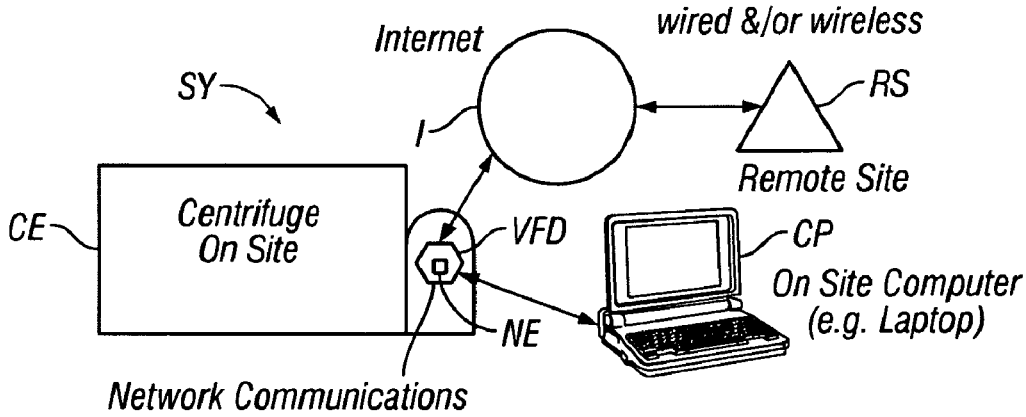
FIG. 3 is a schematic view of a system according to the present invention.

As shown in FIG. 3 a system SY according to the present invention has a centrifuge CE (or centrifuges) on site at a rig with motors and VFD's as in the systems of FIG. 2 or 2A or any system according to the present invention. The VFD has network communications apparatus NE which provides communication via a system such as the Internet I between the VFD and personnel and/or apparatus at a remote site RS for remote control of the VFD and thus of the centrifuge CE. Remote programming and reprogramming of programmable media associated with the VFD is possible according to the present invention. The apparatus NE also, in one aspect, provides communication between the VFD and an on-site computer system CP (e.g. laptop, desktop) with either a wired or wireless connection so that personnel on-site can control the VFD and, with a VFD that has associated programmable media (e.g., but not limited to, a PLC) program and reprogram the programmable media.

Figure 4:
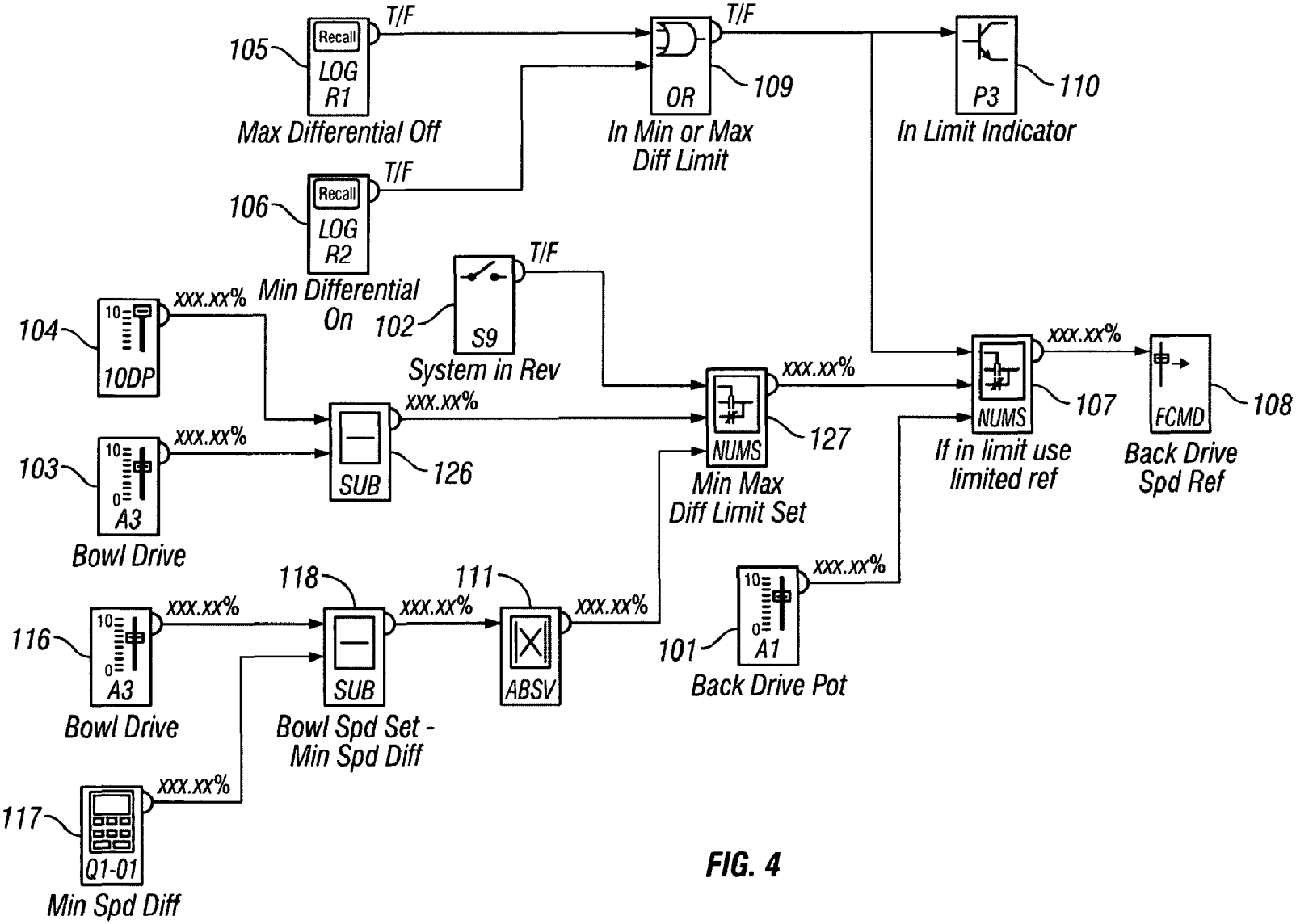
FIG. 4 is a schematic view of a computer method according to the present invention.

As shown in FIG. 4, the program decides whether a manual setting (Block 101) of the speed of the motor 34 is acceptable or whether the manual setting (set by operator personnel) is to be automatically overridden. Block 107 receives inputs from Block 101 which indicates the speed of the motor 34 which has been manually set and inputs from Blocks 127 and 109 which indicate whether a maximum or minimum speed differential (differential between speeds of motors 34 and 24) has been exceeded. If the speed differential based on the manually set speed for motor 34 (Block 101) is within the pre-set limits, the system is allowed to proceed in operation with the manually set speed. If the speed differential for the manually set speed exceeds either the maximum or the minimum limit, then the PLCs 56*p* take over and automatically override the manually set speed for the motor 34. In the event that the system does automatically override the operator, a limit indicator (Block 110) is activated to tell the operator that the operator is no longer in control of the system.

The program, when operating in automatic override mode, produces from Block 107 a signal indicative of actual allowable bowl speed communicated to Block 108. Block 108 provides a signal to the VFD 56*p* which is indicative of the frequency of power the VFD is to provide to the motor 34 to drive the motor 34 at a selected speed so that a desired speed differential between the motor 34 and the motor 24 is achieved. Program Block 111 provides a signal to the Block 108 which is an allowable minimum speed differential and this prevents the communication of speed differential from the Block 107 which is to high or too low.

Block 102 indicates to Block 127 whether the motor 34 is running in forward or reverse. This is important because there are different limits on allowable speeds for different motor directions. When the motor 34 is running forward (e.g. for processing relatively clean fluid), the minimum speed differential reference (Block 18) is the bowl speed (Block 116) minus an entered minimum differential reference (Block 117), a value that prevents sudden centrifuge clogging. Block 118 communicates to Block 127 a percentage of actual allowable bowl speed minus a pre-set minimum percentage. Block 111 converts the value from Block 116 to an absolute (always positive) value.

When the motor 34 is running in reverse (e.g. for processing slurries with a relatively high solids level) the maximum speed differential is calculated to produce an allowable maximum speed differential which is fed to Block 127. The 100% reference speed (allowable speed) of Block 104 the minuend of Block 126 (the fastest speed at which the bowl can operate) and the subtrahend is from Block 103 (actual bowl speed). The resulting remainder signal produced by Block 126 indicates the allowable maximum speed differential and becomes the motor 34 speed reference for Block 127 whenever an excessive speed differential is detected by Block 109 while the motor 34 is running in reverse. Block 110 turns on a status lamp which indicates that the program is limiting the speed reference for the motor 34, reducing the speed differential, and overriding the operator's setting.

Blocks 105 and 106 indicate whether the operator's manual setting is acceptable. If not, i.e. if the maximum speed differential is exceeded by the operator's setting (Block 105) or if the minimum speed differential is exceeded by the operator's setting (Block 106), Block 109 is told to regard this and an appropriate signal is communicated to Blocks 107 and 110. In certain preferred embodiments the scroll or conveyor speed is maintained slower than the bowl speed and this is accomplished with a system as shown, e.g., in FIG. 4. With such a system the scroll or conveyor speed is automatically prevented from equalling or exceeding the bowl speed. In one aspect, such a system enhances gear box life.

Figure 5:
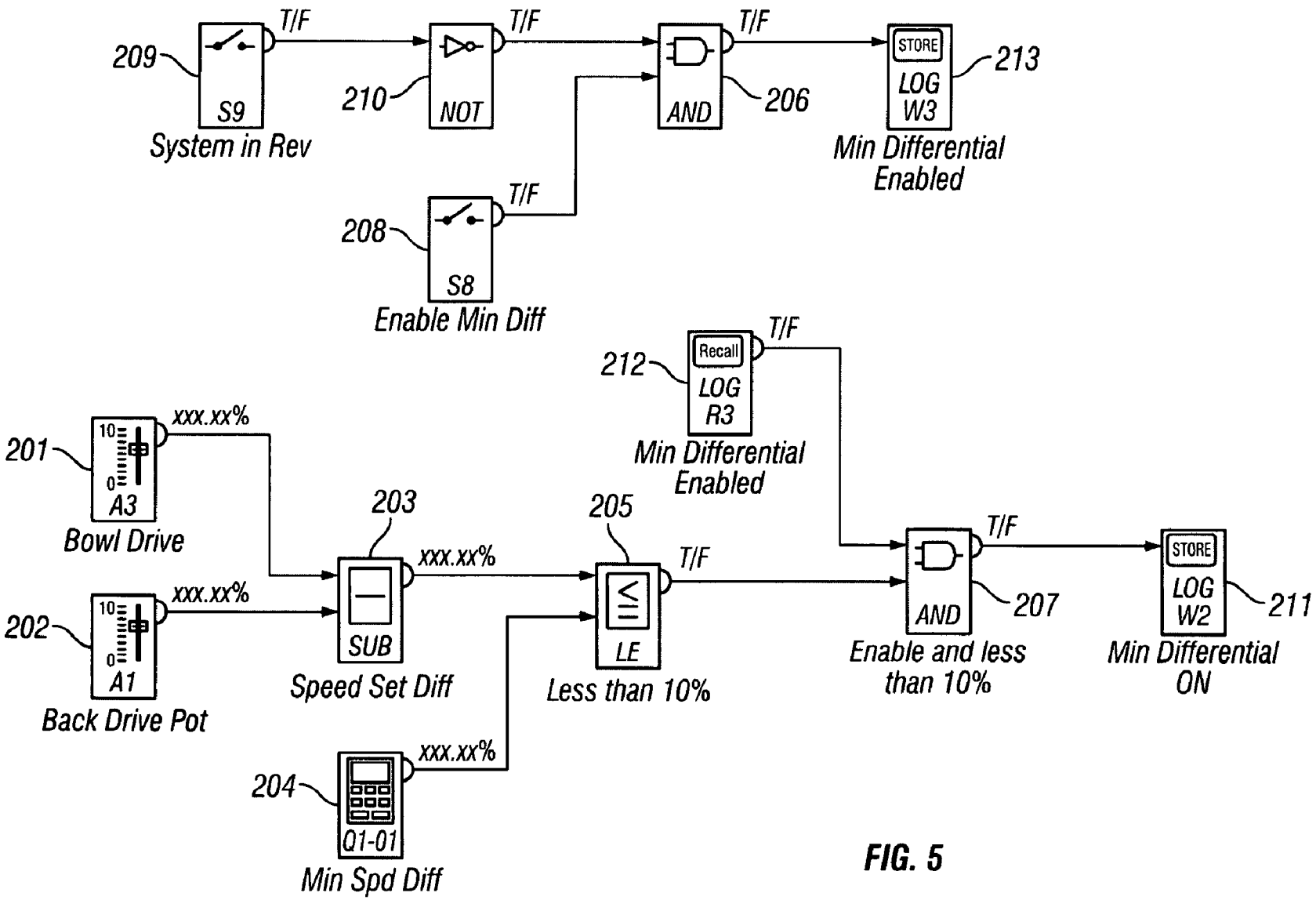
FIG. 5 is a schematic view of a computer method according to the present invention.

FIG. 5 illustrates the detection of the desired minimum speed differential between the speeds of the motors 34 and 24. An operator manual sets a minimum speed differential (Block 204). Block 209 indicates whether the system is running in reverse (i.e., not forward). Block 208 indicates whether the system is actually running. If the system is running, and is running in reverse, Block 206 is "true" and this "true" indication is stored in Block 13 which is read by Block 212. Block 212 indicates that a minimum speed differential is enabled.

Block 207 receives the indication from Block 212 that the minimum speed differential is enabled (and also the value for this differential) and, from Block 205, whether the actual (in real time) speed differential (from Block 203) is less than 10% of what was set in Block 204. If the indication from Block 205 is that the actual speed differential is less than 10% of what the operator set, and Block 212 indicates that the minimum speed differential is enabled, then Block 207 sends a signal to Block 211 that the system must override the manual setting and control the speed differential. The indication of Block 211 is used by Block 106, FIG. 4 ("W2" indicates write number to memory; "R2"' indicates read number from memory). This causes the programmed logic (FIG. 4) to switch the speed reference source from Block 101 to Block 127 and Block 107 selects Block 127.

Figure 6:
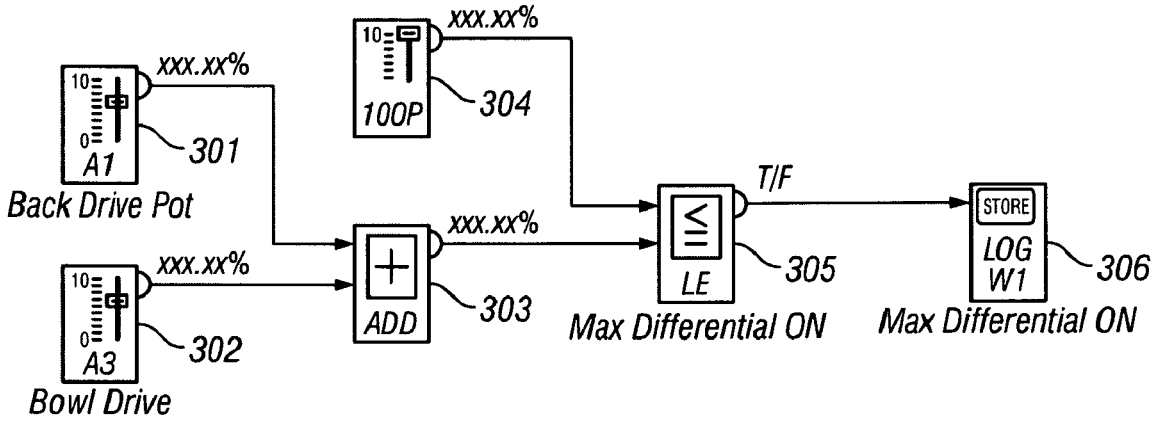
FIG. 6 is a schematic view of a computer method according to the present invention.

FIG. 6 illustrates programming for detection of whether the automatic maximum speed differential is on. In Block 303 the actual (in real time) speed of the motor 34 (Block 301) is added to the actual speed of the motor 24. The resulting sum is compared (in Block 305) with a pre-set maximum speed differential (from Block 304). If the comparison indicates that the actual speed differential exceeds the maximum speed differential, Block 305 communicates this to Block 306 and that the maximum speed differential function is "on." This indication is used by Block 105, FIG. 4.

Figure 7:
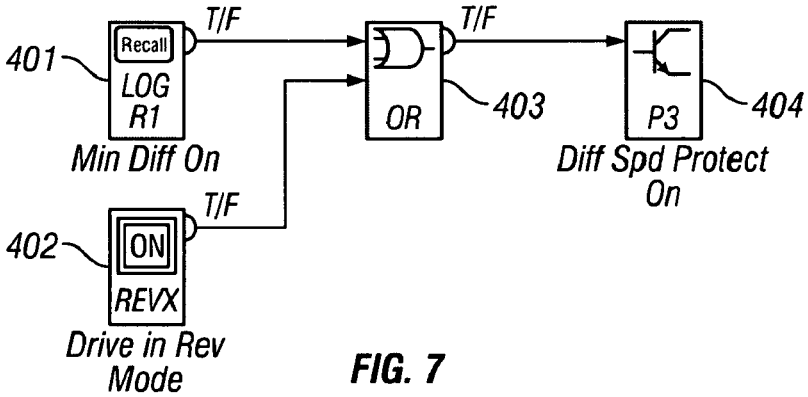
FIG. 7 is a schematic view of a computer method according to the present invention.

FIG. 7 provides an indication that the system is in protective mode (e.g. when the system overrides manual personnel inputs). In this mode an operator cannot do what he is attempting to make the system do and, optionally, the system can provide an alarm at remote site regarding such an operator attempt and/or that the system is in protection mode. Block 402 provides an indication that the drive is (or is not) in reverse mode. Block 401 indicates whether the system is within a desired minimum speed differential between conveyor and bowl. Block 403 provides a signal indicative of the situation in which the drive is not in reverse and the system is not within the minimum speed differential. Block 404 acts on the signal from Block 403 and places the system in protection mode.

Figure 8:
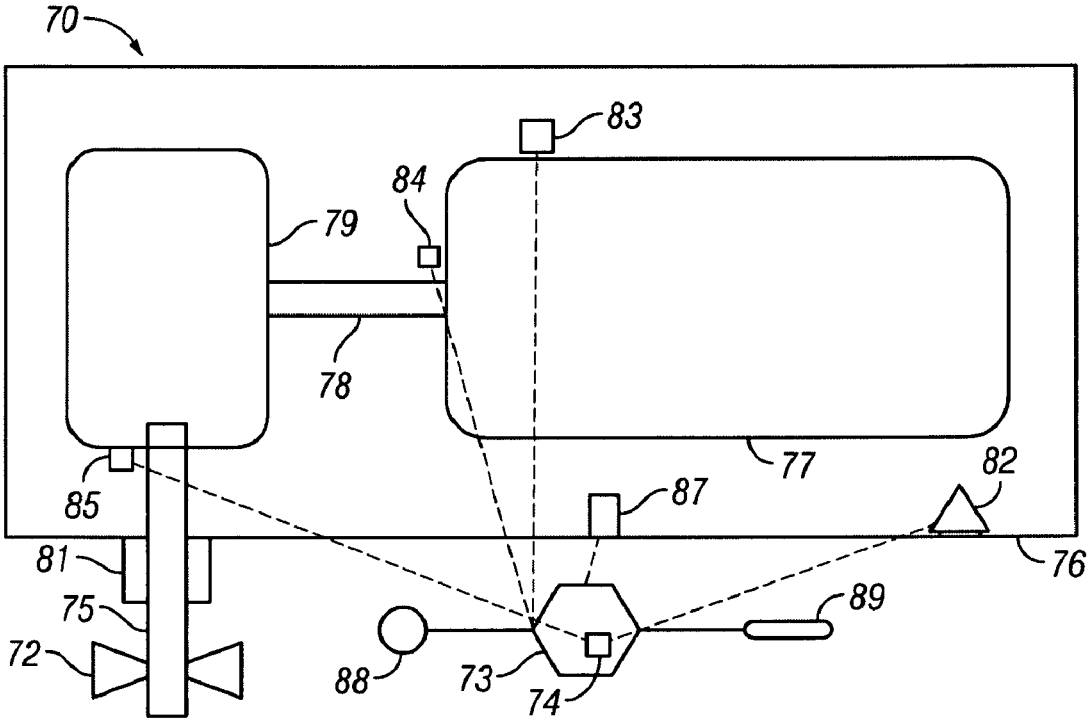
FIG. 8 is a side view of a system according to the present invention.

FIG. 8 shows an embodiment of a system 70 as in FIG. 2 and like numerals indicate like parts. A drive motor 77 drives a shaft 78 which is coupled with a coupling or gear mechanism 79 which, in turn drives the drive shaft 75 and the blade (or blades) 72. A stuffing box 81 or other suitable seal apparatus seals the shaft exit point from the housing 76. A moisture sensor 82 in communication with the VFD 73 and/or the PLC 74 senses the moisture level within the housing 76 and conveys a measurement of this level to the VFD 73 and/or PLC 74. Sensors 83, 84, and 85 sense motor speed and shaft speeds and/or current usage, and convey this information to the VFD 73 and/or PLC 74. The VFD itself can provide current and speed measurements.

Figure 9:
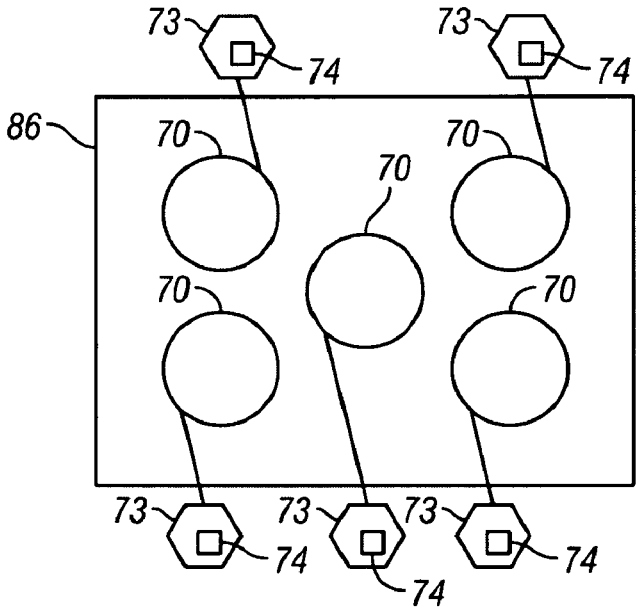
FIG. 9 is a top view of a system according to the present invention.

As shown in FIG. 9, a tank etc. according to the present invention may have two, three, four, five (as shown) or more agitator systems 70 according to the present invention each with its own corresponding VFD 73 and/or PLC 74.

In many prior art systems, an agitator is simply an on/off apparatus which, when it fails, is removed and replaced without any monitoring of its operation until failure. Several things cause agitator failure, e.g. lack of lubrication; and several things inhibit efficient agitator operation, e.g. injury to or loss of an agitating blade.

With a system according to the present invention various sensed parameters and measurements provide an indication of agitator wear, injury, and/or failure. If a gear mechanism or motor requires an increase in current (which can be sensed by the sensors in these items and/or by a VFD), this can indicate a lack of proper lubrication. This problem can be sensed, alarmed and/or displayed, (e.g. on an on-site or remote display 88) and then remedied prior to agitator failure. optionally, the VFD can stop the motor so that proper lubrication can be achieved. optionally, the system can shut down other agitators in the same tank, etc. until the problem is dealt with.

If the system measures a decrease in current to an agitator, this can indicate a damaged or lost blade. The system can provide an alarm and/or display of the situation and/or shut the agitator down until the blade is repaired or replaced (and shut down other agitators until such repair or replacement).

Initially with an agitator or agitators in good working condition the system can measure average current to the agitator or agitators and, during future operation, if a deviation from these averages is sensed, the system can determine the agitator or agitator with the deviation and whether it is deviant due to an increase in current or a decrease in current—each of which can indicate particular problems. With separate VFD's for each of a plurality of agitators in a tank, different agitators can be run at different speeds. When moisture is sensed within an agitator housing, this can indicate a break in the housing or a failure of the shaft stuffing box or seal. As with the response to any sensed parameter, in response to failure or a condition that can lead to failure, the system can shut down the agitator and/or provide an alarm either on-site or remote. Prior to agitator failure, the system can provide a warning and/or indicate scheduled maintenance and/or preventive maintenance is needed before an agitator actually fails.

The display 88 can be used to monitor the agitator(s) in real time. Any suitable recording apparatus 89 (in certain aspects in a VFD or in a PLC) can record all sensed data and can provide access to the data. A heat sensor 87 interacts with the VFD and/or PLC as does the sensor 82. optionally, all sensors are in communication with a control system like the control system 60 described above.

In certain embodiments, (see, e.g. FIGS. 10-19) systems according to the present invention provide tests, checks, and intelligent diagnostics specific to oil rig operational scenarios, to vibratory separator operation and, in particular aspects, to centrifuge operational scenarios which enhance oil rig safety and efficiency of oil field drilling operations, in certain particular aspects when applied to an automatically operated centrifuge with an electronic and/or computerized control system to ensure continuous and proper system operation and availability during downhole operations. In certain systems according to the present invention failures, performance degradation and/or predicted failures are reported to service personnel that perform additional diagnostics or dispatch field personnel to replace or repair the systems as necessary.

The present invention provides a method and apparatus for remotely monitoring, analyzing and affirmatively notifying appropriate personnel of problems and events associated with an oil recovery system comprising one or more, e.g. hundreds, of oil rigs over a vast geographic area. The present invention provides a monitoring and reporting system that is referred to as a Health Check system. The present invention provides a variety of performance monitoring sensors at each oil rig in an oil recovery system, and, in certain aspects, for each centrifuge of an oil rig. The results of selected diagnostics, which are run on each oil rig and/or on each centrifuge, are reported to a central server. The central server automatically populates a database for the oil recovery system and displays a red/yellow/green/gray color-coded report for each rig and/or for an entire oil recovery system. The present invention also affirmatively alerts appropriate personnel of actions required to address events associated with an oil rig in an oil recovery system. The diagnostics performed at each oil rig are configurable at the individual rig. The central server need not change its reporting and display program when changes are made to a heath check at an oil rig. The present invention provides a dynamic oil rig status reporting protocol that enables construction and display of a tree node structure representing an entire oil recovery system status on a single screen. Preferably, top level information is presented on a single screen, and detailed information presented when one drills down in to other screens. Thus, the present invention enables rapid visual affirmation of a system Health Check.

A Health Check is an automated test that is running on the rig and monitoring something, e.g., but not limited to, a centrifuge, for acceptable performance, indication of problems, etc. These tests could be applied to equipments, drilling processes, or an operator's usage of particular drilling equipment, e.g., but not limited to, centrifuge(s). The results are then communicated to a central server located in a service center through a unique protocol, which allows automatic distribution and display of information and/or directly from a centrifuge to an Internet interface. A test program on a rig can be modified and that change will flow automatically through communication, storage and display of the resulting Health Check data for the rig.

The service center based web server allows secure access to Health Check results. The results are presented in "top down tree" mode with red/yellow/green/gray colors. The red color indicates the failure of a test or flagging an event of interest, the yellow color indicates that the health test has found some abnormality that may need attention, green indicates successful completion of a test, and gray color indicates inability to conduct a test. The bottom-most node of the "top down tree" contains the results of a Health Check. The workcase result is successively carried up to the next level, until topmost node (which in most cases is the drilling rig, group of rigs or oil recovery system) is reached.

Each Health Check result can be configured to generate a message (email, phone call, PDA, etc.) to alert single or multiple persons in case of test failure. The data transfer protocol is well defined, such that other development groups or third parties can easily develop Health Check tests, generate results and feed information to the central server. Test results are transferred from the rig to the server using a novel data protocol that dynamically defines the structure of the data, that is, the node tree structure of the data by the naming convention of the protocol. Thus, the results are simply stored and displayed using the structural definition provided in the communication protocol. This allows for extreme flexibility in the definition of new programs and results to run and report at oil rigs without requiring a change in the communication protocol, notification function or the display and storage functions at the central server. The bottom-most nodes in the tree structure contain test results. Each test comes into the central server as a record containing node information as to where the information fits within the tree structure, an identifier for the test, a test result (red/yellow/green/gray) and intermediate data such as error codes, operator entry data and test data description. Thus, no results processing need occur at the central server. The central server only archives and display results and issues affirmative (with acknowledgement) and regular notifications as required.

Events or conditions can be set for notification, thus, once the event or condition occurs and after it is set for notification, a notification is sent to a designated person reporting the event of condition. A list of persons can be associated with each oil rig and event or condition. A notification can be sent to a cell phone, PDA or other electronic device. A notification can comprise a text, audio or video message to a user. A notification tells the rig status color code, text, aural or video. A user can call into the central server to check the status of an oil rig or oil recovery system. The status returned is a notification message indicating that the rig is okay or that a problem or condition of interest has occurred. Thus, the Health Checks are different than alarms, although alarms (including those alarms generated by prior or legacy systems) can be used as inputs to a Health Check where the alarms are processed and considered by Health Check rather than sending an alarm immediately to oil rig personnel. Health Check may indicate that piece of equipment is out of range and should be replaced in the near future, however, supercritical alarms can be processed by Health Checks to generate an immediate notification.

In certain aspects, the present invention (and any and all steps and/or events described above for any scenario) is implemented as a set of instructions on a computer readable medium, comprising ROM, RAM, CD ROM, Flash or any other computer readable medium, now known or unknown, that when executed cause a computer or similar system to implement the method and/or step(s) and/or events of systems and methods according to the present invention, either on-site or remotely or both.

The present invention is described herein in certain aspects for use on drilling rigs, however, numerous other applications are intended as appropriate for use in association with the present invention.

The present invention provides a user interface, which, in one aspect, is preferably mounted to existing rig floor structure and also provides a pedestal mount with adjustable height, for convenient choke operation. A wireless version is also provided.

The present invention supports real-time two-way data communication, e.g., with Varco International, Inc.'s RigSense and DAQ JVM, and with other commercially available information systems. In one aspect any sensors whose data is used by the present invention (for control and/or display) are directly connected to the present invention, including, but not limited to, sensors on a shale shaker or shakers.

In one aspect, when the RigSense system is present in an embodiment of the present invention, the RigSense system provides data archiving and expanded data displays functionality to the present invention. The present invention provides a user interface integrated into other systems such as the RigSense system, DAQ JVM and VICIS; Real-Time Well Control, supervisory control specific to well control tasks; and Automated well control, which may be entire process or selected sub-tasks. One of the primary impacts perceived on existing products and services in which integration and/or implementation of the present invention is performed is additional capability for taking control of and/or being in control of the choking operation via a distinct intervention, so that control is clearly being exercised by users at other stations and by automated controllers.

A key factor for efficient utilization and integration of the present invention into the operator's working environment is the present invention's provision of manual controls for high-frequency user control actions in lieu of touch screen control consoles. Additional automated functionality is provided such as automatic pressure-set control for use in association with the touch screen and provides benefit in the control area, particularly in emergency stations. In an alternative embodiment a touch screen user interface is provided.

In another embodiment, the present invention is implemented as a set of instructions on a computer readable medium, comprising ROM, RAM, CD ROM, Flash or any other computer readable medium, now known or unknown that when executed cause a computer to implement a method of the present invention.

The present invention provides a method and apparatus for remotely monitoring, analyzing and affirmatively notifying appropriate personnel of problems and events of interest associated with an oil recovery system comprising one or more, e.g. hundreds, of oil rigs over a vast geographical area or a single rig. The present invention provides a monitoring and reporting system that is referred to as a Health Check system. The present invention provides a variety of performance, process and equipment monitoring Health Checks and equipment sensors at each oil rig in an oil recovery system. The present invention provides a dynamic oil rig status reporting protocol that enables population and display of a tree node structure representing an entire oil recovery system or single oil rig status on a single screen. Thus, the present invention enables rapid visual or aural affirmation of a system Health Check.

Health Checks are not the same as alarms. An alarm is an immediate notification to an operator that a known unacceptable condition has been detected, requiring the operator's awareness of it and often some action by the operator. A Health Check may use alarms in its logic, but it is by nature different than an alarm. A heath check is more general and more diagnostic than an alarm, and does not require immediate action, at least not on the oil rig. In the present invention, a problem is reported to a central server for reporting and diagnosis to service personnel. A Health Check can apply to any equipment component or process, sensors, control systems, operator actions, or control processes, etc.

The Health Check system comprises software containing test logic. The logic is configurable so that inputs, outputs and logic can be selected by a user to test and look for any condition or event associated with an oil rig or oil recovery system. The overall system in certain aspects comprises Health Checks running in real time on a computer at an oil rig and a communications network connecting the oil rig to a central server to move data from the rig of a group of rigs to the server. The server displays the results in hierarchical form. The server sends commands, application programs and data to the rig from the server.

The Health Check system of the present invention further comprises, in certain aspects, a central database populated with dynamic status reported from oil rigs comprising an oil recovery system. The present invention further comprises a web page display for efficiently displaying Health Check results associated with a test, a rig, an area or an oil recovery system. The web page results can be displayed on a computer, cell phone, personal data assistant (PDA) or any other electronic display device capable of receiving and displaying or otherwise alerting (e.g., sound notification) a user of the status of the data. The preferred screen is a color screen to enable red/green/yellow/gray display results. Results can also be audio, video or graphically encoded icons for severity reports, e.g., an audio message may state audibly, "situation green", "situation red" or "situation yellow" or display a particular graphical icon, animation or video clip associated with the report to demonstrate a Health Check severity report. The present invention enables drilling down (that is, traversing a hierarchical data structure tree from a present node toward an associated child or leaf node), into a tree of nodes representing diagnostic status, to a node or leaf level to access additional information regarding a color-coded report.

The present invention also provides a notification system to immediately inform service personnel of problems as necessary, such as a message or email to a cell phone or pager or computer pop up message. There is also a receipt affirmation function that confirms that a notification message was received and acknowledged. Secondary and tertiary notifications are sent when a primary recipient does not acknowledge an affirmative notification within a configurable time limit. A severity report associated with a given problem is represented by a blinking color when it is unacknowledged and remains a blinking color until the given problem is cleared and returns to green or clear status. Severity reports once acknowledged change from blinking to a solid color. Reports that have been acknowledged by one user may be transferred or reassigned to another user upon administrative permission by a system supervisor or by requesting permission to transfer a second user and receiving permission from the second user. A system supervisor can also display a list of users and severity reports being handled by the user, that is, a list of acknowledged and in progress severity reports assigned to a particular user to view and enable workload distribution to facilitate reassignments for balancing the work load.

A dispatch may assign a work order to a group of particular severity reports. Once the work order is completed the system checks to see if the nodes associated with the work order have been cleared. The work order provides a secondary method for determining if nodes associated with a work order have been cleared after a work is complete. The system administrator software program can also automatically check the work order against the node state for a system check.

The advantages provided to the customer of a preferred Health Check system are substantially less down time due to the present invention's Health Check's ability to find or anticipate problems earlier and fixing the problems faster, ideally before the customer becomes aware that a problem has occurred. The present invention reassures the customer that the Health Check system is always on the job and monitoring and reporting on the oil recovery system twenty-four hours a day, seven days a week. A customer or system user can always call in and confirm the status of an entire oil recovery system or single rig with a single call to the central server or a rig and receive a situation report, that is situation red, yellow, green or gray for the oil recovery system or single rig, as requested. The present invention enables more efficient use of operational service personnel. The present invention finds and reports problems, potential problems and trigger events of interest, which enables rapid response and recovery in case of actual and/or potential equipment or operator malfunctions or the occurrence of a particular event. The present invention also helps to find problems at an early stage when the problems are often easier to fix, before catastrophic failure, thus creating less impact on the customer's oil recovery system or individual oil rig. Health Checks according to the present invention provide a method and apparatus for providing an application program that acts as an ever-vigilant set of eyes watching an entire oil recovery system or single rig to ensure that everything is okay, that is, operational.

In certain embodiments, all results for each oil rig in an oil recovery system or individual oil rig or equipment, e.g., but not limited to, a shaker or shakers, are worst-case combined so that the worst-case severity report bubbles to the top of the reporting tree and is reported as the status for an entire oil recovery system, oil rig(s), event of interest, process, or equipment being analyzed. As discussed above, red is a worst-case severity report, followed by yellow severity report and then green is the least severe report. Gray indicates no data available. Thus, if one or more tests reporting a red status is received from an oil rig, the red status bubbles up past all yellow and green status reports and the status for the rig and the entire oil recovery system in which the rig resides is shown as red. Once the red report is cleared, yellow reports, if any, bubble up and the status of the oil recovery system, rig or equipment being viewed is shown as yellow, if a yellow report is in a node tree transmitted from any oil rig in an oil recovery system. The status for a single oil rig bubbles up the worst-case report as well, however, localized to the single rig or rigs under investigation, unless grouped. When grouped the worst-case status for the group is reported. For example, if three rigs were reporting the following scenario is possible: Rig 1 reports red, rig 2 reports yellow and rig 3 reports green. The status for a group selected to include rigs 1, 2 and 3 would be red. The status for a group selected to include rigs 2 and 3 would be yellow. The status for a group selected to include rig 3 only would be green. Subsections within a rig can also be selected for a color-coded status report. Preferably, the gray is not cleared. Usually, if the test were not conducted for any reason, the status would take gray color.

The present invention enables testing at the nodes of a bottom up tree structure representing an oil recovery system, a single rig therein, or an equipment in an oil rig, wherein the nodes carry the results to the top for easy visualization and use.

The present invention also provides a dynamic reporting protocol for data transfers from an oil rig to a central server wherein level identifiers are provided to transfer data and its structure in a single packet transfer, thus enabling dynamic data base population and display of reports from an oil rig. The results are presented on a web page or reported to cell phones, computers, pagers, personal data assistants or otherwise affirmatively reported other wise to appropriate personnel. In a preferred embodiment, reports are acknowledged by a first recipient or a second recipient is selected for receipt of the report when the first recipient does not acknowledge receipt, and so on, until a recipient has received and acknowledged the report. Alternatively multiple recipients may simultaneously get the notification.

The present invention is automatically scaleable and extensible due to the modular and dynamic nature of its design. Tests can be easily created, added or deleted and parameters added or modified on an oil rig equipment test or Health Check without reprogramming or changing the central server's database population, data reporting and data display applications. The reporting can vary between broad coverage and specific coverage, that is, a status report can included data for an entire oil recovery system comprising over 100 oil rigs and/or specifically report status for a single oil rig of interest concurrently.

The present invention provides early warning of potential and actual failures and also provides confirmation of product performance and usage. A set of automated Health Checks and diagnostic tests is selected to run in real time on an oil rig. Status from the test is reported continuously via a communication link between the oil rig and a central server. The present invention provides insight and analysis of equipment, processes and equipment usage on an oil rig. The present invention monitors alarms and parameter limits to assess necessary action and perform affirmative notification of appropriate personnel.

The present invention provides quick response, real-time monitoring and remote diagnostics of the automation and control systems running on oil rigs comprising a fleet of oil rigs or an oil recovery system to achieve maximum rig performance while maintaining optimum personnel allocation. A service center is connected to the oil rigs through an Internet based network. System experts make real-time data and logged data from the oil rigs available for perusal and analysis in a central facility or at distributed locations. The web site of the present invention provides access to current operational status as well as to historical operation and performance data for each of the rigs comprising an oil recovery system.

Health Check tests are configurable so that new tests can be created, added or deleted and parameters changed for execution at an oil rig without the necessity of programming. A simple user interface is provided wherein a user at the central server or at an oil rig can select a test from a library of existing tests, or create a new test using a scripting language, natural language interface or pseudo language is provided which generates a script defining inputs, outputs and processing logic for a test. The script is compiled and sent to the rig for addition to existing Health Checks running on the rig. The user interface also enables modification or addition and deletion of parameters associated with a Health Check or test.

Notifications can be an immediate message when a problem is detected or an advisory notification. The notification is sent to expert service personnel associated with the central server or can be directed to a service manager or local service person closest to the rig needing service. For each rig and problem type, a particular person or service personnel category is designated for receipt of a notification. Secondary and tertiary backup personnel and personnel categories are designated as a recipient for each notification. Affirmative notifications must be acknowledged by the recipient so that the problem is acknowledged and someone has taken responsibility for the problem. If an affirmative notification is not acknowledged within a configurable time period, then a secondary or tertiary recipient is notified until the problem is acknowledged. Reliability reports are generated by the present invention showing performance summaries for oil rigs, comprising up time, response, problems detected and solutions provided. These reports provide an objective basis for formulating an evaluation of the Heath Check system's efficiency.

The results from a rig include processed inputs from the rig. No processing is required at the central server, other than display, storage and alerts to appropriate personnel. The oil rig Health Checks and tests are configurable so no programming is required to implement a new test or change logic or parameters for an existing test. A field engineer or central server personnel can add a new test without requiring a user to perform a programming change. The present invention provides a local or remote user interface, which provides a simple interface for describing a test and logic. The interface comprises an iconic presentation, pseudo language, script or a natural language interface to describe a test's input(s), processing logic and output(s). The user interface interprets a user's inputs and converts the user's input into a scripting language. The script language is compiled and sent to the rig on which the new or augmented test is to be performed. The new test is added to a library of tests from which a user may choose to have run at a rig. Test modules can be deleted, added, parameters changed, and updated from the oil rig, the central server or from a remote user via a remote access electronic device.

Figure 10:
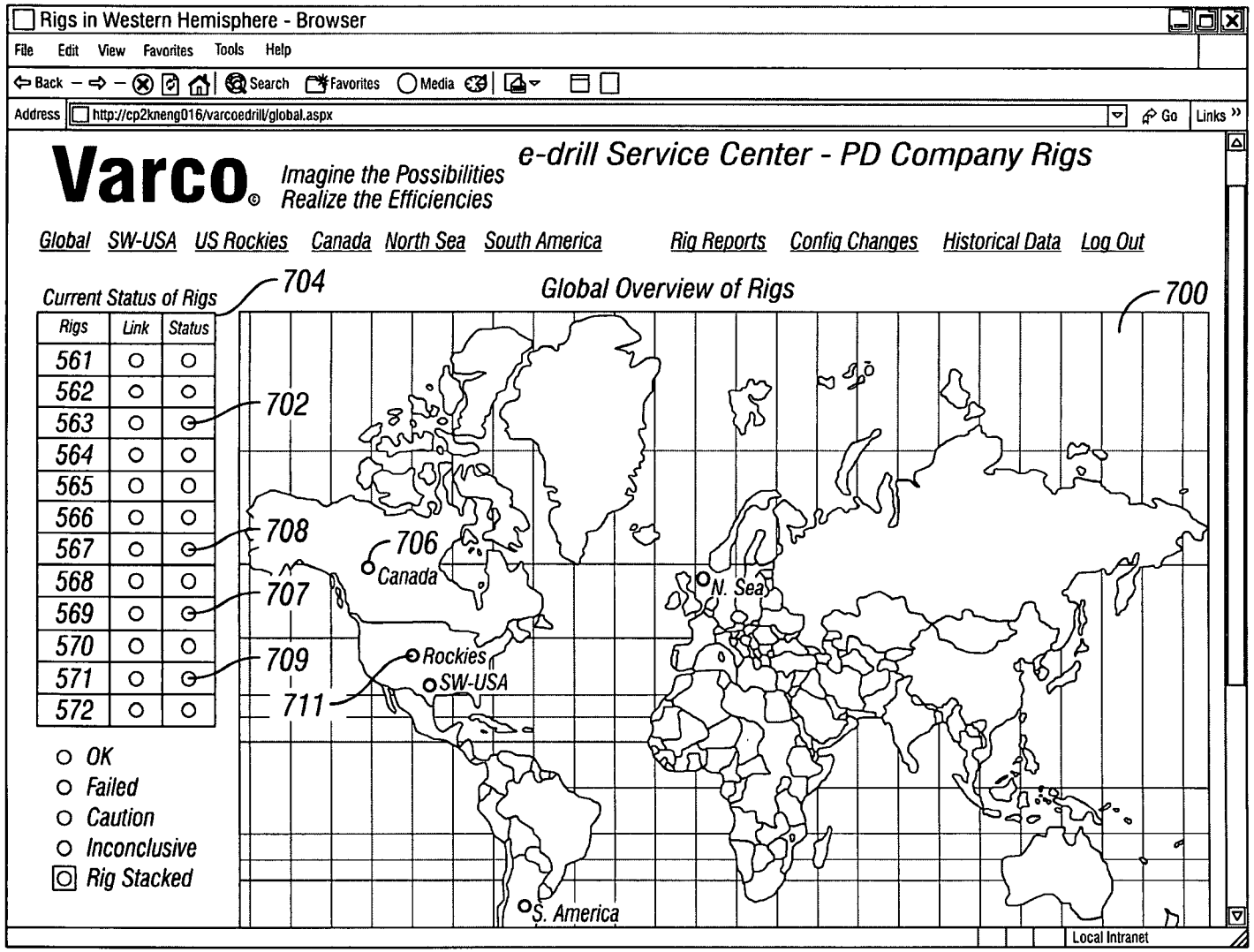
FIG. 10 is an illustration of a preferred status display for an oil recovery system showing status for individual rigs and aggregated worse-case status for geographical areas.
Figure 11:
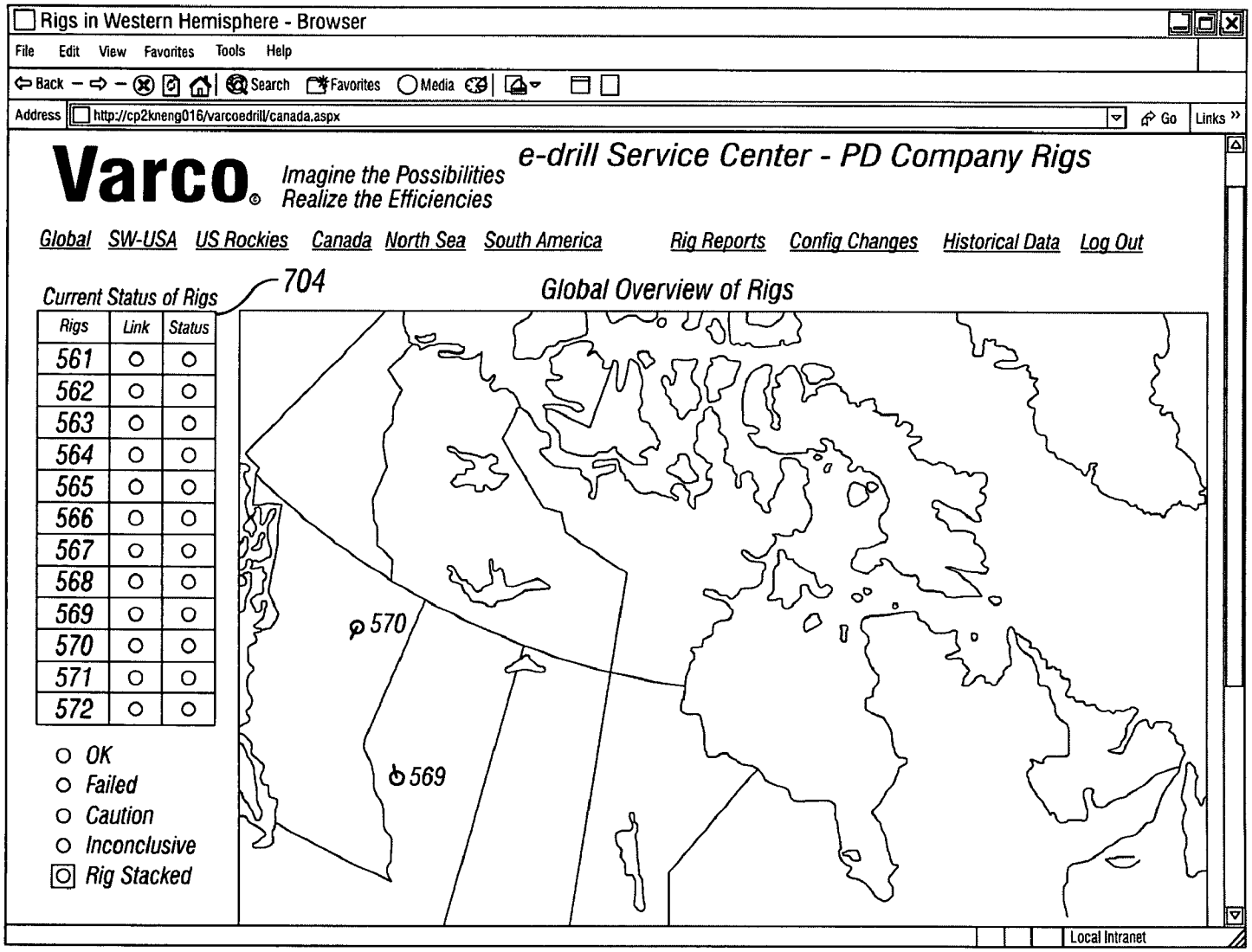
FIG. 11 is an illustration of a preferred status display for an oil recovery system showing status for individual rigs and aggregated worse-case status for a smaller geographical area including Western Canada.

Turning now to FIG. 10, a preferred embodiment of the present invention is shown illustrating a global overview 200 of all rigs comprising an oil recovery system. As shown in FIG. 10, a map pinpoints geographic locations of the rigs in the system of interest. A web page display is presented on a personal computer or PDA. The web page generated by the central server presents a geographic view of an oil recovery system. In FIG. 10, rig number 563 (702) and rig number 569 (707) are shown with a red status, indicating that a condition or reporting event of interest has occurred at rig number 563 and number 569. Rig number 569 (706) is in Canada and rig number 563 (711) is in the United States. Rig number 571 (709) has a yellow status and rig number 567 (708) has gray status. All other rigs shown in FIG. 10 have a green status. When a system user clicks on rig number 569 (707) or the Canadian region, the display of FIG. 11 appears. FIG. 11 shows the Canadian region, which includes rig number 569. Notice that rig number 570 has a green status is now displayed on the more detailed Canadian region display. The green status geographical indicator for rig number 570 is suppressed and not shown in the broader display of FIG. 10 so that the more severe red status of rig number 569 would be immediately visible and evident on the display of FIG. 10. Once a user implicitly acknowledges the red status for rig number 569 by clicking on rig number 569, the present invention displays the less severe status of rig number 570. Thus, the more severe status of rig number 569 bubbles up in the geographical display and is displayed first at a higher level in the geographical display hierarchy. Note that the green status indicator of rig number 570, however, is shown in the panel 704 of FIG. 10 and FIG. 11. Thus, the present invention presents a hybrid display in which all Health Check results are available in the panel 704, but worst case results are presented in the geographical displays of FIG. 10 and FIG. 11.

Figure 12:
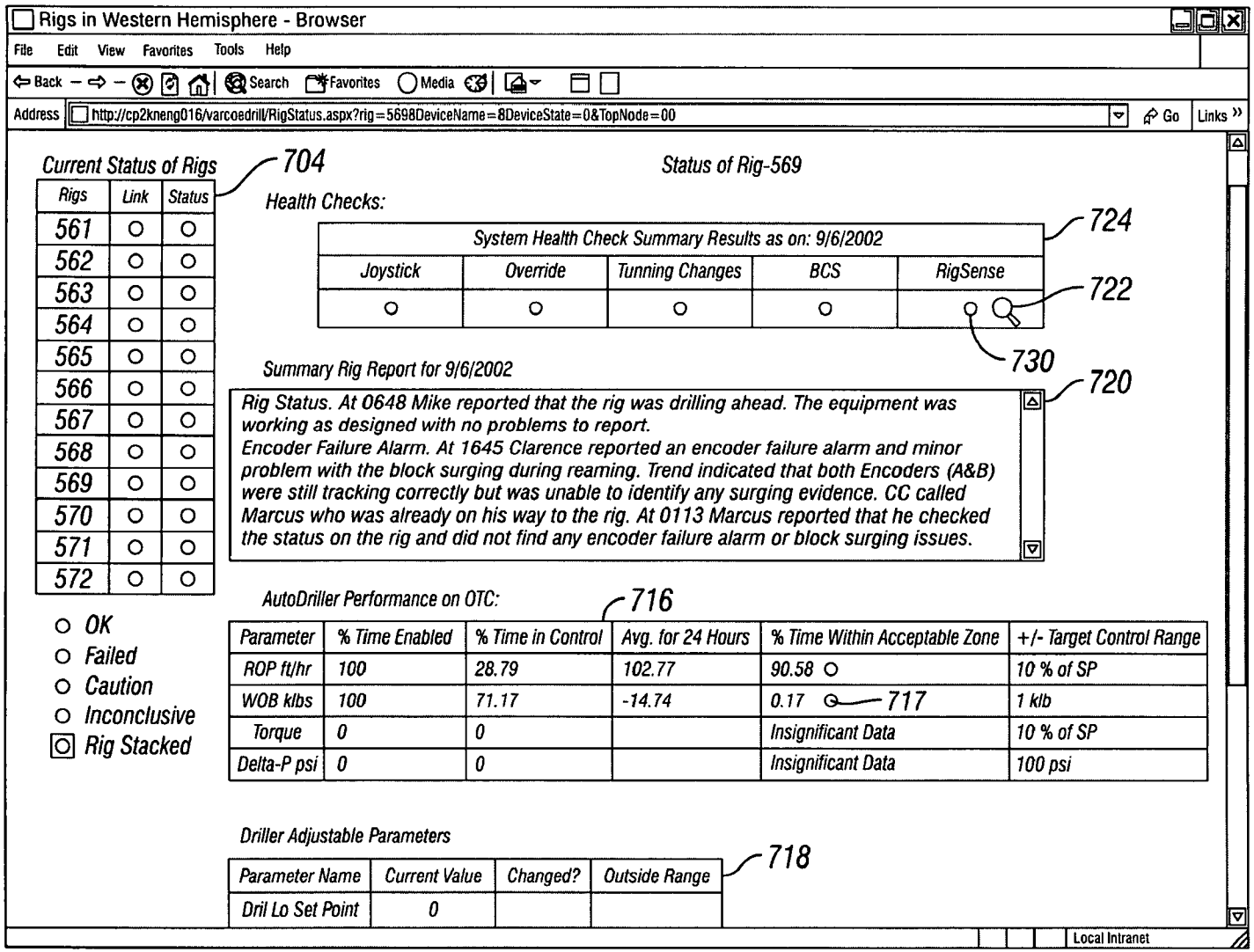
FIG. 12 is an illustration of a preferred status display for an oil recovery system showing status for individual rigs and panel results showing text descriptions and color-coded status for a single oil rig.

Turning now to FIG. 12, the status display 724 of FIG. 12 for rig number 569 is shown when a user clicks on rig number 569 in FIG. 10 or FIG. 11. FIG. 12 illustrates that a rig number 569 component, "RigSense" has a red indicator. The Magnifying Glass icon 722 shown adjacent red indicator 730 indicates that more information is available regarding the red indicator 730. There are also additional panel displays 716 and 718, which are configurable, which perform additional informative functions. A summary panel 720 is displayed for rig number 569. The summary status panel contains operator reports from the oil rig. These operator reports are useful in diagnosing status and formulating a plan of action or notification. An AutoDriller status panel is also displayed. Note that the Weight on Bit (WOB) indicator 717 is red in the AutoDriller status panel. A driller adjustable parameters panel 718 is also displayed.

Figure 13A:
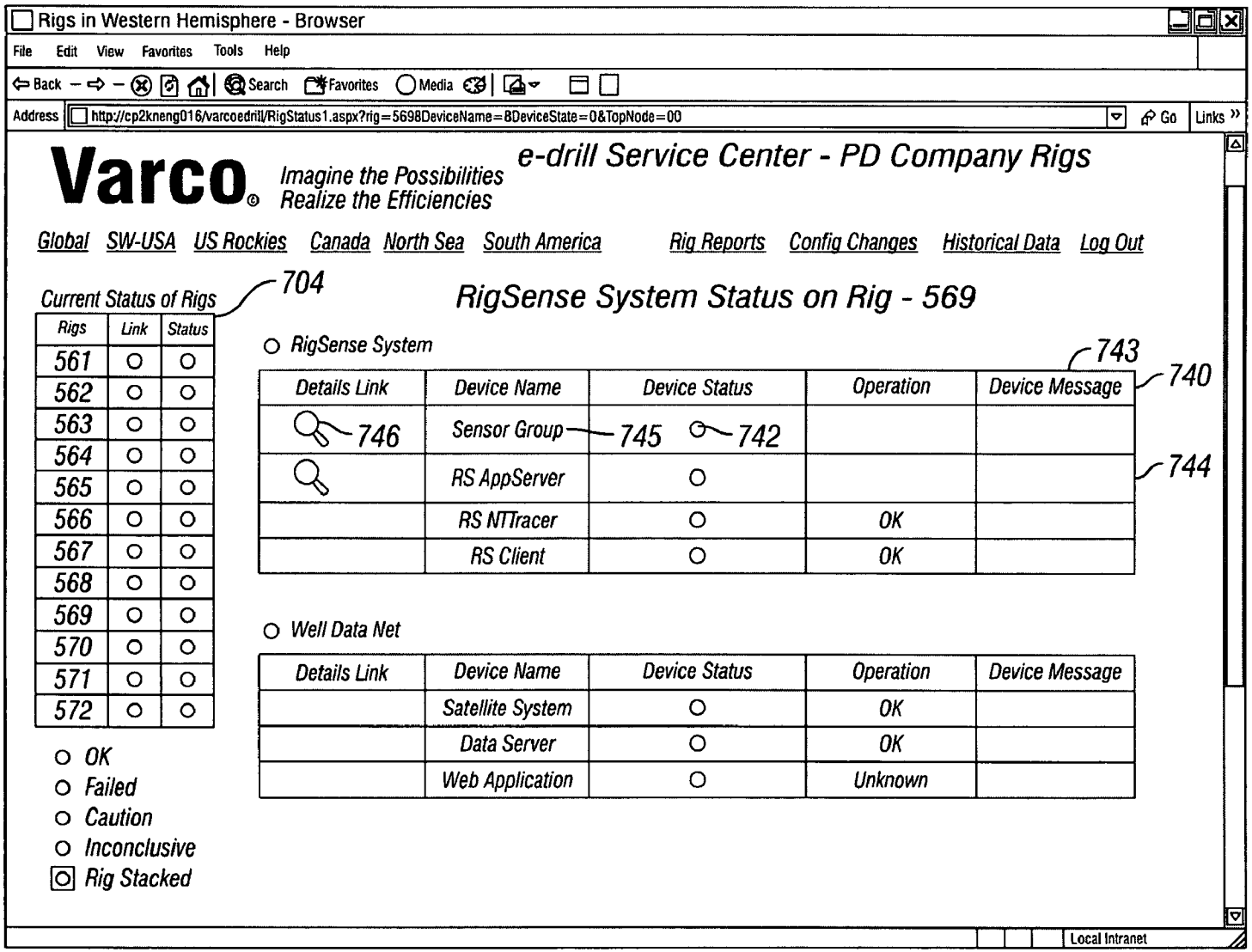
FIG. 13A is an illustration of a preferred status display for an oil recovery system and a sub status for an individual rig.

Turning now to FIG. 13A, continuing with rig number 569, clicking on the red indicator for RigSense status in FIG. 12, brings up the display for the RigSense system panel status 740 as shown in FIG. 13A. Note that the device message block 743 may contain a part number to expedite repair of a failure as reported. The particular part number and or drawing number necessary to perform a given repair associated with a given problem or severity report may be difficult to find in a vast inventory of parts and part numbers and drawings associated with a given failure. Otherwise, the recipient of a failure report may have to search via key words through a vast inventory of parts, part numbers and drawings associated with a given failure. Moreover, the user may not be familiar with a particular vendor's part numbering system, thus, provision of the part number is a valuable expedient to trouble shooting.

Figure 13B:
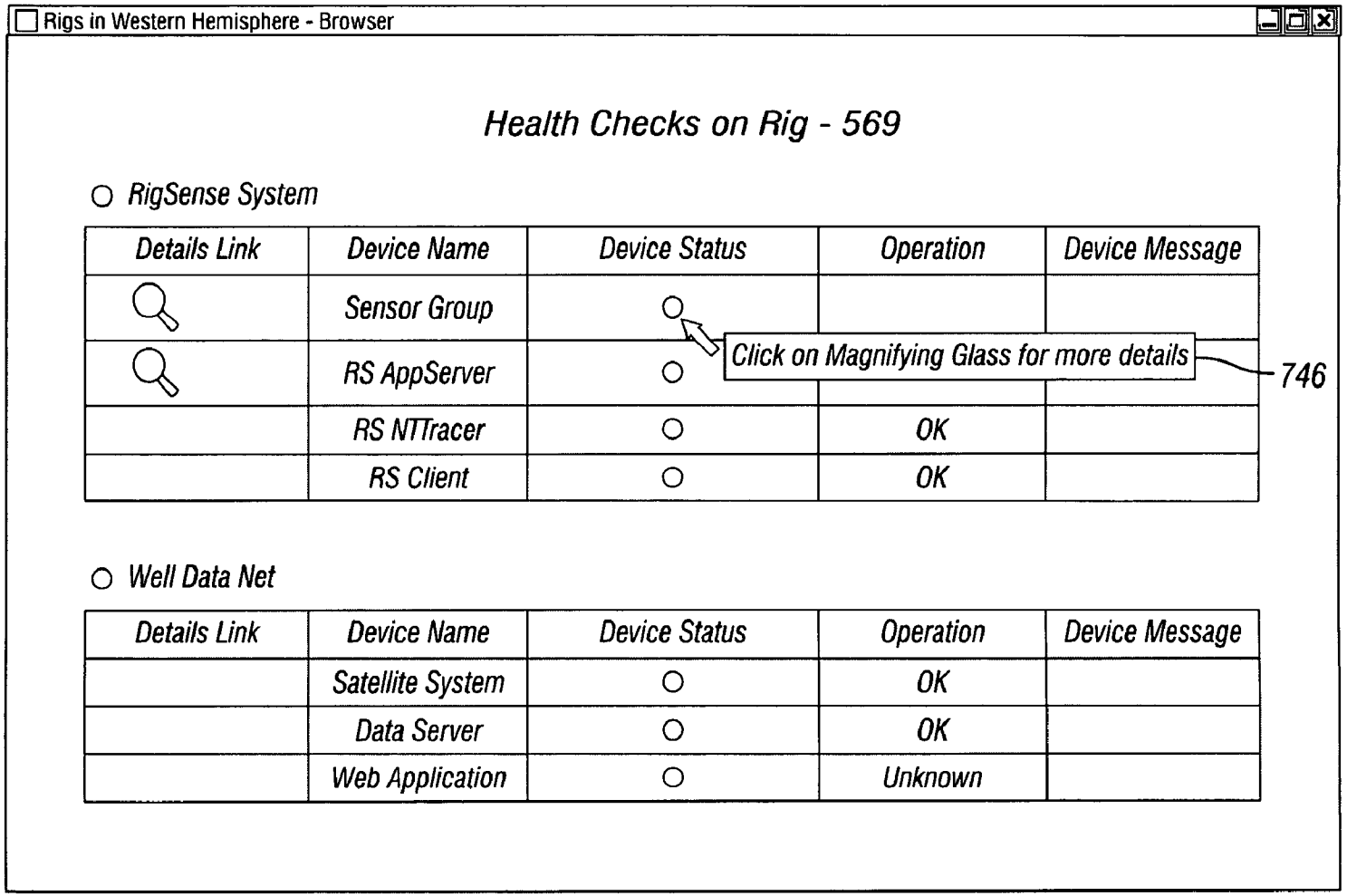
FIG. 13B is an illustration of an alternative status display for an oil recovery system and a sub status for an individual rig.
Figure 14:
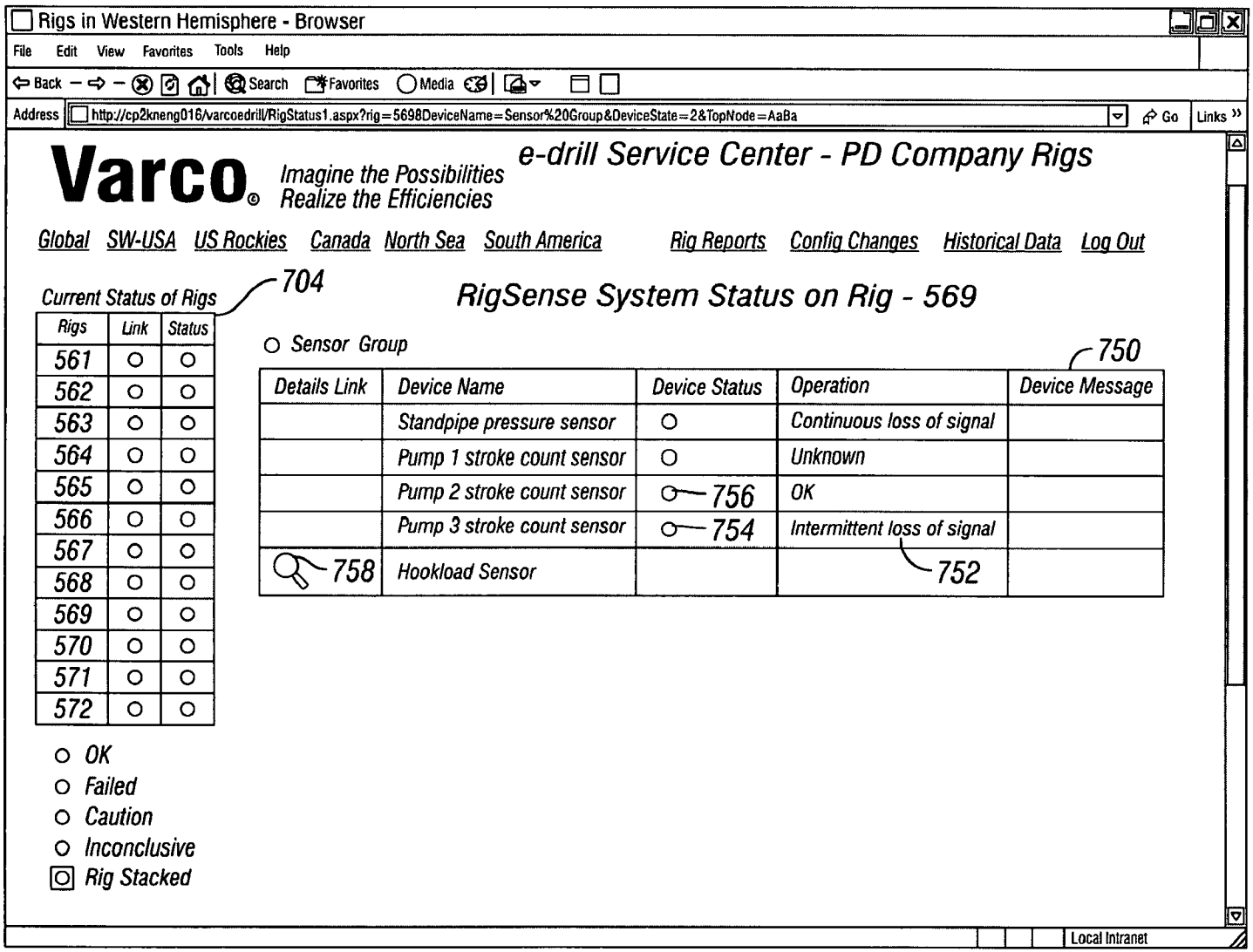
FIG. 14 is an illustration of a preferred status display for an oil recovery system and a lower level sub status for an individual rig.
Figure 15:
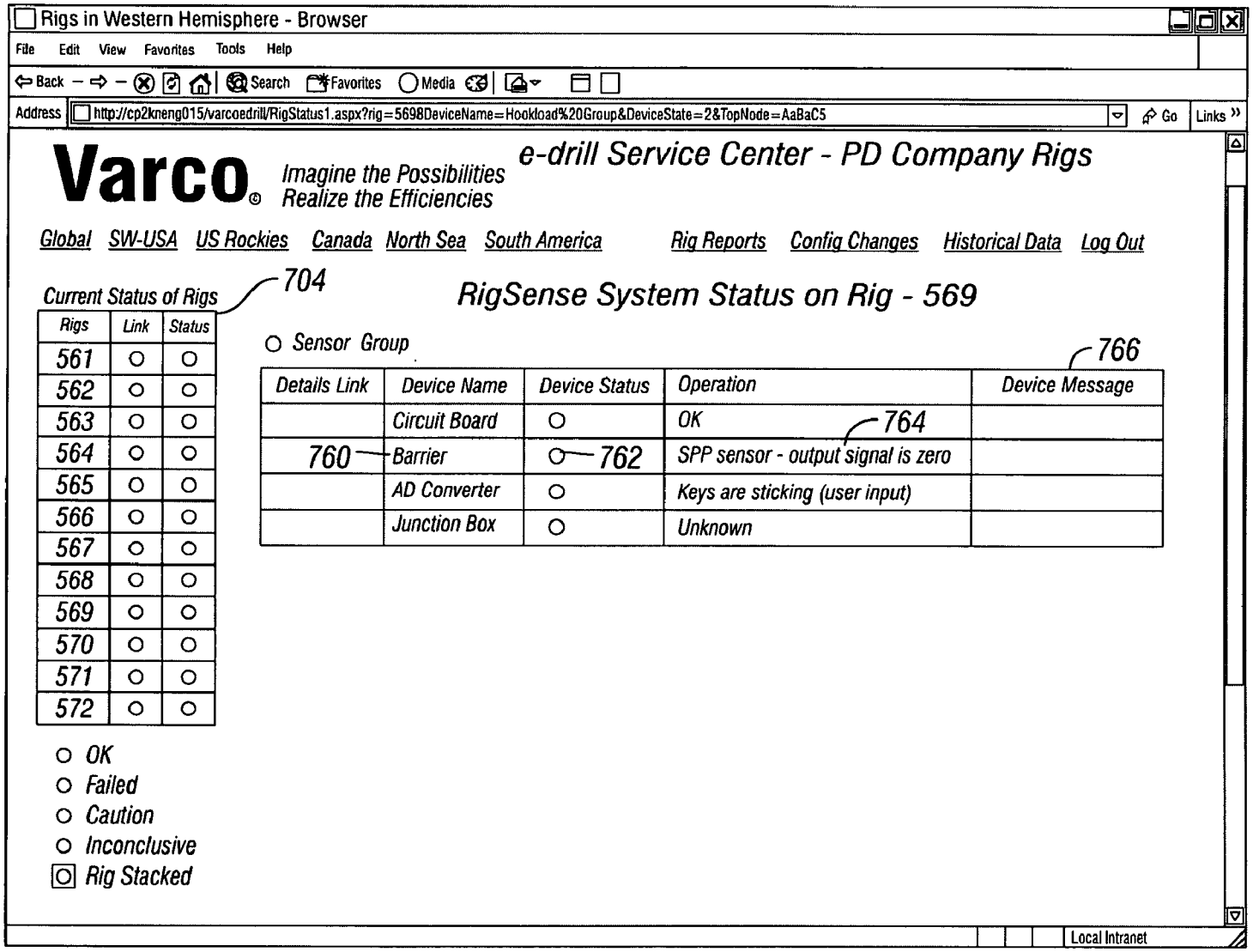
FIG. 15 is an illustration of a preferred status display for an oil recovery system and a lower level sub status for an individual rig.

FIG. 13A shows that the sensor group device status 742 is red with a Magnifying Glass icon 746 indicating that more information is available for the red sensor group device status indicator 742. In an alternative embodiment, as shown in FIG. 13B, a pop-up message 746*a* appears along with the Magnifying Glass stating "Click on Magnifying Glass for more details." Clicking on the red sensor group 744 device Magnifying Glass 746 brings up the display 750 of FIG. 14, showing a detailed status for the sensor group device status. Note that there are two red indicators shown in FIG. 14 for device status in the sensor group as follows: "Pump 3 Stroke Count Sensor" 756 and "Hookload Sensor" 754. Note that the Pump 3 red device status indicator has an informational comment 752 in the operation column of the display of FIG. 14, stating "Intermittent Loss of Signal." The Hookload Sensor red device status indicator present an adjacent Magnifying Glass icon 758 with a message indicating that more information is available for the device status of the Hookload sensor by clicking on the Magnifying Glass icon. Clicking on the Magnifying Glass indicator 758 for the Hookload sensor brings up the Hookload sensor panel 766 of FIG. 15, which shows that the device name "Barrier" 760 had a red device status indicator 762. The red device status for the Barrier displays an Operation message 764, stating, "Excessive ground current". Each colored indicator and accompanying operation message shown in the preferred displays illustrated in FIGS. 10-15 appeared in line of the Health Check performed at an oil rig and sent to the server in the structured protocol of the present invention.

Figure 18:
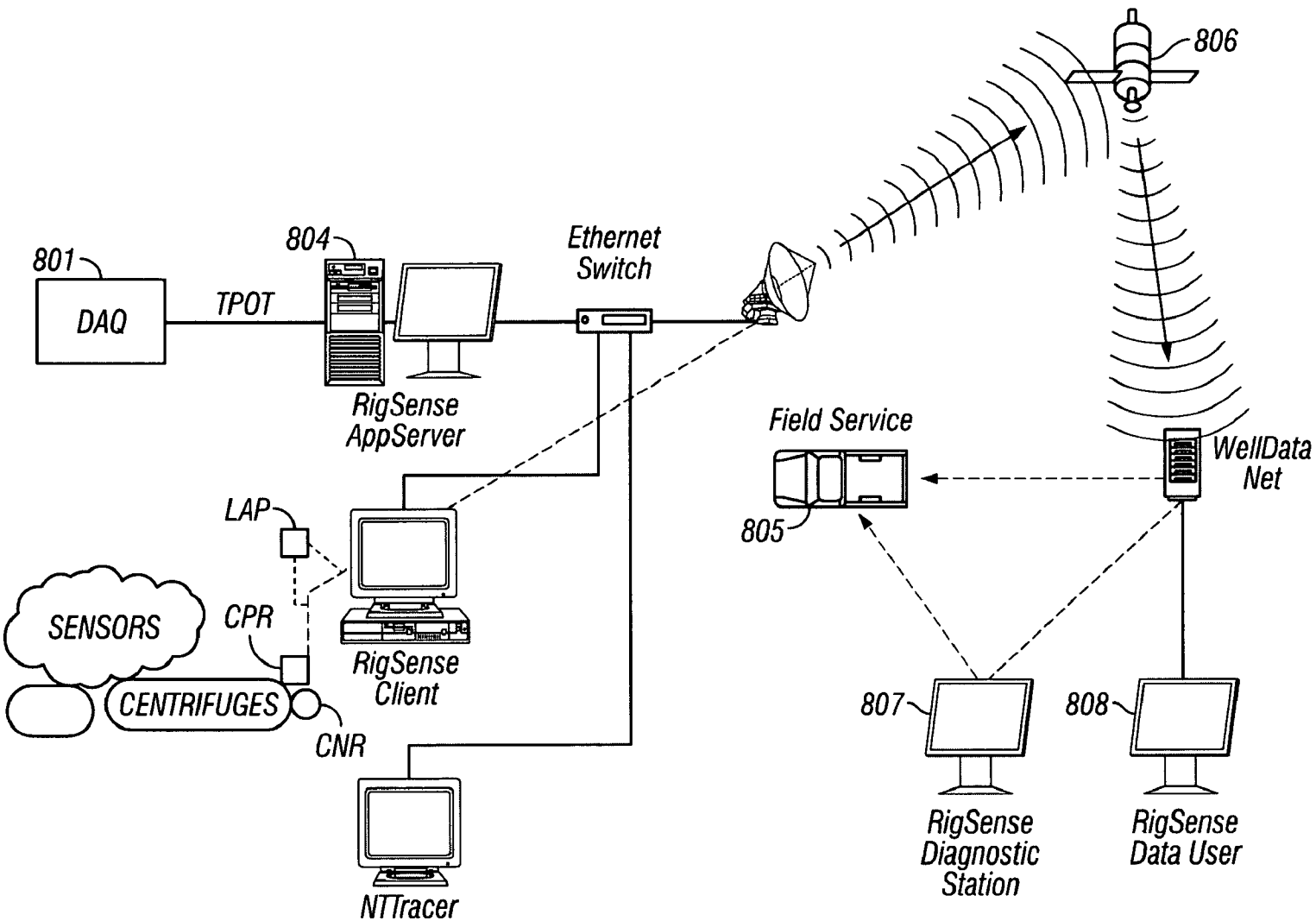
FIG. 18 is an illustration of a preferred health check system reporting health checks from an oil rig to a user via satellite.

FIG. 16 illustrates a Driller Adjustable parameters display 710 with two red indicators showing that Drill Low Set Point 712 and Upper Set Point 714 are Outside Range. A Drilling Tuning parameters panel 716 is also displayed. Both panels indicate the current value, changed indicator and outside range indicator for each parameter displayed in the respective panels of FIG. 16. The display of FIG. 16 is an alternative tabular display for rig status for a single rig. FIG. 17 illustrates a configuration or driller adjustable parameters status panel 810 for rig numbers 178-189. The display of FIG. 17 is an alternative tabular display for rig status for plurality of rigs, e.g., rigs 178-189. Turning now to FIG. 18, a data acquisition system 801 is shown in an oil rig environment connected to a plurality of legacy or Heath Check sensors ("SENSORS") which, in certain aspects, include sensors on a centrifuge or centrifuges which gathers data from the group of sensors monitoring the rig equipment, parameters and processes. The data acquisition system 801 sends the acquired data from the sensors to a computer 804 on which the preferred Health Check application of the present invention is running. The application of the present invention performs Health Checks logic on the acquired data and reports the results in the structured protocol to a user via satellite 806 or some other form of electronic communication. A user may monitor health check status and receive notifications via an electronic receiver 808, diagnostic station 807 or mobile in field service vehicle 805. Alternatively the shaker(s) may have a direct connection from a shaker computer CPR to the data transmission system.

The present invention is also useful for Process Monitoring, that is, to determine that equipment is being used properly to perform a designated process. For example, if rig operators are using an "override" during a certain system state indicative of a certain process, which is supposed to be run automatically rather than manually overridden, the present invention can perform a health check to detect this event of interest and report it to the central server. Knowledge of this occurrence enables central server personnel to detect and correct the inappropriate action of the operators. Moreover, the test to detect the inappropriate override stays in the system so that if new operators recreate the problem or trained operators backslide into using the manual override inappropriately, the central server personnel will be notified so that the problem can be address again. Thus, the Health Check system builds a cumulative base of operational checks to insure that a process on a rig or oil recovery system runs in optimal fashion.

Figure 19:
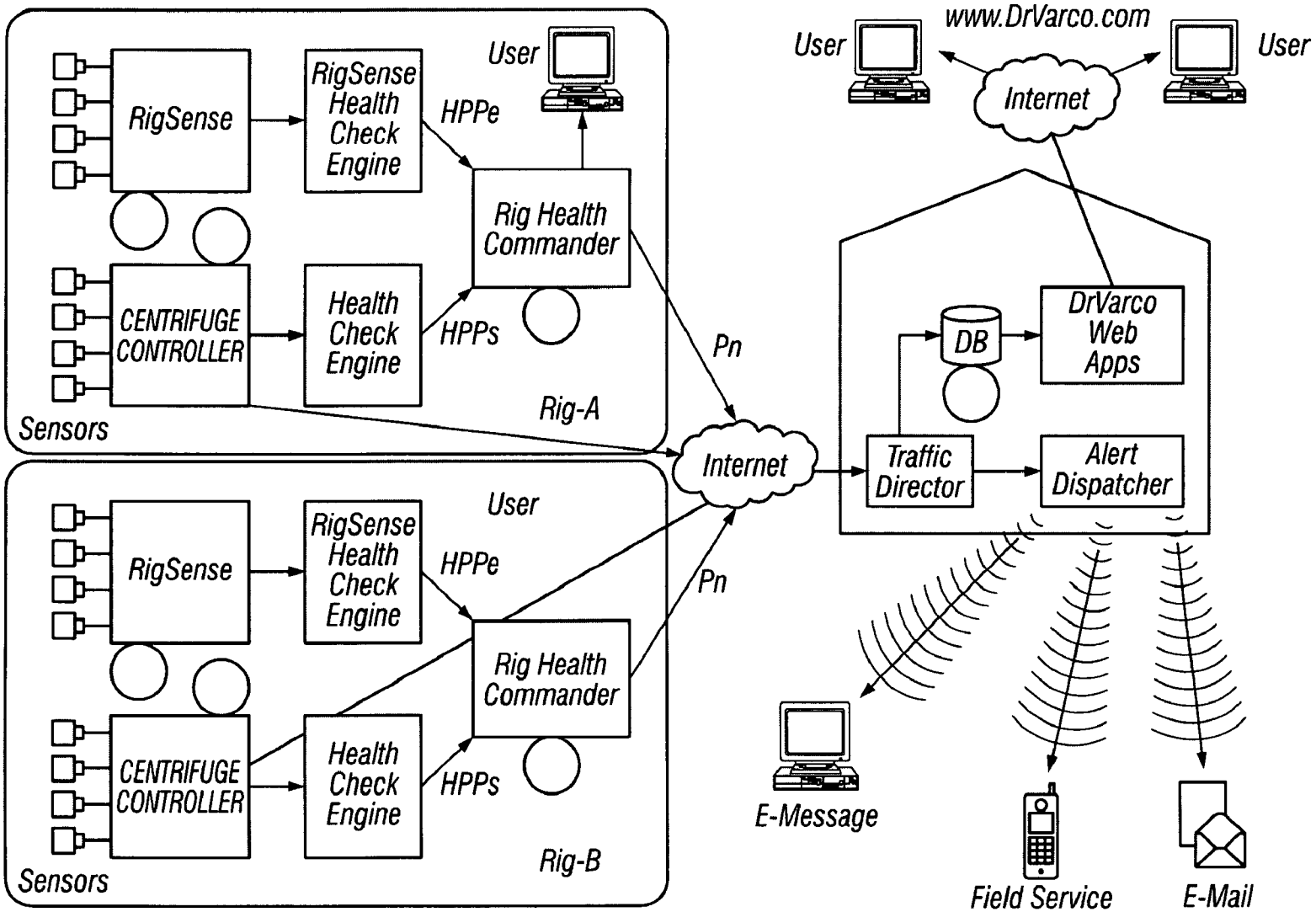
FIG. 19 is an illustration of a preferred health check system reporting health checks from an oil rig to a user via satellite.

Turning now to FIG. 19, FIG. 19 is an illustration of a preferred Health Check system reporting health checks of multiple equipments, processes or systems from multiple oil rigs to multiple users. It is to be understood that any equipment's, device's, or apparatus's controller or associated computer may be employed for the system as shown in FIG. 19, but the specific item shown schematically is a controller and/or computer for a centrifuge. As shown in one aspect the centrifuge controller and/or computer (e.g. but not limited to PLCs 54*p*, 56*p*, 46*p* described above) is in communication with a Rig Health Commander, a Health Check Engine, and a user. optionally, the centrifuge controller and/or computer can be in direct communication via the Internet or a similar network with another entity, device, and/or user.

Figure 20:
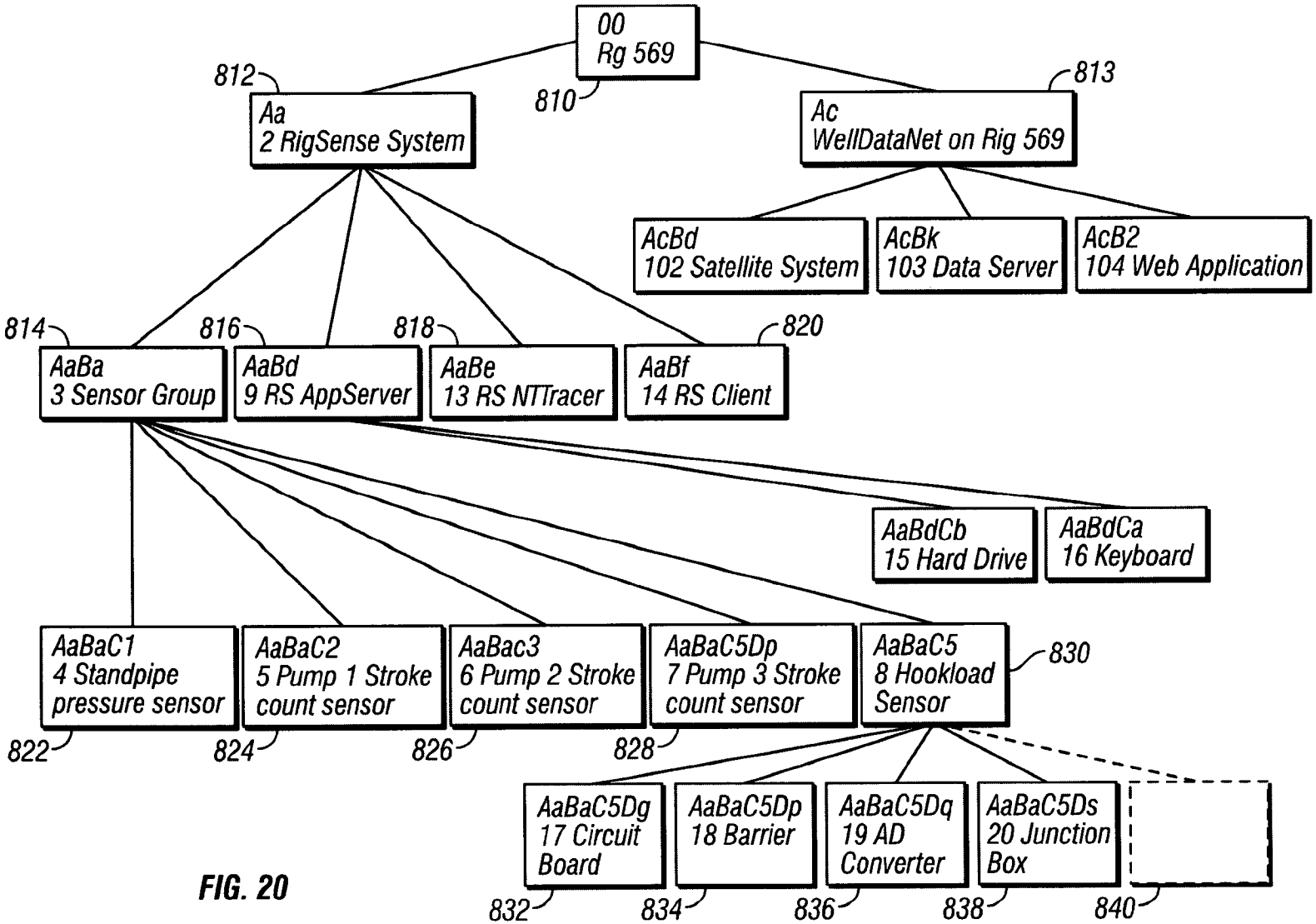
FIG. 20 is an illustration of a preferred protocol which defines an event reporting data structure for data base population and display.

Turning now to FIG. 20, the results of the tests are reported to the central server in a special protocol that contains heath check results data and describes the manner in which the data is constructed so that the data can be placed in a logical data structure or tree format and displayed. Note that the root node 810, usually an oil rig has a designation of "00". The first level of nodes 812, 813 etc. under the root node are named Aa, Ab, Ac, Ad, etc. Each subsequent layer of node is named with the name of the parent node followed by a designation of the current node. For example, as shown in FIG. 20, for a rig number 569, the root node 810 is named "00", the first level of children nodes under the root node are named Aa 812 and Ac 813. The children of node Aa 812 are named AaBa 814, AaBd 1116, AaBe 818 and AaBf 820 as shown. The children of child node AaBa are named AaBaC1 822, AaBaC2 824, AaBaC3 826 and AaBaC4 828. The children of node AaBaC5 830 are named AaBaC5Dg 832, AaBaC5Dp 834, AaBaC5Dq 836 and AaBaC5Ds 838. A new test could be added to rig 569 number and the Heath Check status could be reported under node AaBaC5Dx 840.

Changes to the Health Checks running on any or all rigs does not require changes to the display or data base population application because the preferred communication protocol defines the data base layout and display layout. The leaf nodes of the tree structure represent Health Check results. Each node contains a test identifier, test result (red/yellow/green/gray), intermediate data, user-entered data and test description. Trouble shooting comments are provided at the central server based on reported errors. Test error codes are included in the node so that messages associated with the error codes are displayed to the appropriate user. Alternately, trouble shooting and other information can also be generated and appended to the results of the tests at rig site. Thus, no processing to determine rig status is done at the central server. Notifications are sent when deemed necessary by the application. Notification logic is configurable by service personnel at the central server or at the oil rig. Notification logic dictates that notifications are sent when an event occurs and the event has been selected for reporting as a notification to a user. The notification logic and a list of appropriate notification recipients in order of priority, that is, who to contact first, is retained at the central server. The event can be a report on an equipment status, process execution or an operational item. A user can check in with the central server of present invention to obtain a real time report of the status of an oil rig or multiple oil rigs. The requesting user will receive a severity report message indicating the status of the rig, for example, "okay" or "red/yellow/green/gray."

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed of the conveyor with respect to the bowl.

The present invention, therefore, provides in certain, but not necessarily all embodiments, a centrifuge system for processing material, the centrifuge system including a housing; a bowl rotatably mounted within the housing; a bowl motor for rotating the bowl; a bowl motor variable frequency drive apparatus for providing power to the bowl motor, the bowl motor variable frequency drive apparatus including a bowl motor on-board controller for controlling the bowl motor variable frequency drive apparatus; a screw conveyor rotatably mounted within the housing; a screw motor for rotating the screw conveyor; a screw motor variable frequency drive apparatus for providing power to the screw motor, the screw motor variable frequency drive apparatus including a screw motor on-board controller for controlling the screw motor variable frequency drive apparatus; and pump apparatus for pumping material to be processed into the bowl. Such a system may have one or some (in any possible combination) of the following: network communications apparatus (e.g., but not limited to, the Internet) for providing communication between at least one of the variable frequency drive apparatuses and a site remote from a location of the centrifuge system; remote control apparatus for remotely controlling the at least one or all variable frequency drive apparatuses from the site remote from the location of the centrifuge system; the network communications apparatus for providing communication between at least one of or all of the variable frequency drive apparatuses and a computer system at the location of the centrifuge system and/or remote therefrom for controlling at least one of or all of the variable frequency drive apparatuses; the pump apparatus including a variable frequency drive pump, and pump variable frequency drive apparatus for controllably driving the pump apparatus; load sensor apparatus for sensing load of the bowl motor and load of the screw motor and for producing load signals indicative of said loads, pump on-board controller apparatus for receiving said load signals and for controlling the pump apparatus in response thereto; wherein the pump on-board controller shuts down the pump apparatus in response to load signals indicating the centrifuge system is jammed with material, thereby stopping flow of material to the bowl; screw motor sensor apparatus for sensing speeds of the screw motor; the screw on-board controller apparatus having programmable media for controlling the screw motor variable frequency drive apparatus; the screw on-board controller apparatus for checking a manually-set screw motor speed and, if said manually-set screw motor speed is unacceptable, automatically overriding said manually-set screw motor speed with an acceptable screw motor speed; alarm apparatus in communication with the on-board controller apparatus for providing an alarm signalling that a manually-set screw motor speed has been overridden; the screw on-board controller apparatus including alert apparatus for alerting personnel on-site and/or off-site operating the centrifuge system in the event of the screw on-board controller automatically overriding a manually-set screw motor speed; screw motor direction sensing apparatus for sensing a direction, forward or reverse, in which the screw motor is running; wherein the screw on-board controller maintains screw motor speed slower than bowl motor speed; wherein the screw on-board controller maintains screw motor speed between a pre-set minimum speed and a pre-set maximum speed; a tank system for holding material to be processed by the centrifuge system, the tank system including a container, an agitator system having agitating apparatus within the container, an agitator motor for rotating the agitating apparatus, sensor apparatus for sensing operational parameters of the agitator motor and for sending agitator signals indicative thereof to at least one of the variable frequency drive apparatuses for control thereof in response thereto; wherein the at least one variable frequency drive apparatus stops the agitator motor in response to agitator signals; wherein the at least one variable frequency drive apparatus produces an alarm in response to agitator signals; sensor apparatus connected to the centrifuge system for sensing a parameter indicative of operation of the centrifuge system for providing a signal corresponding to said parameter, control apparatus for receiving signals from the sensor apparatus for controlling the centrifuge system based on said signals, the centrifuge system on a drilling rig, the control apparatus for monitoring and analyzing a plurality of signals from the sensor apparatus and for transmitting signals indicative of information related to operation of the centrifuge system to a processor on the drilling rig, the processor including a set of health check rules for health checks comprising logical rules, inputs and outputs for defining events associated with the status of the centrifuge system, the processor for determining a severity code for each event and for reporting the events and severity codes to a central server, the events reported by the processor to the central server in a protocol defining a data structure, the data structure comprising a hierarchical tree node structure wherein results from application of the health check rules are a bottommost node of the tree node structure, and displaying the event severity codes on a display; the processor for providing to the central server the results as records containing node information regarding an appropriate location for the results in the tree node structure; the control apparatus running the health checks in real time to provide results regarding on-going status of the centrifuge system to indicate a potential failure of the centrifuge system; the control apparatus for providing information regarding centrifuge system operation so that maintenance can be performed on the centrifuge system without shutting down drilling by the drilling rig; recording apparatus in communication with at least one on-board controller for at least one of the variable frequency drive apparatuses for recording personnel operator inputs thereto; wherein the recording apparatus is for producing a record identifying each personnel operator's inputs; wherein the at least one on-board controller includes the bowl motor on-board controller and the screw motor on-board controller; and/or wherein the material includes drilling fluid and drilled cuttings.

The present invention, therefore, provides in certain, but not necessarily all embodiments, a method for processing material with a centrifuge system, the method including feeding material to be processed to a centrifuge system according to the present invention, pumping the material into the bowl, and processing the material with the centrifuge system. In one such method the material includes drilling fluid and drilled cuttings.

The present invention, therefore, provides in certain, but not necessarily all embodiments, a computer readable medium containing instructions that when executed by a computer implement a method according to the present invention (any method disclosed herein according to the present invention).

Figure 21B:
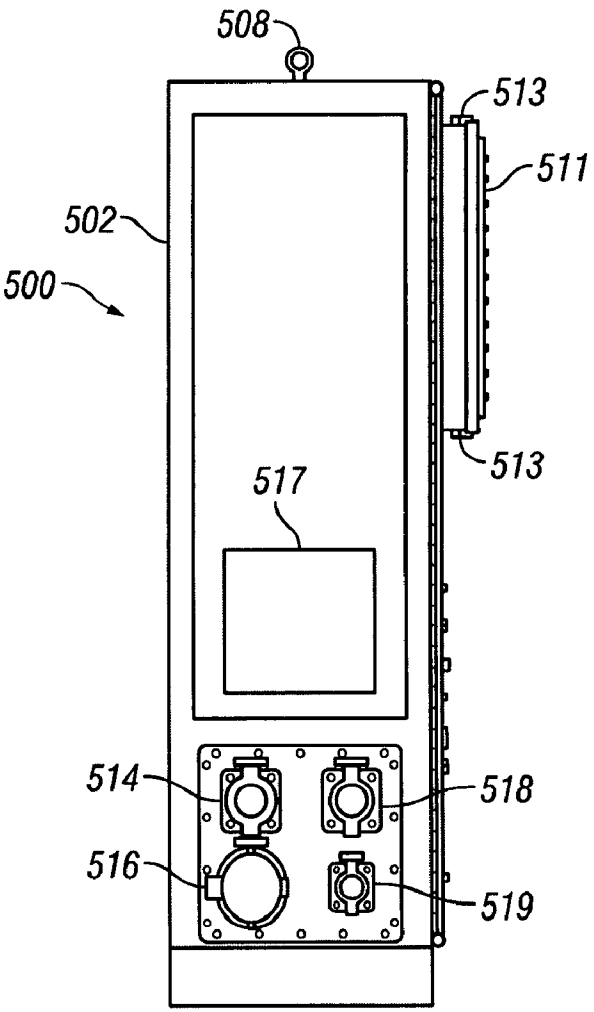
FIG. 21B is a side view of the system of FIG. 21A.
Figure 21A:
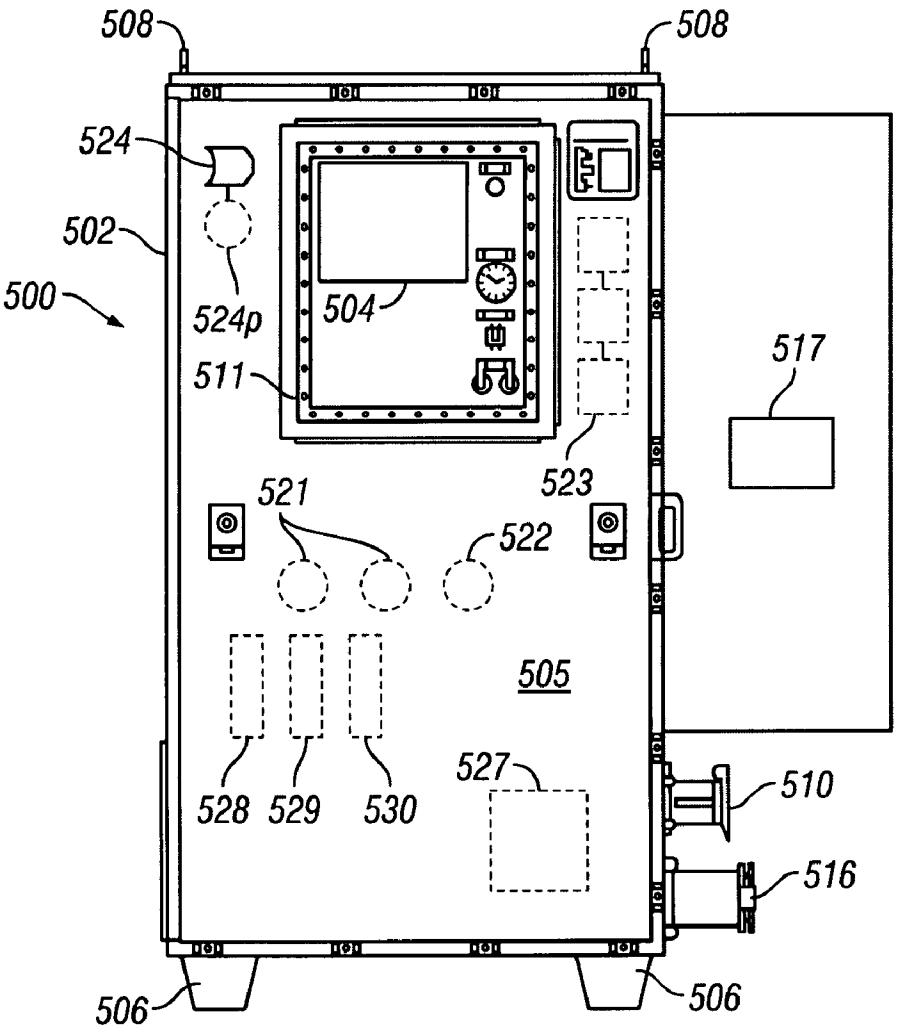
FIG. 21A is a front view of a control system for centrifuge operation according to the present invention.

FIGS. 21A and 21B show a control cabinet 500 for a control system (e.g., but not limited to, a control system as in FIGS. 2, 2A, and 3) with an enclosure 502 made, in one aspect, e.g. of metal, e.g. carbon steel or stainless steel (or, optionally, made of fiberglass or composite material). The enclosure can be made of materials and parts suited for either hazardous or nonhazardous locations. The control cabinet 500 distributes facility (rig) power through the use of variable frequency drives (VFD's) to a centrifuge and a pump (e.g. VFD's as in FIG. 2). A centrifuge can be controlled using a human machine interface, a touch screen apparatus (or screens) 504. The screen apparatus or apparatuses can be in a cabinet and/or at another location or position.

The enclosure 502 has feet 506 and lifting eyes 508. Optionally a window 511 protects the touch screen 504 and is movable on hinges 513.

Receptacles or glands receive cables to provide power to the VFD's for the motors (centrifuge bowl motor, centrifuge conveyor motor, pump motor). A gland or receptacle 519 is for a control line (e.g., at 24 VDC or 120 VAC) which can be connected to centrifuge safety devices (e.g. an emergency stop safety vibration switch, and torque arm which measures torque). A receptacle or gland 512 receives inlet an inlet power cable or cables for certain items in the cabinet 500. The control power transformer 593 receives input power (e.g. at 120, 380, 480, 575, or 690 VAC) from the power terminals 534. Power cables for the motors pass through glands 516, 518.

Figure 22:
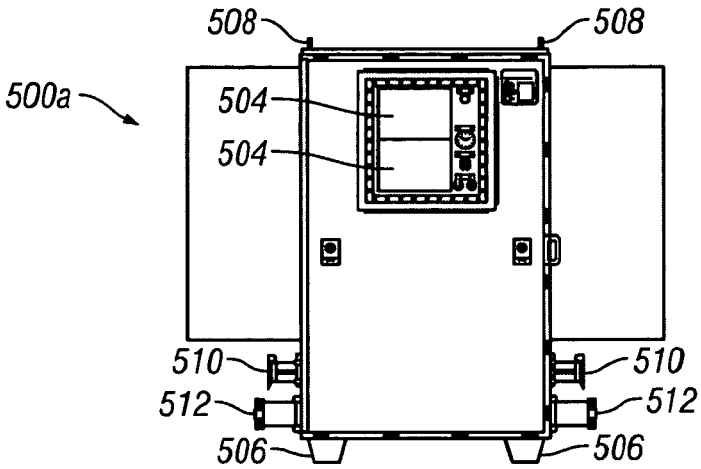
FIG. 22 is a front view of a control system for centrifuge operation according to the present invention.

FIG. 22 shows a control cabinet 500*a*, like the control cabinet 500 (like numerals indicate like parts). The control cabinet 500*a* is used to control two centrifuges and has two touch screen apparatuses 504 and two control panels, one for each centrifuge, as described below.

Figure 23:
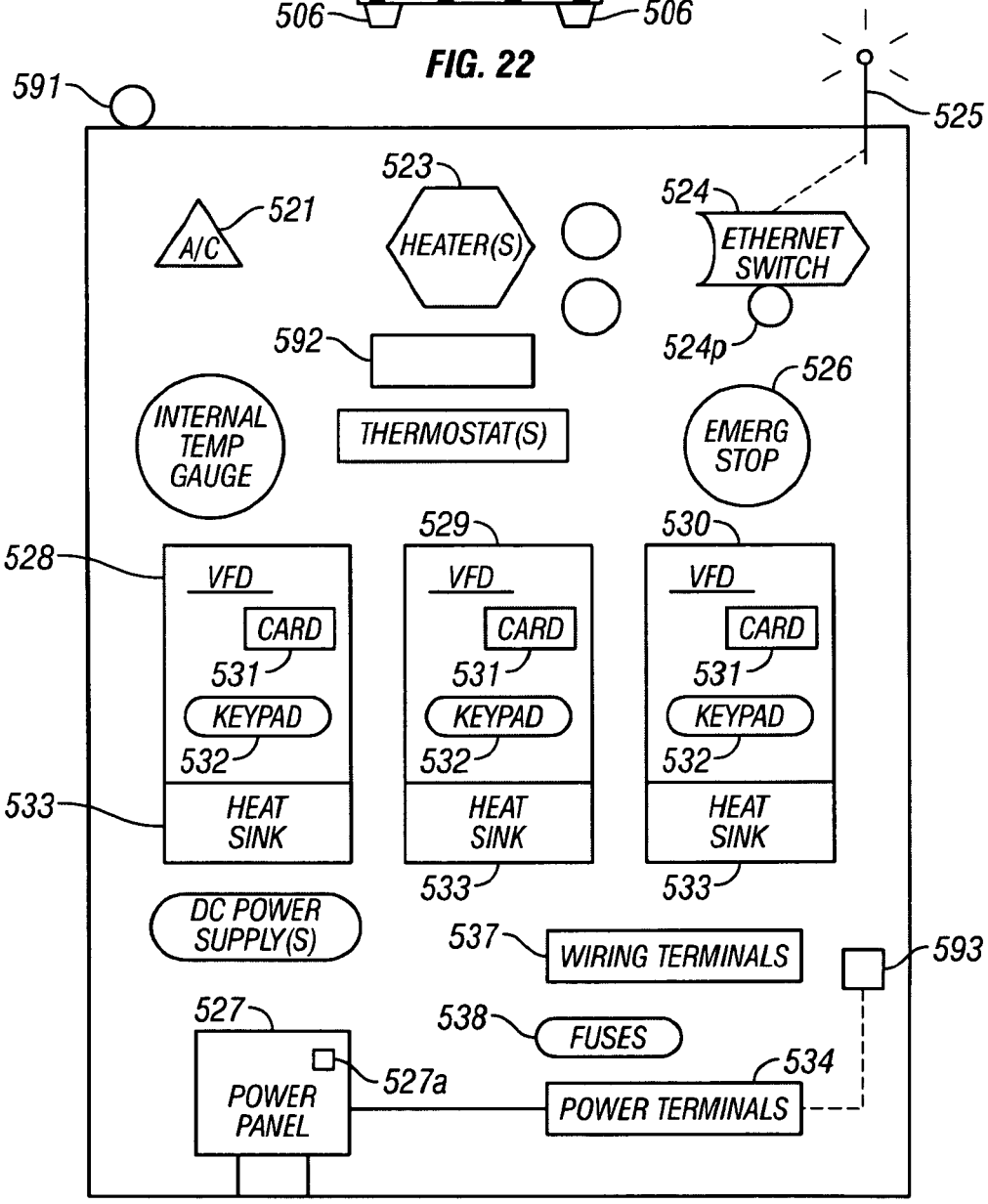
FIG. 23 is a schematic view of components of the system of FIG. 21A.
Figure 24:
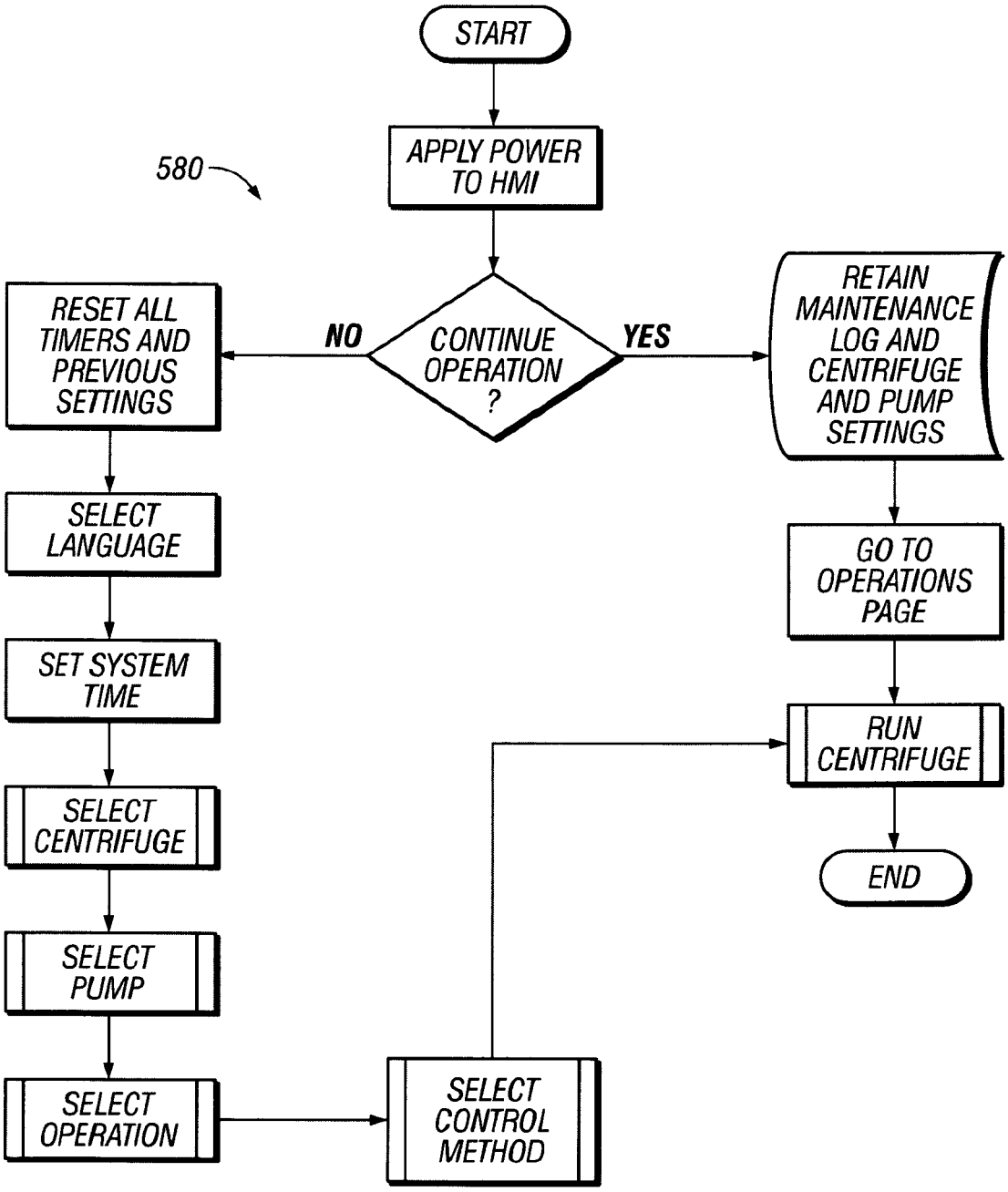
FIG. 24 is a schematic view of a method according to the present invention useful for centrifuge control.

The control cabinet 500 houses a control panel 600 (see FIG. 23) and its related apparatuses, structures and devices, (shown schematically in FIG. 21A) which are in communication with the touch screen apparatus 504. There are two control panels 600 in the control cabinet 500*a*, FIG. 22, one panel for each centrifuge for independent control of each centrifuge.

The control panel 600 includes controls for at least one, two, or more air conditioning units 517 ("A/C") with on/off switches or circuit breakers for each unit and an internal temperature gauge 522 ("INTERNAL TEMP GAUGE") which can be inside and/or outside the cabinet. In one aspect, the gauge reads temperatures between −50 degrees C. and 50 degrees C. Multiple heaters or one heater can be housed in the control cabinet 500. There are three heaters 523 in series in the control cabinet 500 which turn on automatically if the temperature falls below zero degrees C. An appropriate circuit breaker or breakers are used with the heater(s). An exterior temperature gauge 591 provides a visual indication of the temperature external to the cabinet 500. The control cabinet includes a digital thermometer 592 in communication with the touch screen 504 which provides a visual indication of the temperature within the cabinet. The air conditioning units can be started automatically when the temperature inside the cabinet rises above a threshold point. Similarly, the heating units can be automatically started when then temperature inside the cabinet falls below a certain threshold point.

Optionally, the system of the control cabinet 500 can be operated by remote control via a wireless ethernet switch 524 connected to an antenna 525. A push-pull emergency button 526 ("EMERG STOP") applies power to the controls for the centrifuge and other apparatuses (pull out) or removes all power from the controls, etc. (push in). The system 500*a* has such a button for each centrifuge. The emergency stop can be located on the cabinet, on the centrifuge, or both.

The touch screen apparatus 504 is a computer-based apparatus with a computer or PLC, programmable media and associated hardware and software and a touch screen which, in one aspect includes a "stop centrifuge" button. During normal operations the centrifuge and feed pump are stopped by pressing the "STOP CENTRIFUGE" buttons on the touch screen 504 and not by pressing the Emergency Stop button on the control cabinet. When the "STOP CENTRIFUGE" button in the touch screen 504 is pressed, the VFDs ramp to a stop. When the Emergency Stop button is pressed, the VFDs shut down completely and the centrifuge and feed pump coast to a stop. It takes longer to coast to a stop than to ramp to a stop. Once the centrifuge stops rotating, the Emergency Stop button can be pressed. The Emergency Stop button should not be pulled out re-applying power to the VFDs when the centrifuge is slowing down.

A power panel 527 in the control cabinet 500 contains a contactor 527*a* (or circuit breaker) and a terminal 534 that supply the power for the VFDs and the various items in the cabinet 500. A supply power cable enters the enclosure 502 through the receptacle 516 and is connected to the contactor (or "POWER PANEL") 527. Power from the power panel is supplied to each VFD.

The control cabinet 500 houses three VFDs, two for the centrifuge motors (bowl VFD, conveyor VFD) (VFDs 528, 529) and one for the pump (VFD 530). Each VFD has an internet protocol card 531, e.g., a Modbus TCP/IP card for communication with the touch screen 504 via an ethernet cable and switch. Using appropriate IP addresses, this insures that the touch screen apparatus 504 runs the centrifuge it is programmed to run (or one it is chosen to run) and not some other centrifuge with different parameters. There are six VFDs in the control cabinet 500*a*, three for each centrifuge/pump system. Each VFD includes a keypad 532 which can be used to program the VFD and display information (on the touch screen apparatus 504) about the VFD during operation. With appropriate touch screen apparatus programming (programming of the programmable media that is part of the touch screen apparatus) any suitable VFD may be used. Optionally any desired number of VFD's can be housed in the cabinet (e.g. VFD's for two, three, four or more centrifuge systems and/or shakers, agitators, dryers, augers, etc.

Each VFD may have a heat sink apparatus 533 for dissipating the relatively large amount of heat generated by a VFD in use. Also, high ambient temperature and direct sunlight can heat up the interior of a control cabinet. Each VFD monitors its respective heat sink 533. In one aspect, if the heat sink temperature approaches a preset maximum, e.g., but not limited to, 105 degrees C., the VFD will shut down.

The power panel 527 is wired to power terminals 534. The control cabinet 500 has one, two, or more thermostats 535 for controlling the air conditioning unit(s) 521 and controlling the heater(s) 523. One thermostat may be an ambient temperature thermostat that turns the heaters 523 on and off while another thermostat is a safety backup thermostat which prevents the cabinet from over heating in case the ambient temperature thermostat does not turn the heaters off. The control power transformer system 593 connected to the power terminals 534 provides power at an appropriate voltage to the items in the cabinet. In one aspect, there is one thermostat for each air conditioner.

The ethernet switch 524 provides communication between the VFDs and the touch screen 504. The switch 524 is powered by a 24 VDC power supply 524*p*. Wiring terminals 537, on a door 505 of the control cabinet 500 supply power to the heater(s) 523, thermostats 535, and emergency stop circuits.

Fuses 538 protect the control and power circuits.

FIGS. 24-29C illustrate a typical method 580 according to the present invention for controlling a centrifuge (e.g. using a system as in FIGS. 2, 2A, 3, 21A, and 23). To start ("START") the method, power is applied to a touch screen system (like the touch screen apparatus 504) (e.g. power applied to the touch screen at 24 volts from a 24 volt power supply). The touch screen system 504, in one aspect, has programmable media programmed with the operational logic software downloaded into the media and has a memory, e.g. compact flash memory and/or non-volatile memory, where predefined parameters are saved which enables the system to run a previously-saved operation (e.g. after it loses power). In the "Continue Operation?" step, if it is desired to retain the saved settings, "YES" is pushed and the method advances to an operations page ("GO TO OPERATIONS PAGE") for monitoring operations, and displaying operation parameters, and with method steps taken to run the centrifuge ("RUN CENTRIFUGE"). When running is finished, the function is completed (executed).

If saved settings are not desired ("NO") timers and settings are reset ("RESET ALL TIMERS AND PREVIOUS SETTINGS"); a language is selected ("SELECT LANGUAGE") (e.g. English, French, Spanish, Italian, Russian, German, Chinese, Hebrew, That, Japanese or Korean or any other suitable language); and the system time is set e.g. by a user ("SET SYSTEM TIME") for the particular world time zone to insure that the system historical program in the system and/or on a removable flash card or portable drive selectively connectible to the touch screen is synchronized to the proper time zone.

Figure 25:
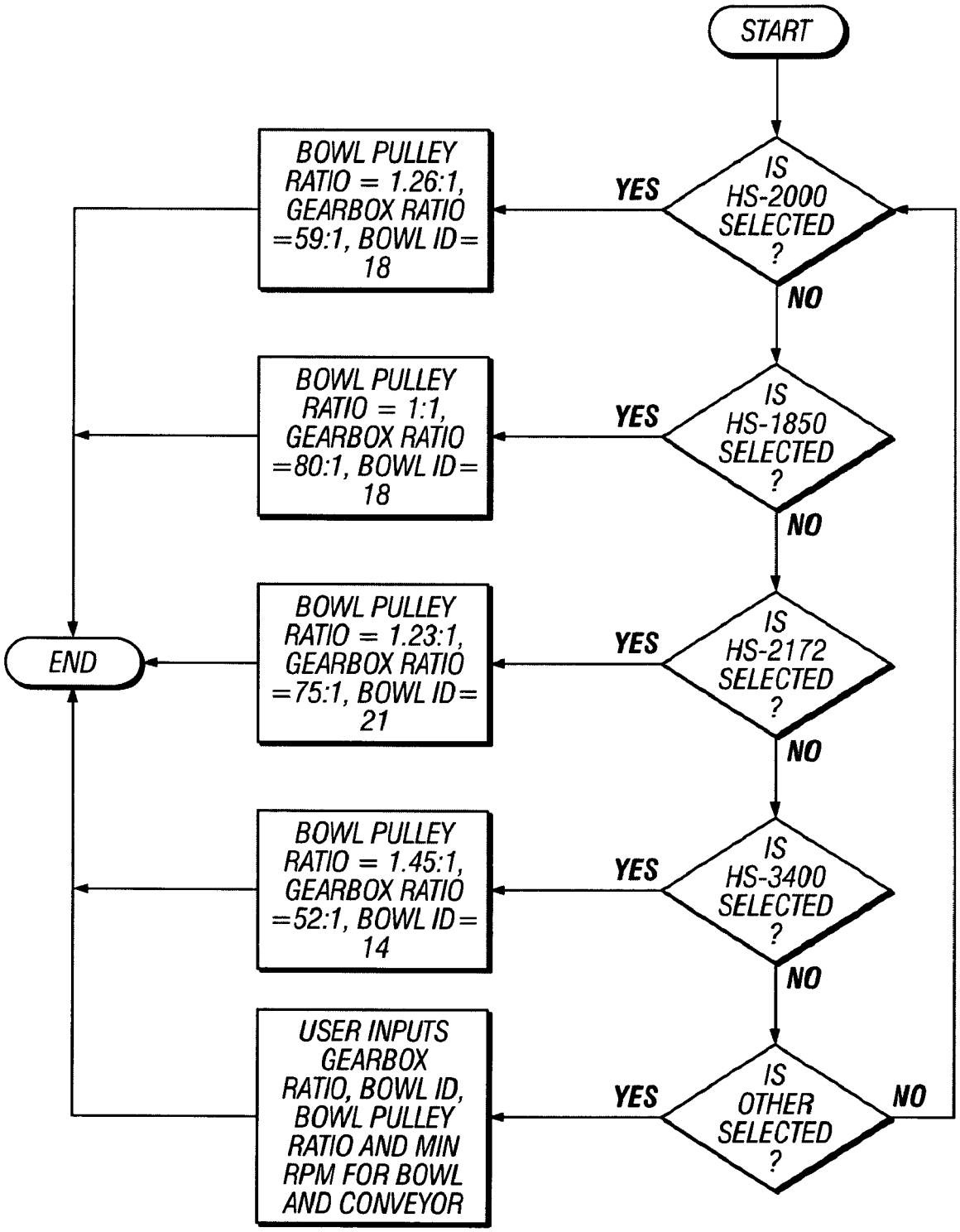
FIG. 25 is a schematic view in a method according to the present invention useful for centrifuge control.
Figure 26:
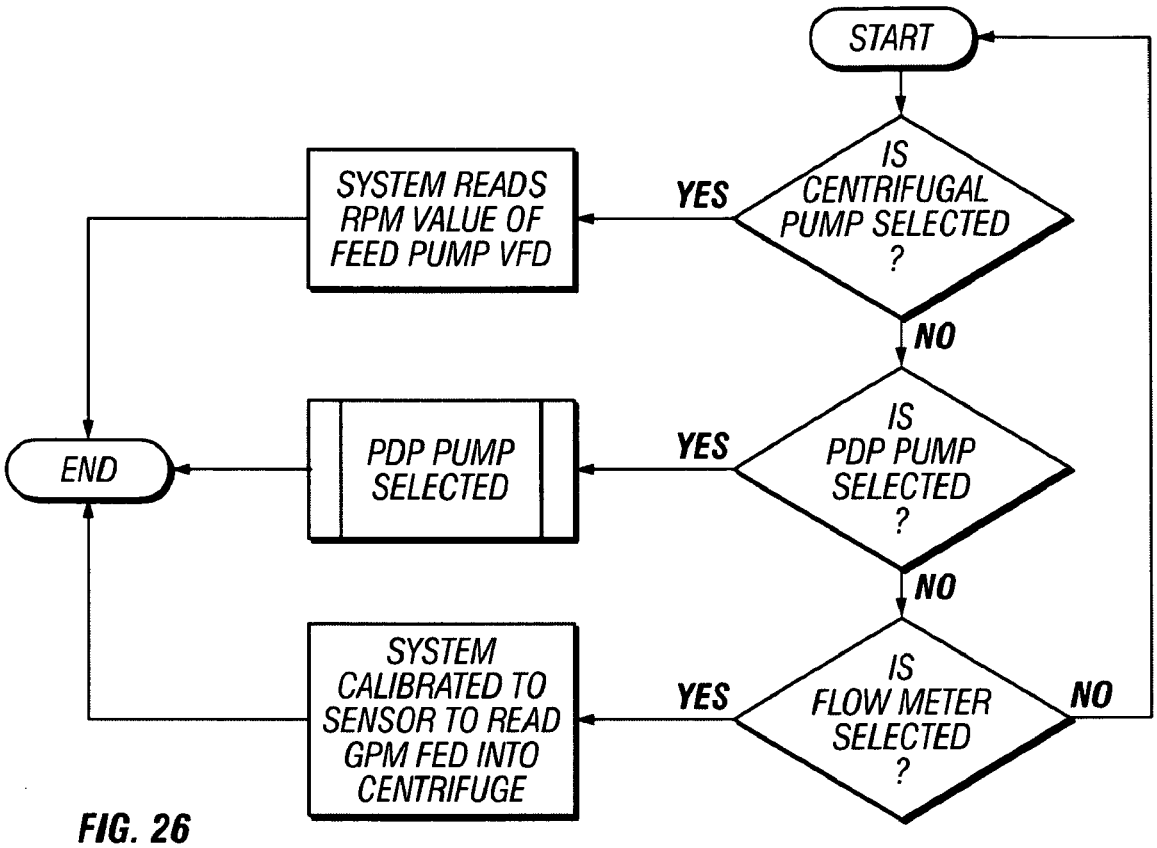
FIG. 26 is a schematic view in a method according to the present invention useful for centrifuge control.
Figure 27:
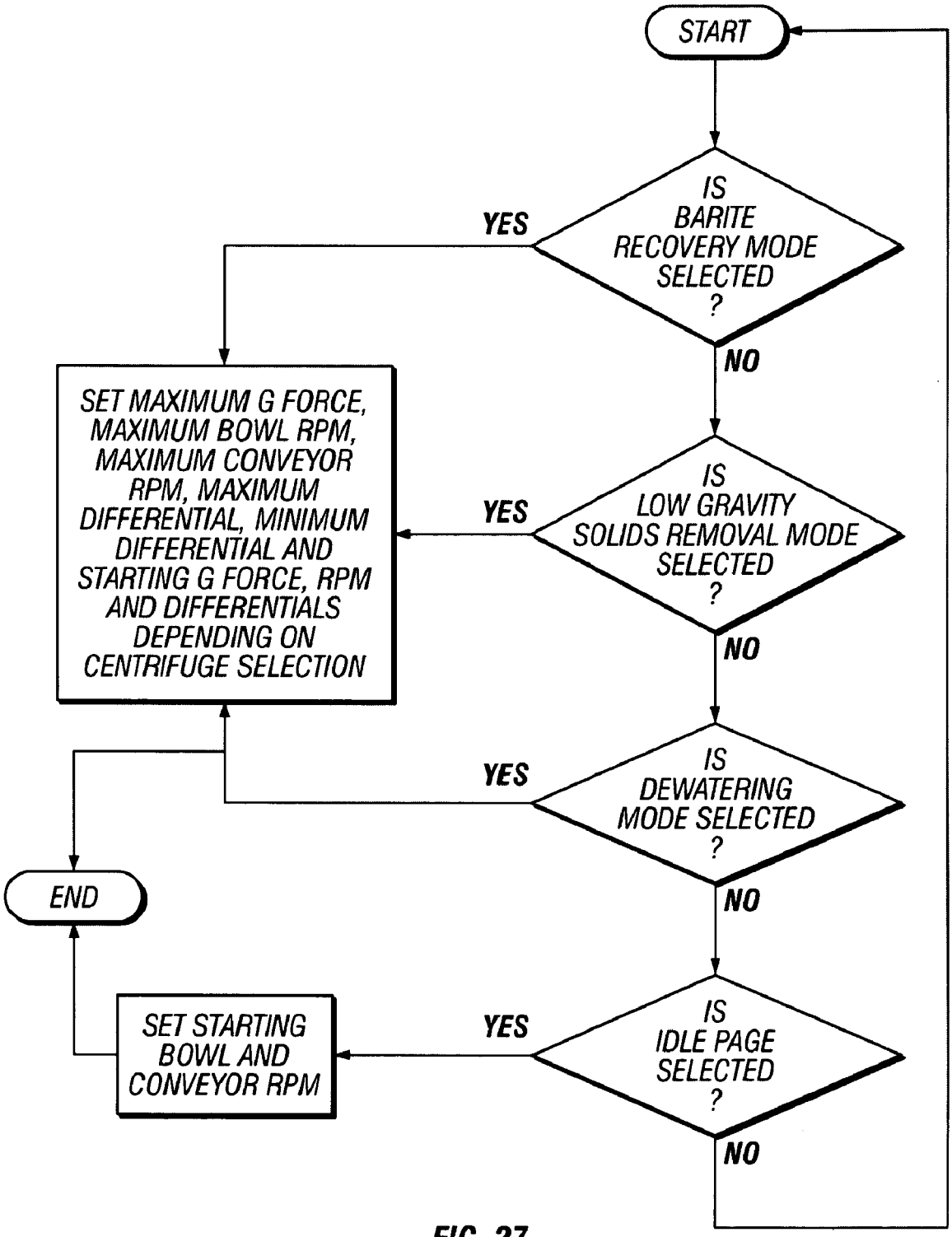
FIG. 27 is a schematic view in a method according to the present invention useful for centrifuge control.
Figure 28:
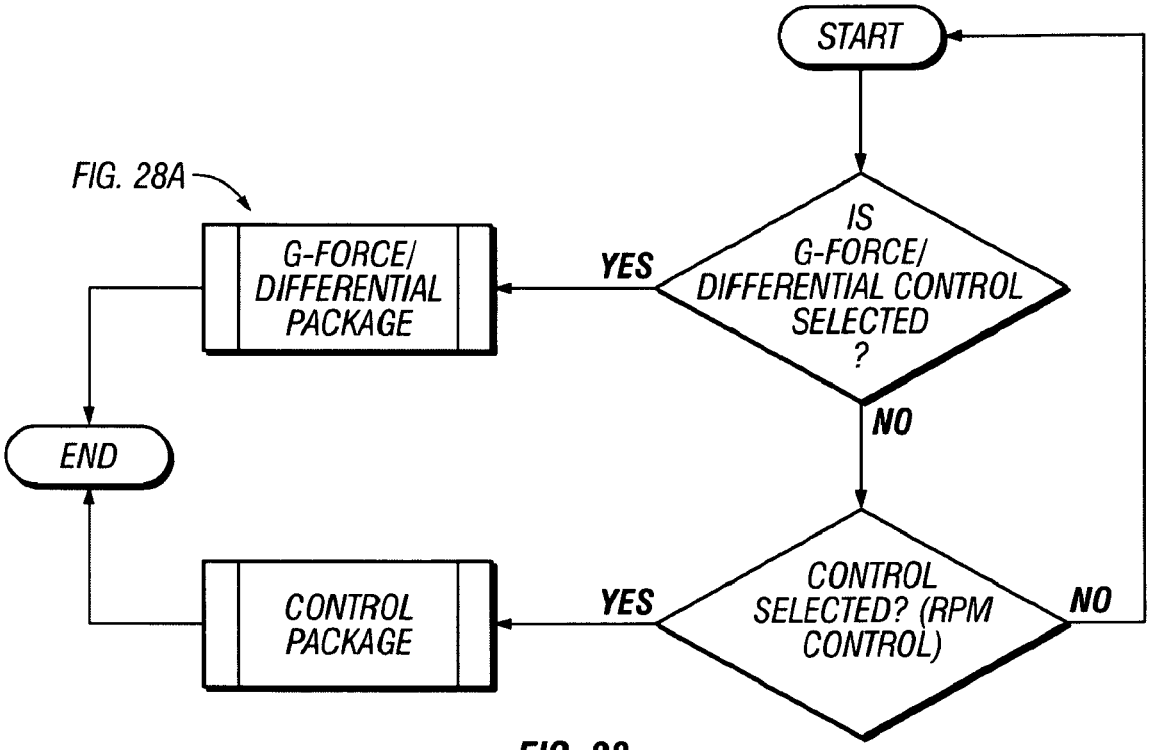
FIG. 28 is a schematic view in a method according to the present invention useful for centrifuge control.

Once the time is set, a centrifuge is selected ("SELECT CENTRIFUGE"; FIG. 25); a pump is selected ("SELECT PUMP"; FIG. 26); an operation is selected ("SELECT OPERATION"; FIG. 27); and a control method is selected ("SELECT CONTROL METHOD"; FIG. 28). The centrifuge is run ("RUN CENTRIFUGE") with the pump running (FIG. 29A); with torque protection (FIG. 29B); and with fault protection (FIG. 29C). It is within the scope of the present invention to control and run any centrifuge, e.g., but not limited to, any triple drive centrifuge and can, in one aspect, achieve this without the need for reprogramming the touch screen apparatus.

To begin ("START") the select centrifuge step, FIG. 25, either a specific known centrifuge is selected by model (e.g. HS-2000) or another centrifuge is selected ("IS OTHER SELECTED"). If a known centrifuge is selected, its preprogrammed settings already entered into the system (e.g. a particular bowl pulley ratio and gearbox ratio) are applied in the operating system. If another centrifuge is selected, parameters are entered into the system by a user (e.g. gearbox ratio, bowl inner diameter, bowl pulley ratio, minimum rpms for bowl of the centrifuge, and minimum rpms for the centrifuge's conveyor). For a known centrifuge (not "another centrifuge") minimum bowl and conveyor rpms are preset. In one particular aspect, the bowl is set at a minimum of 800 rpms and the conveyor motor is set at a minimum of 400 rpms; and, in another aspect, the bowl is set at 2500 rpms or at 3000 rpms and the conveyor motor at 100 rpms, 250 rpms, or at 460 rpms.

To begin ("START") pump selection, FIG. 26, a particular type of pump system is selected using the touch screen (as is done in the other steps of the method); e.g. a centrifugal pump or a PDP pump. If neither of these types of pump are chosen, a flow meter is used to read the pump's flow ("IS FLOW METER SELECTED") and the system is calibrated to read the selected pump's flow to the centrifuge in gpm.

Figure 26A:
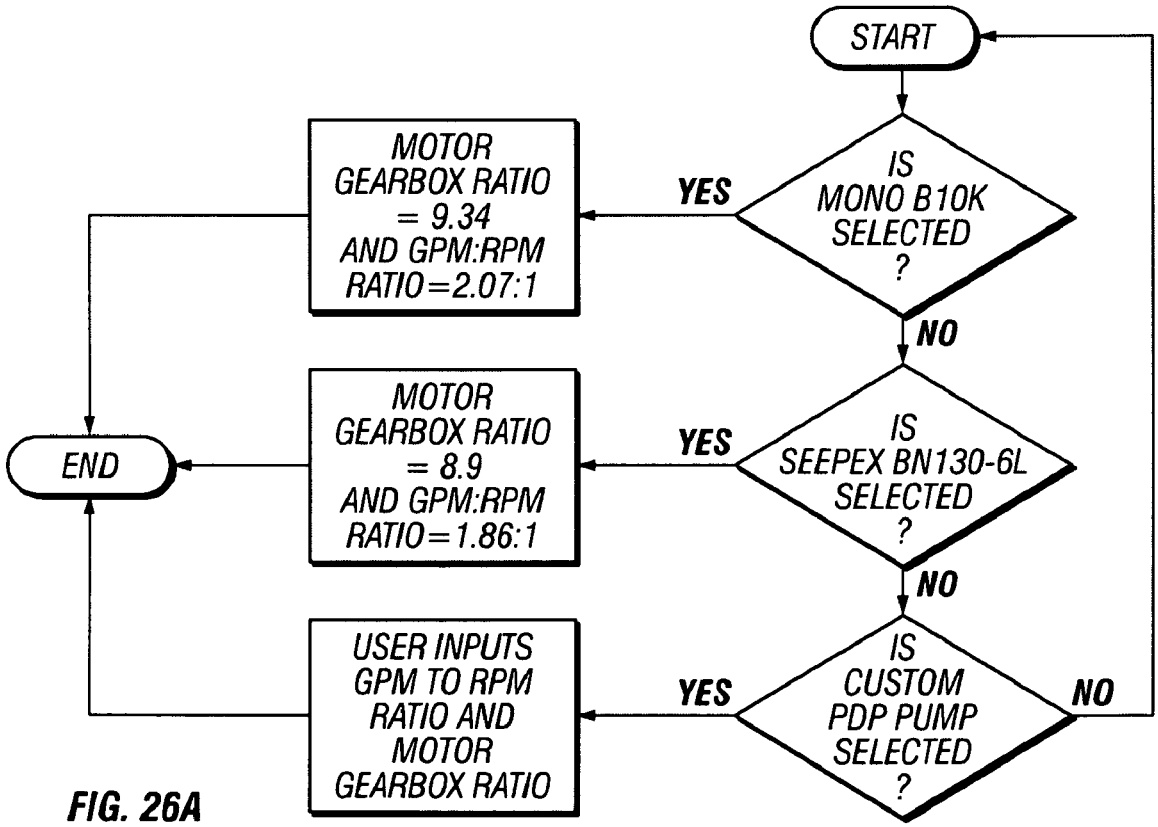
FIG. 26A is a schematic view in a method according to the present invention useful for centrifuge control.

When a PDP pump is selected (FIG. 26A) the method beings ("START") by entering the type of PDP pump (e.g. Mono Blok; Seepex BN 130-6L; or a custom pump). For known pumps, parameters (motor gearbox ratio and gpm/rpm ratio) are pre-set. For a custom pump, gpm/rpm ratio and motor gearbox ratio are input by the user. then this step is done ("END").

To begin to select a particular operation ("START", FIG. 27) one of a variety of choices is made; e.g., barite recovery, lower gravity solids removal, dewatering mode, or idle ("IDLE PAGE"). Once an operation is selected, using the touch screen, pre-set parameters take effect, e.g. as the following: maximum g force of the bowl (maximum bowl rpm); maximum conveyor rpm; maximum bowl/conveyor differential; minimum bowl/conveyor differential; starting G force; starting rpms; starting differential (depending on centrifuge selection). If idle operation is selected, starting bowl rpm and starting conveyor motor rpm is preset (or optionally input by the user). In one aspect, idle is selected to allow the centrifuge to run at low speed while preserving the interior wall cake in cold climates (e.g. to prevent plugging).

Figure 28A:
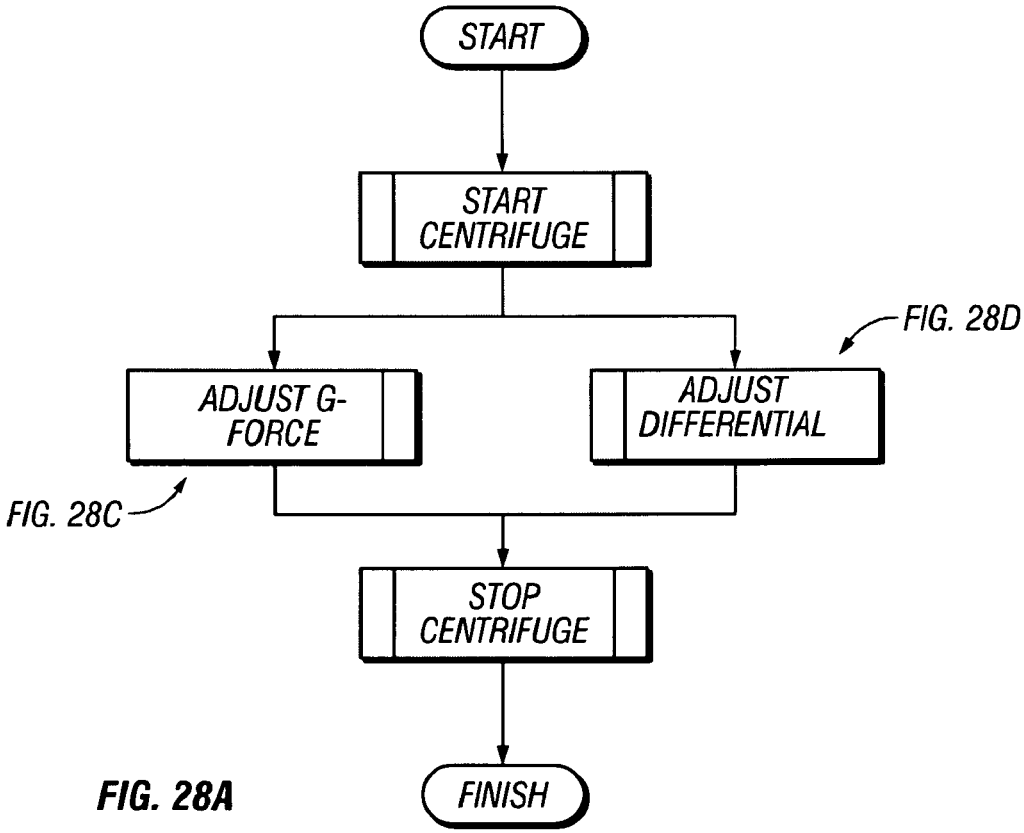
FIG. 28A is a schematic view in a method according to the present invention useful for centrifuge control.
Figure 28B:
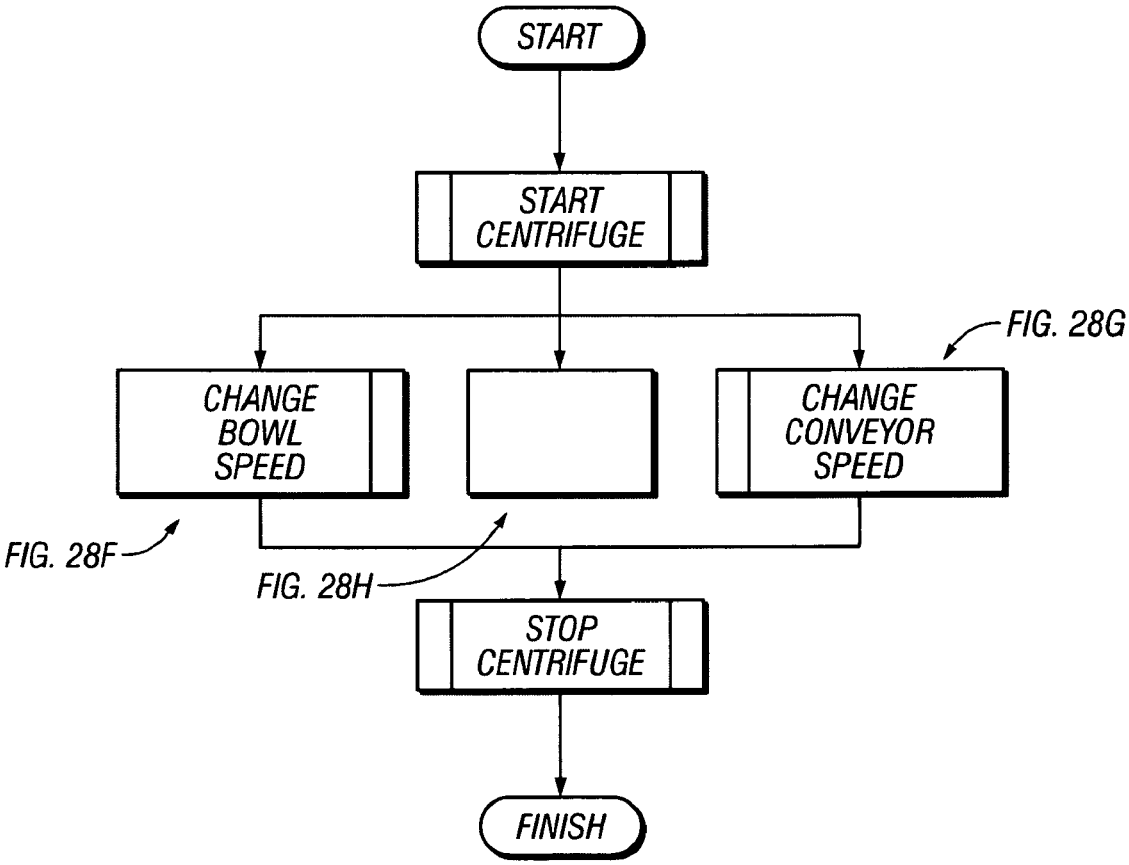
FIG. 28B is a schematic view in a method according to the present invention useful for centrifuge control.

To begin ("START", FIG. 28) to select a control method, the user inputs a choice of one type of control method (control rpms; FIG. 28B) or G-force differential control (differential is the bowl-rpm conveyor-rpm differential; FIG. 28A).

The control rpm sub-method is illustrated in FIGS. 28B, 28F, 28G and 28H. The G-force differential control method is illustrated in FIGS. 28A, 28C, 28D and 28F.

In the G-force-differential control mode (FIG. 28A) starting the centrifuge ("START"; "START CENTRIFUGE") ramps the bowl and the conveyor to predetermined speeds based on the operation. The bowl speed may be changed (FIG. 28F); the conveyor speed may be changed (FIG. 28G); the conveyor motor direction may be changed (FIG. 28H); and the centrifuge may be stopped (as in FIG. 28E).

Figure 28C:
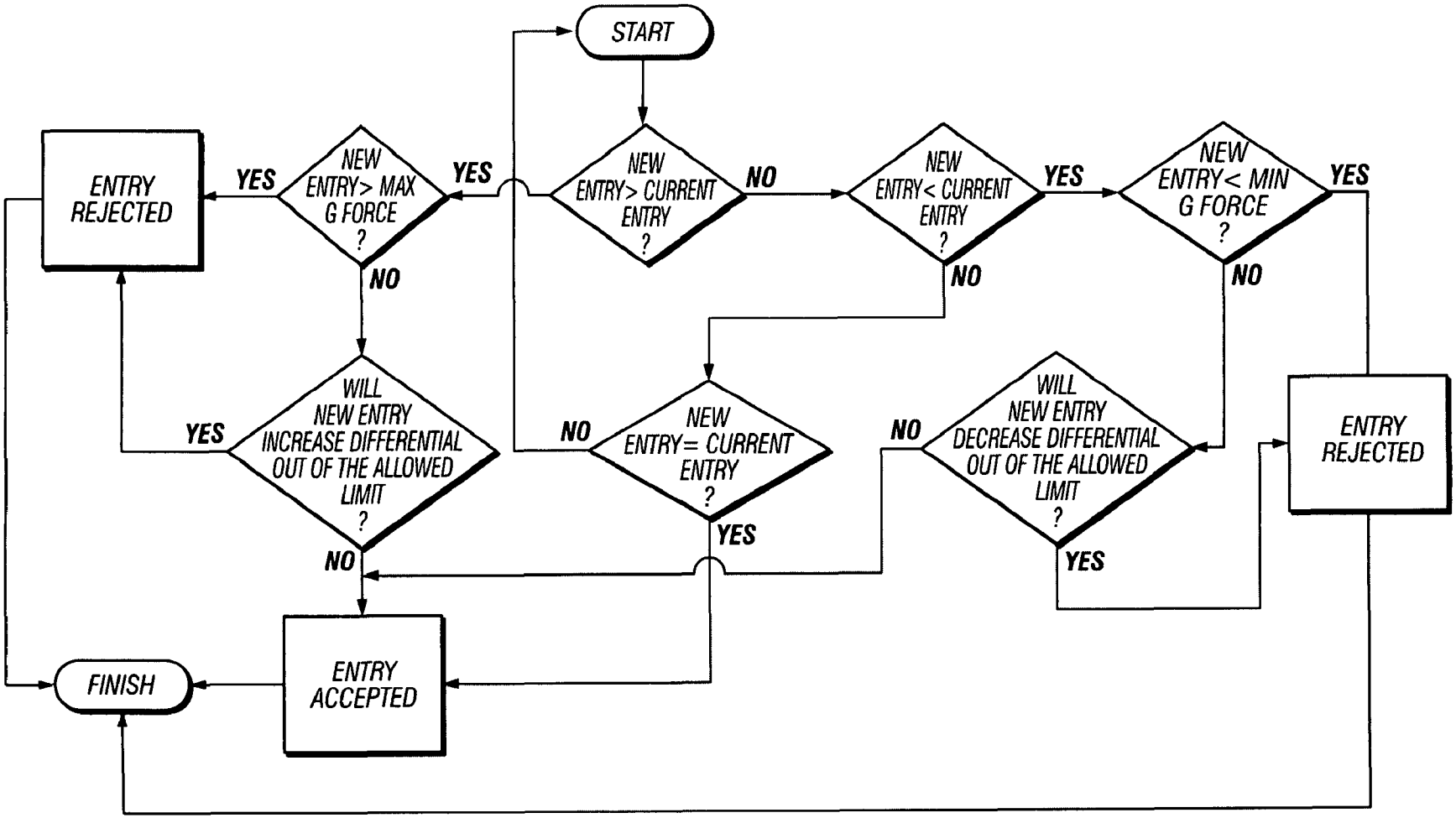
FIG. 28C is a schematic view in a method according to the present invention useful for centrifuge control.
Figure 28D:
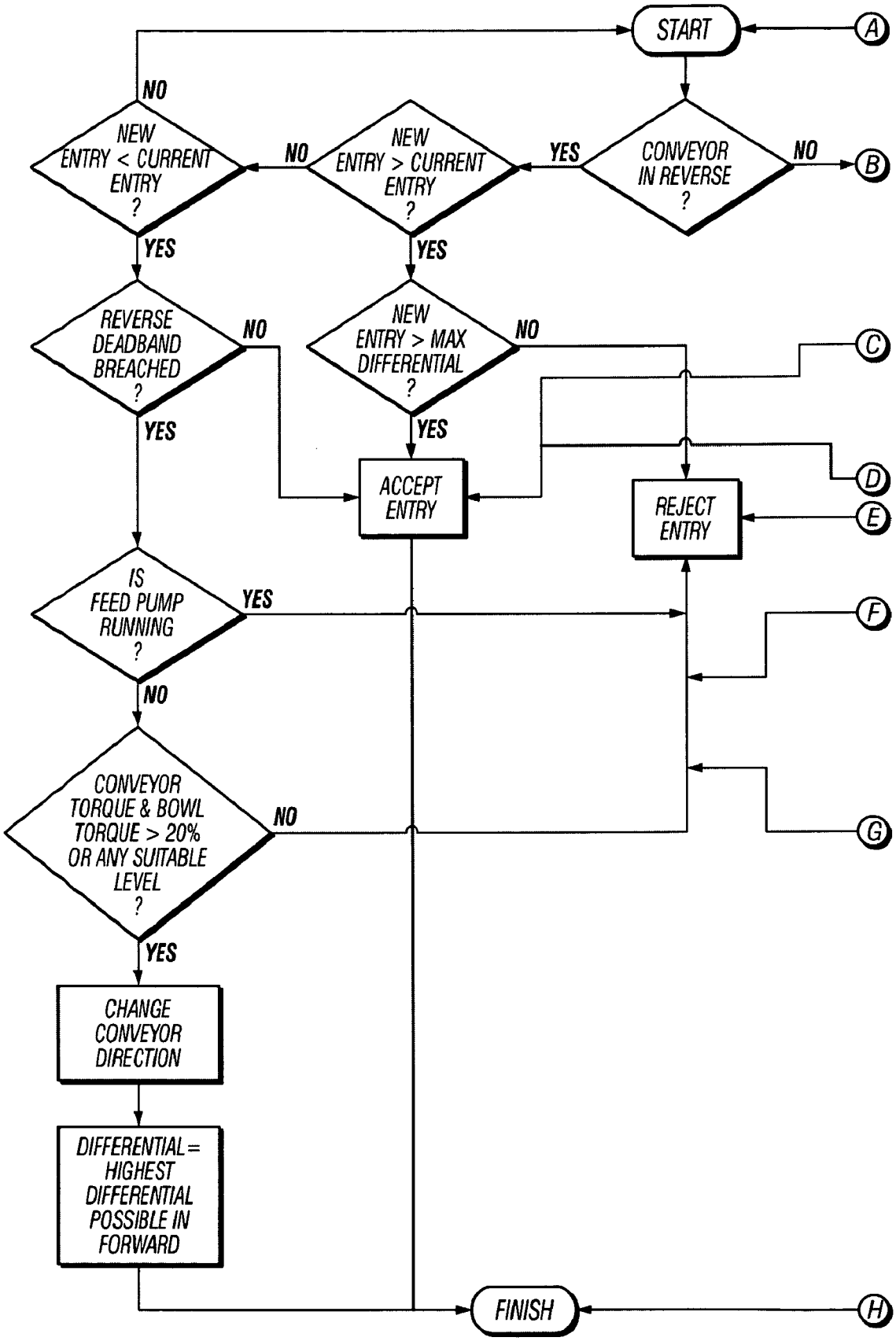
FIG. 28D is a schematic view in a method according to the present invention useful for centrifuge control.
Figure 28D:
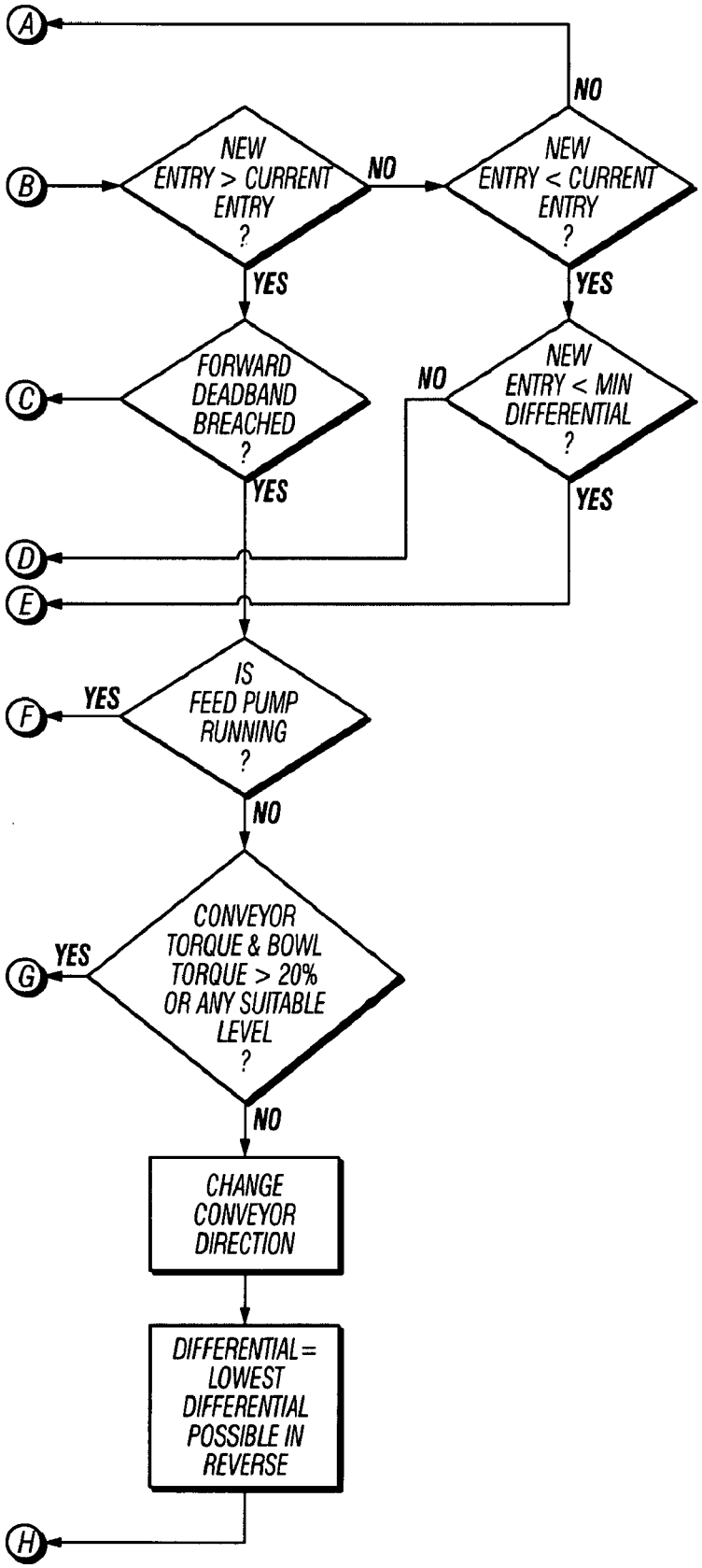
Figure 28E:
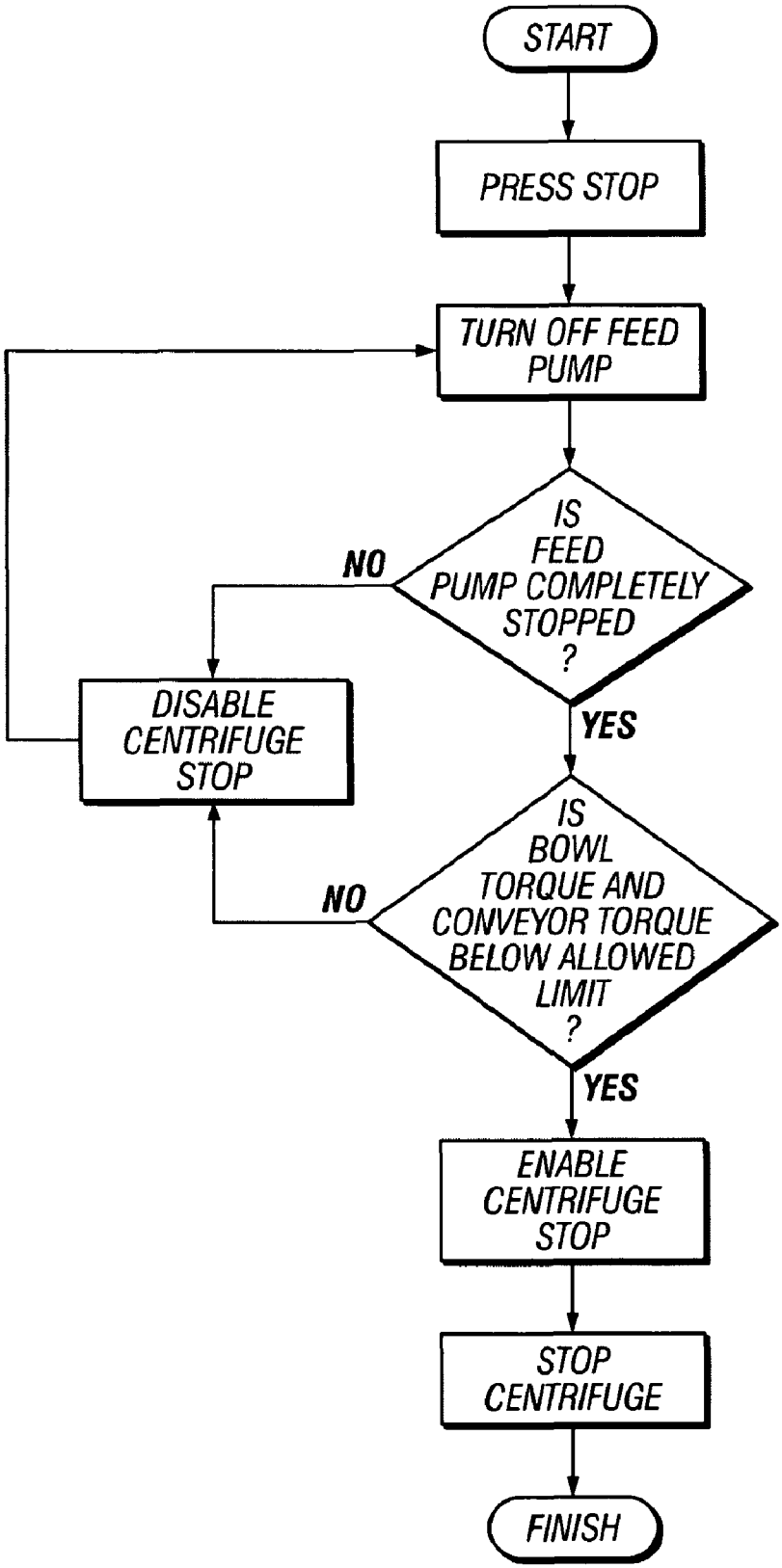
FIG. 28E is a schematic view in a method according to the present invention useful for centrifuge control.
Figure 28F:
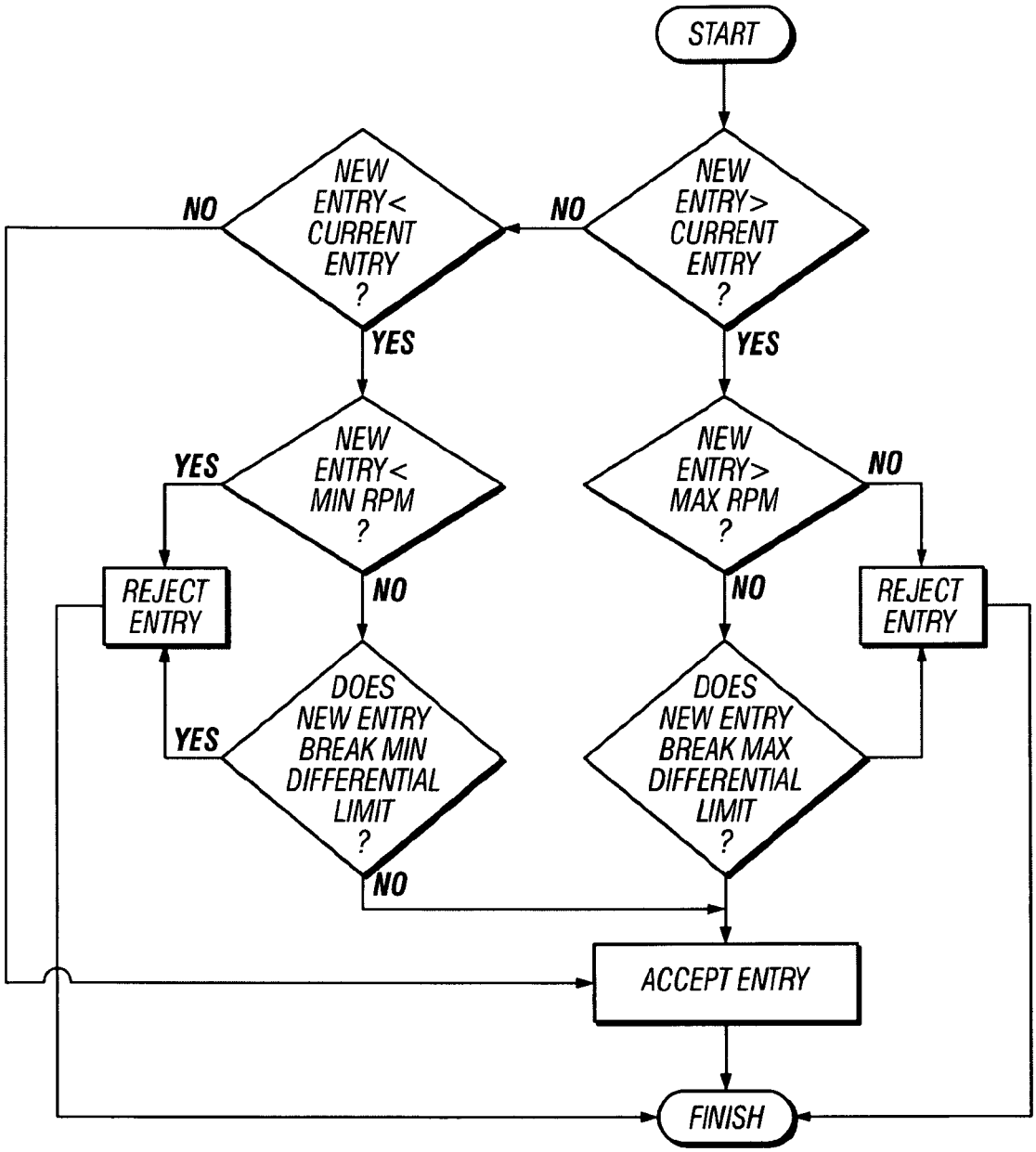
FIG. 28F is a schematic view in a method according to the present invention useful for centrifuge control.

To begin ("START"; FIG. 28F) to change the bowl speed, a user chooses between inputting: a new speed ("ENTRY") greater than the current speed; and a new speed less than the current speed in rpms. If a new entry is chosen and it is not greater than the maximum rpm speed, and does not break the maximum bowl/conveyor differential limit, then it is accepted ("ACCEPT ENTRY") and this step is over ("FINISH"). If a new entry is not greater than the current entry and is not less than the current entry, ("NEW ENTRY<CURRENT ENTRY"), it is accepted. If the new entry does not exceed the minimum or maximum differential limit, and it does not exceed the maximum or minimum speed allowances, ("DOES NEW ENTRY BREAK MIN DIFFERENTIAL LIMIT ?"), it is accepted.

As shown in FIG. 28F, entries not satisfying the conditions stated in the paragraph above are rejected ("REJECT ENTRY") and the rpm does not change.

Figure 28G:
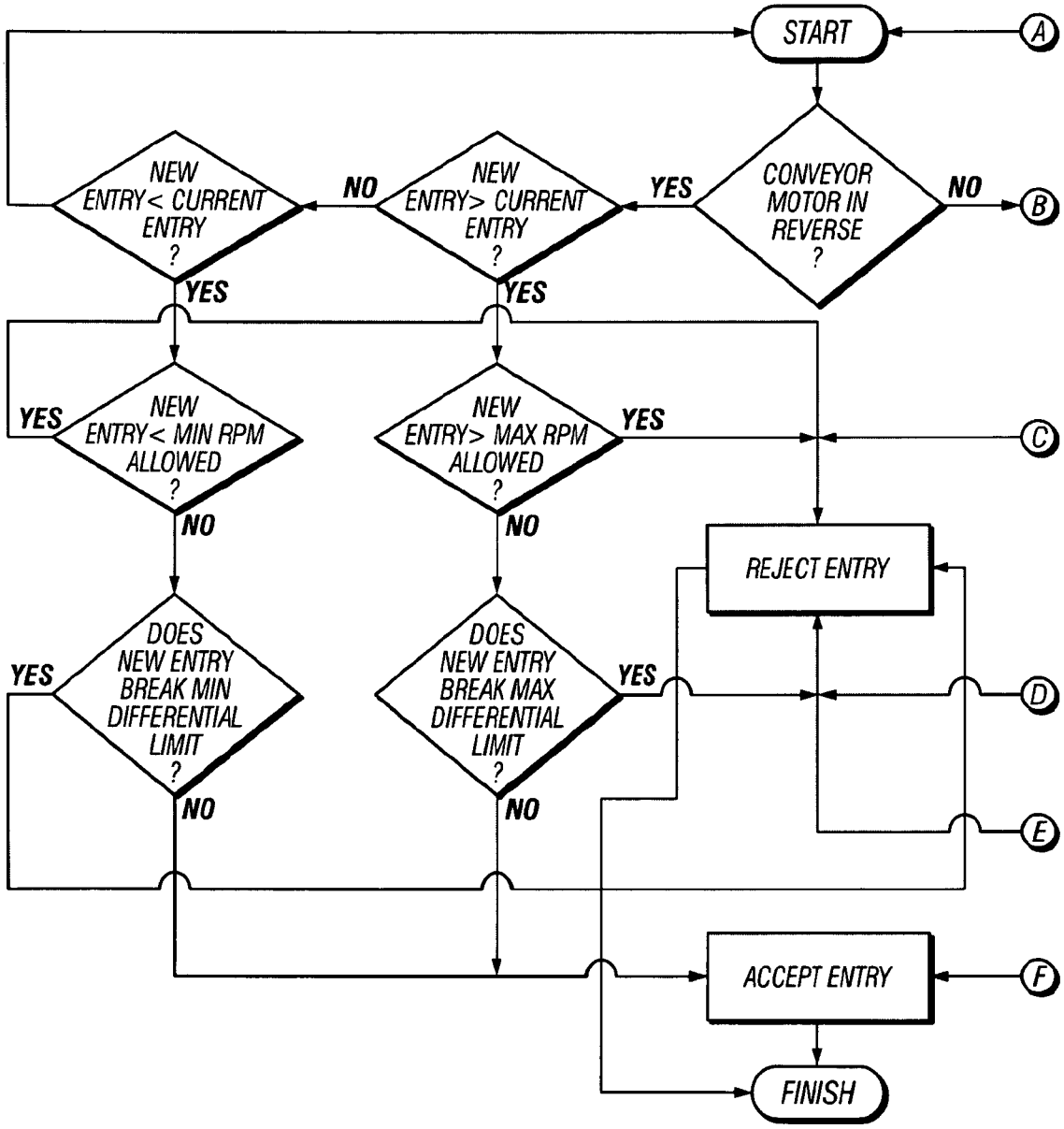
FIG. 28G is a schematic view in a method according to the present invention useful for centrifuge control.
Figure 28G:
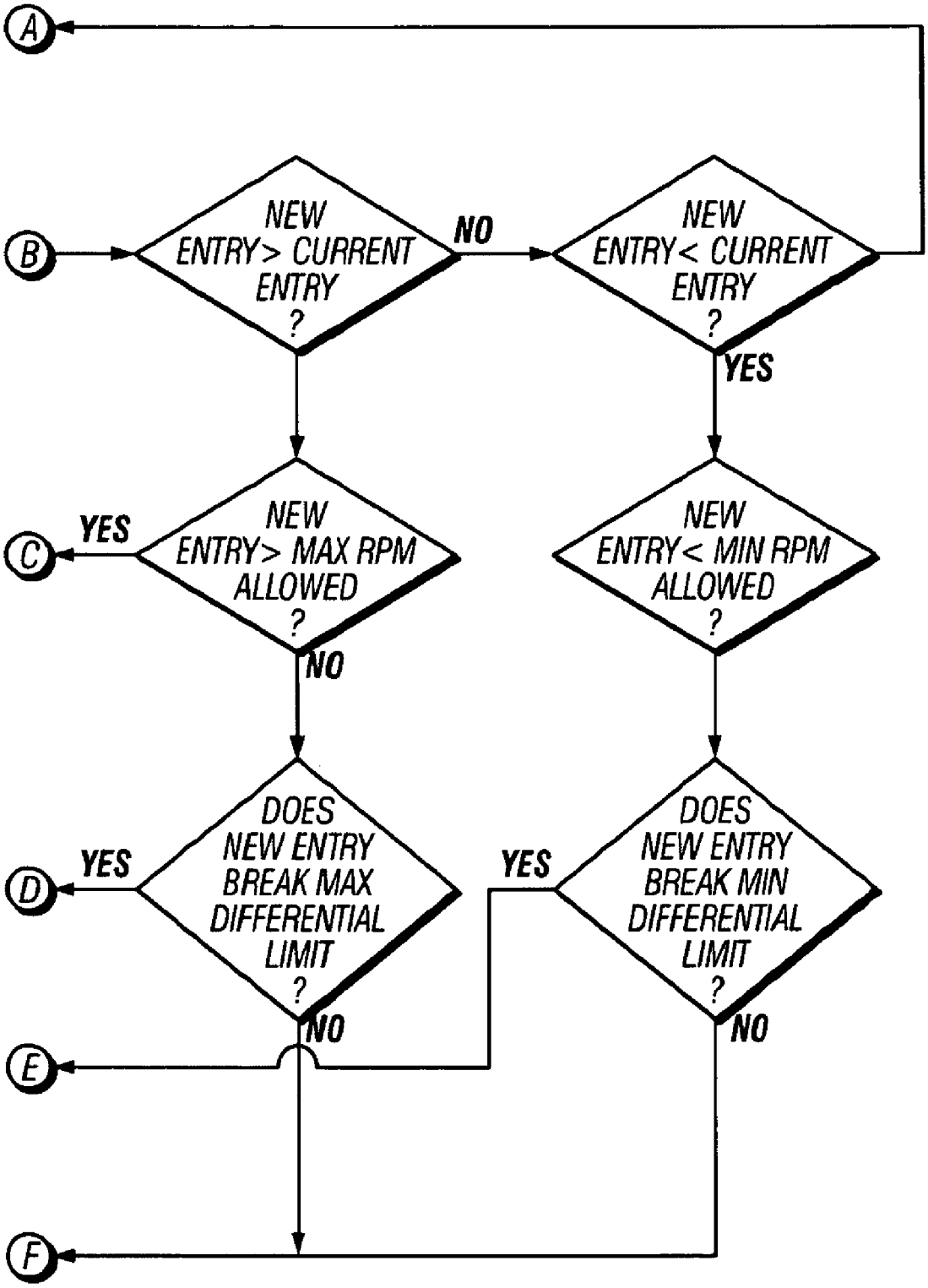
Figure 28H:
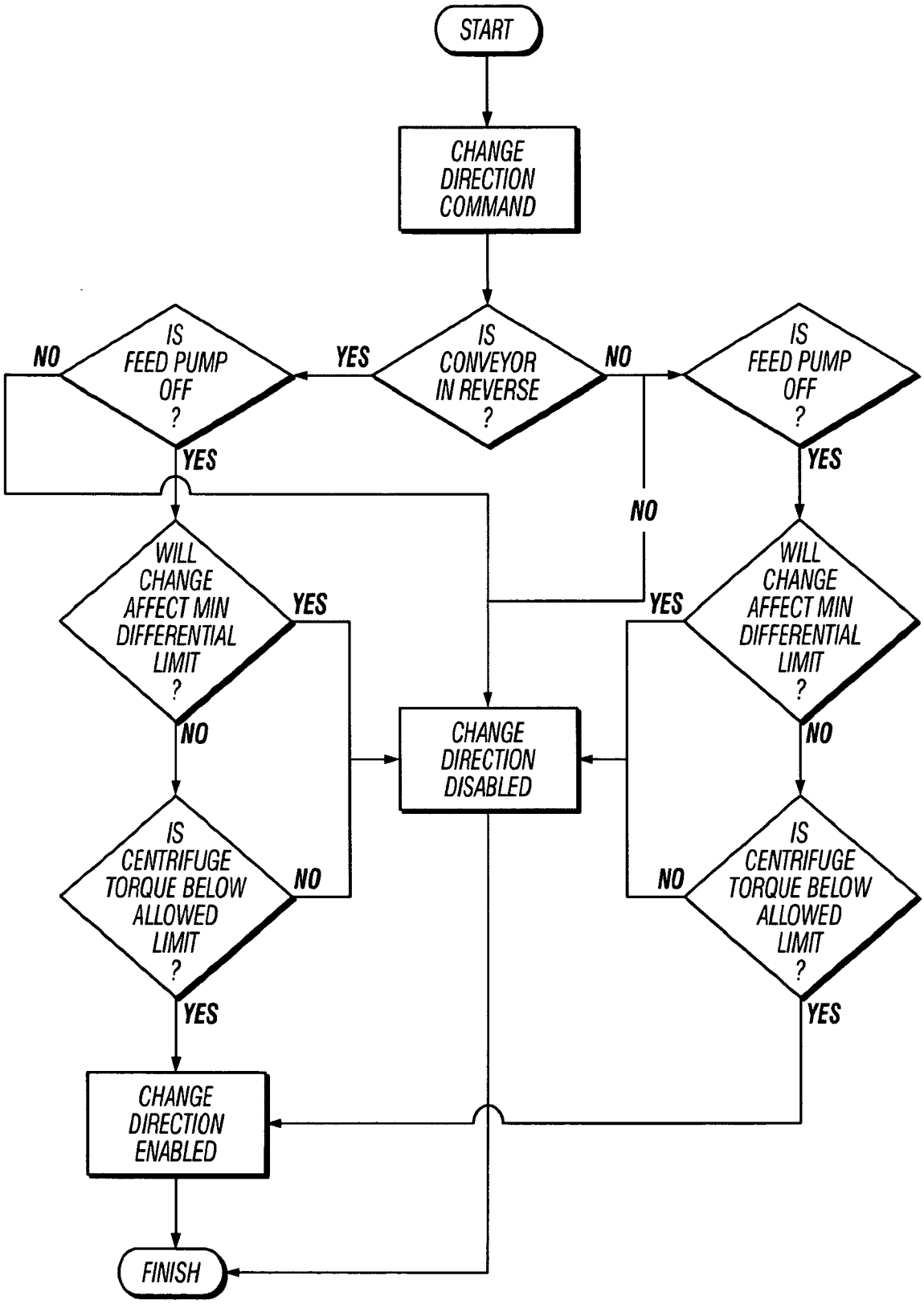
FIG. 28H is a schematic view in a method according to the present invention useful for centrifuge control.

FIG. 28G illustrates steps in changing the conveyor speed (and, hence, the bowl/conveyor rpm differential) beginning ("START") with a system response to the question whether the conveyor motor is moving in reverse ("CONVEYOR IN REVERSE"). A new conveyor speed is accepted if, as shown in FIG. 28G, conditions are satisfied regarding: the new entry's relation to the current entry—greater than or less than the current entry; the new entry's relation to the maximum allowed speed and the minimum allowed speed; and whether the new entry violates the maximum and minimum differential limits.

Beginning a step to change the conveyor motor direction ("START", FIG. 28H), the system checks whether the conveyor motor is running in reverse ("IS CONVEYOR MOTOR IN REVERSE?"). A change in direction is not permitted if the feed pump is running ("IS FEED PUMP OFF"); if the maximum or minimum differential limit is violated; or if bowl torque and conveyor torque exceed a preset level; or if the conveyor motor is not in reverse and: if the feed pump is off ("IS FEED PUMP OFF") and the direction change will affect the maximum differential limit (bowl-conveyor speed differential); or with the feed pump off and the differential not changed, the centrifuge torque is not below an allowed limit ("IS CENTRIFUGE TORQUE BELOW ALLOWED LIMIT"). If the centrifuge torque is below the allowed limit, and the differential limit is not exceeded and the pump is off, the change direction command is executed ("CHANGE DIRECTION ENABLED") and the step is done ("FINISH"). If the feed pump is off and the direction change will affect the minimum differential limit ("WILL CHANGE AFFECT MIN DIFFERENTIAL LIMIT"), the change is not allowed ("CHANGE DIRECTION DISABLED"). If the feed pump is off, the minimum differential limit is not affected, and the centrifuge torque is not below the allowed limit, and the differential limit is not exceeded and the pump is off, the direction change is not allowed and, if the torque is below the allowed limit the direction change is allowed ("CHANGE DIRECTION ENABLED").

In the G-force-differential control mode of FIG. 28A, in starting the centrifuge ("START CENTRIFUGE") the G-force can be adjusted ("ADJUST G FORCE"; FIG. 28C) or the differential (bowl-conveyor speed differential) can be adjusted ("ADJUST DIFFERENTIAL") (FIG. 28D). The step of stopping the centrifuge is illustrated in FIG. 28E. When this is executed, then the step is done ("FINISH").

As shown in the step of FIG. 28C, there being a minimum speed below which the control system will not let the centrifuge conveyor motor or the bowl motor go, the differentials referred to in FIG. 28C depend on these minimum allowable speeds. There is a differential for when the conveyor motor is in reverse:

Differential (Conveyor Motor in Reverse)=[(Sqrt (GFORCE*70414/Bowl_ID)]+Conveyor Motor RPM]/GB_Ratio and a differential for when the conveyor motor is in forward:

Differential (Conveyor Motor in Reverse)=[(Sqrt (GFORCE*70414/Bowl_ID)]−Conveyor Motor RPM]/GB_Ratio "Sqrt" is square root. "GFORCE" is the G-force on the bowl. "Bowl_ID" is the inside diameter of the bowl. "Conveyor Motor RPM" is the speed in rpms of the conveyor motor. "GB_Ratio" is the gear ratio for a gear system between the bowl and the conveyor. The system queries regarding whether the new entry will be greater or less than the current entry and how the new entry will affect the allowed limit on the differential (FIG. 28C). With other condition met, if the new entry will not increase the differential beyond the allowed limit, the new entry is accepted (FIG. 28C, "ENTRY ACCEPTED"); and if, with other conditions being met, the new entry will not decrease the differential below the allowed limit, the new entry will be accepted. Otherwise, the new entry will be rejected ("ENTRY REJECTED"). Once the entry is accepted (or rejected) this step is done ("FINISH"). Once the entry is accepted (or rejected) this step is done ("FINISH"). If a new entry is rejected, a message that the attempted new entry is invalid will appear on the touch screen ("HMI").

Regarding the speed differential between the conveyor and bowl, there is a "deadband." The centrifuge cannot operate in this deadband. When the deadband is breached, a differential value change (speed differential) will cause the conveyor motor to drop below the allowed speed (rpm) of the conveyor motor. Deadband breach occurs when the differential value decreases, and in forward motion this occurs when the differential value increases. The highest and lowest differentials (in the two bottom blocks of FIG. 28D above "FINISH") depend on the current G-force setting. The steps shown in FIG. 28D are designed to prevent the centrifuge from operating in the deadband and can change conveyor motor direction to skip the deadband.

FIG. 28E presents steps in a sub-method for stopping the centrifuge. It should be kept in mind that it is always possible to effect an emergency stop of the centrifuge.

To begin the sub-method of FIG. 28E ("START"), "stop" is touched on the touch screen ("PRESS STOP") and the feed pump is turned off ("TURN OFF FEED PUMP"). Once the feed pump is off ("IS FEED PUMP COMPLETELY STOPPED ?") and the torque on the bowl and torque on the conveyor are below pre-set levels ("IS TORQUE BELOW ALLOWED LIMIT ?"), the system enables stopping of the centrifuge ("ENABLE STOP CENTRIFUGE") and the centrifuge stop button is pressed ("STOP CENTRIFUGE"). When the centrifuge stops, this sub-method is done ("FINISH").

If the feed pump is not stopped or the torque is not below the allowed limit, the centrifuge will not be stopped ("DISABLE CENTRIFUGE STOP").

The feed pump is stopped so that no more solids are pumped to the centrifuge. A lower torque indication (e.g. below a certain percentage of maximum possible torque, e.g. 30% of maximum possible torque) indicates that all (or substantially all) solids have been evacuated from the centrifuge. It is desirable to have the centrifuge cleaned out of solids prior to stopping because this avoids plugging of the centrifuge.

Figure 29A:
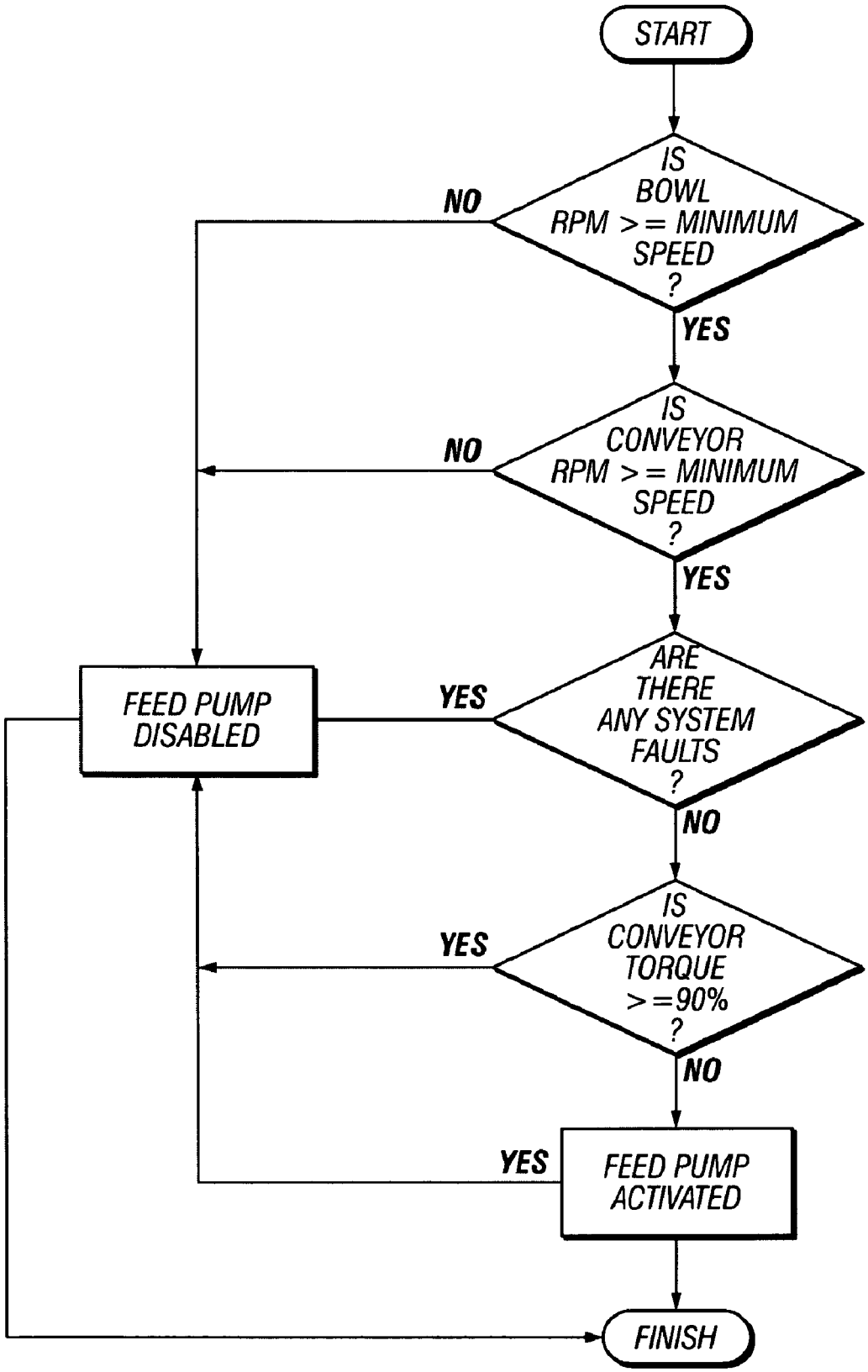
FIG. 29A is a schematic view in a method according to the present invention useful for centrifuge control.

To insure that the bowl and conveyor are rotating at a desired speed before the feed pump is activated, a sub-method is done as in FIG. 29A. To begin ("START") the system is queried to see if the bowl and conveyor rotation speeds are equal to or greater than the acceptable minimum speeds ("IS BOWL RPM MINIMUM SPEED"; "IS CONVEYOR RPM MINIMUM SPEED"). If so, and if there are no system faults ("ARE THERE ANY SYSTEM FAULTS?"), and if the conveyor torque is less than or equal to 90% of the full torque (a pre-set maximum, e.g. in pound-feet) ("IS CONVEYOR TORQUE<90%"), then the feed pump is activated ("FEED PUMP ACTIVATED") and this submethod is done ("FINISH").

The feed pump is disabled ("FEED PUMP DISABLED") if there are faults (e.g. VFD faults in the bowl VFD or the conveyor VFD, etc.) in the system or if the conveyor torque is at a high level.

Figure 29B:
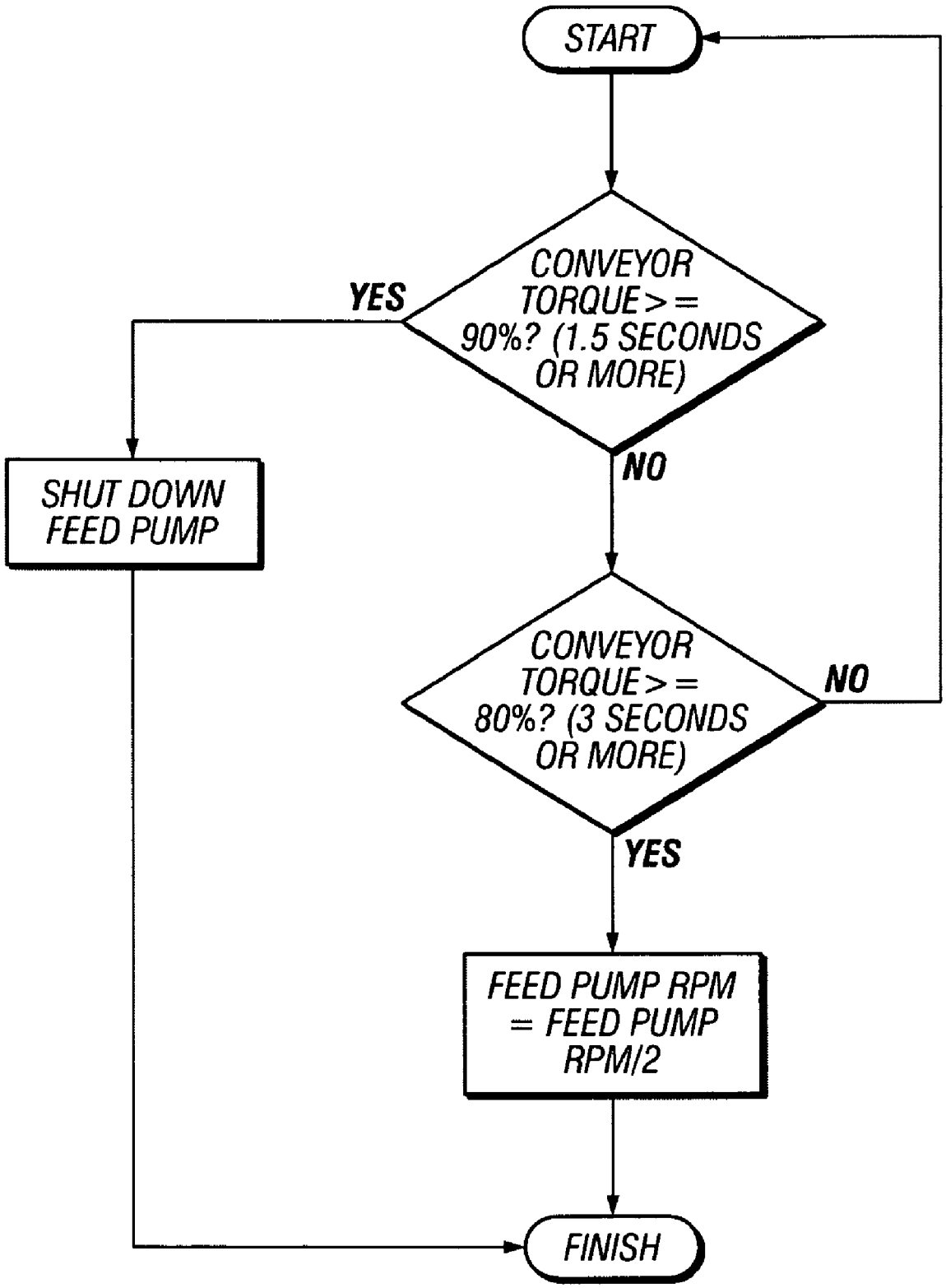
FIG. 29B is a schematic view in a method according to the present invention useful for centrifuge control.
Figure 29C:
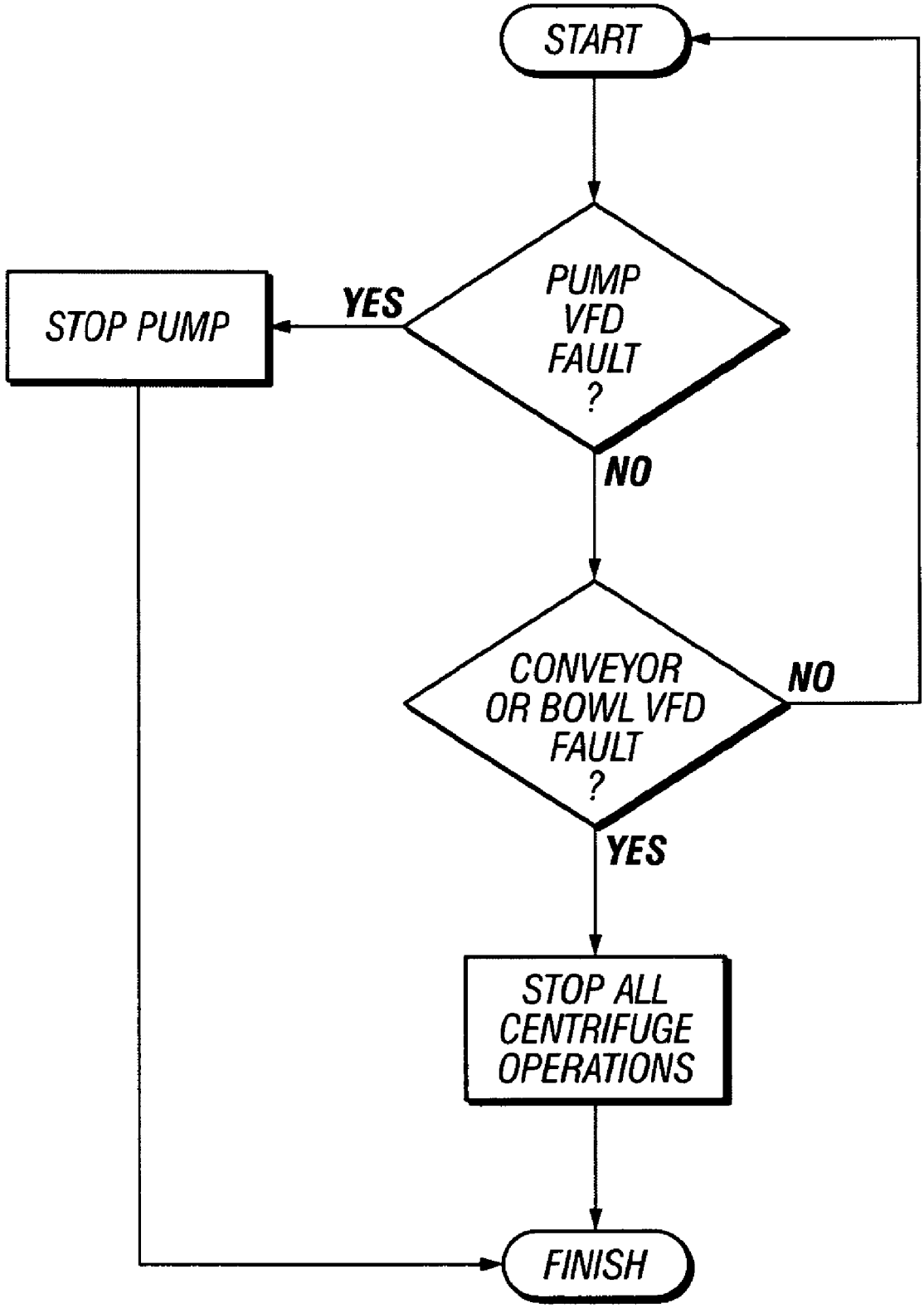
FIG. 29C is a schematic view in a method according to the present invention useful for centrifuge control.

FIG. 29B illustrates a torque protection method according to the present invention implemented by the control system, e.g. by a computer programmed to execute steps as listed, so that a desired maximum torque is not exceeded. A full maximum torque for the conveyor motor is preset in the control system. If ("YES") the actual torque is greater than or equal to 90% of this pre-set maximum for 1.5 seconds or more, ("CONVEYOR TORQUE≧90%? (1.5 SECONDS OR MORE)), the control system shuts down the feed system's pump ("SHUT DOWN FEED PUMP"; "FINISH"). If the torque is not greater than or equal to 90% of the pre-set maximum for 1.5 seconds or more ("NO"), and the torque is ("YES") greater than or equal to a preselected percentage (e.g. 80%) of the pre-set maximum for 3 seconds or more ("CONVEYOR TORQUE≧80%? (3 SECONDS OR MORE)), the feed pump motor is slowed down (to avoid centrifuge plugging), e.g. to a pre-set percentage of a preselected maximum feed pump speed, e.g. 20% to 60%, or e.g. by 50% ("FEED PUMP RPM=FEED PUMP RPM/2" "FINISH").

With the sub-method of FIG. 29B constantly operational, if the conveyor torque reads above a certain level (e.g. 80% of pre-set maximum) for a certain time period (e.g. 3 seconds), the feed pump output is reduced (e.g. by 50%); or if the conveyor torque reaches a higher level (e.g. 90% of the pre-set maximum) for a pre-set time period (e.g. 1-5 seconds), the feed pump is turned off. If the bowl torque is greater than or equal to 95% of a pre-set maximum for a time period T, the pump also slows down. If the bowl torque or the conveyor torque equals 100% of the pre-set maximum, the system shuts down; and if the pump torque equals 100% of the pre-set maximum, the pump (only) shuts down.

FIG. 29C illustrates a system shut down method according to the present invention implemented by the control system, e.g. by a computer programmed to execute steps as listed. If there is any fault sensed for the bowl VFD, the conveyor VFD ("CONVEYOR OR BOWL VFD FAULT") or for the pump VFD ("PUMP VFD FAULT"), the system is shut down ("FINISH"). In the event ("YES") of a pump VFD fault, the pump is shut down ("STOP PUMP") and the centrifuge continues running. In the event of a bowl VFD or conveyor VFD fault ("YES"), the centrifuge is stopped ("STOP ALL CENTRIFUGE OPERATIONS"). If there is a fault in a conveyor or a bowl VFD, a signal is sent to the two non-faulty VFDs, insuring that a touch screen reset button will be pressed before restarting the centrifuge. If there is a conveyor or bowl VFD fault, centrifuge operations cease ("STOP ALL CENTRIFUGE OPERATIONS") and, until restart, this sub-method is done ("FINISH").

FIGS. 30A-43 illustrate touch screen apparatus displays of a control system according to the present invention.

Figure 30A:
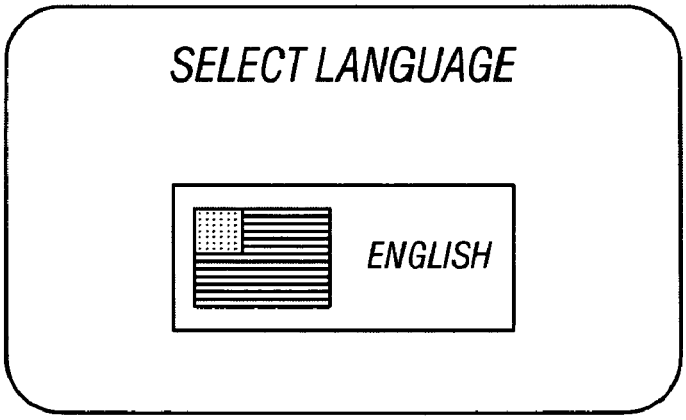
FIG. 30A is a view of a touch screen apparatus of a control system according to the present invention regarding language selection for communication between an operator and the control system.

FIG. 30A presents an initial screen for selecting a language for communication between an operator and the control system. The computer (or computers) of the touch screen apparatus and/or of the control system can be programmed to use any known language (e.g., but not limited to, French, Arabic, Russian, Spanish, English, Urdu, Italian, German, Hindi, Chinese, Japanese) which has a written alphabet, pictogram, Portuguese or symbol system.

Figure 30B:
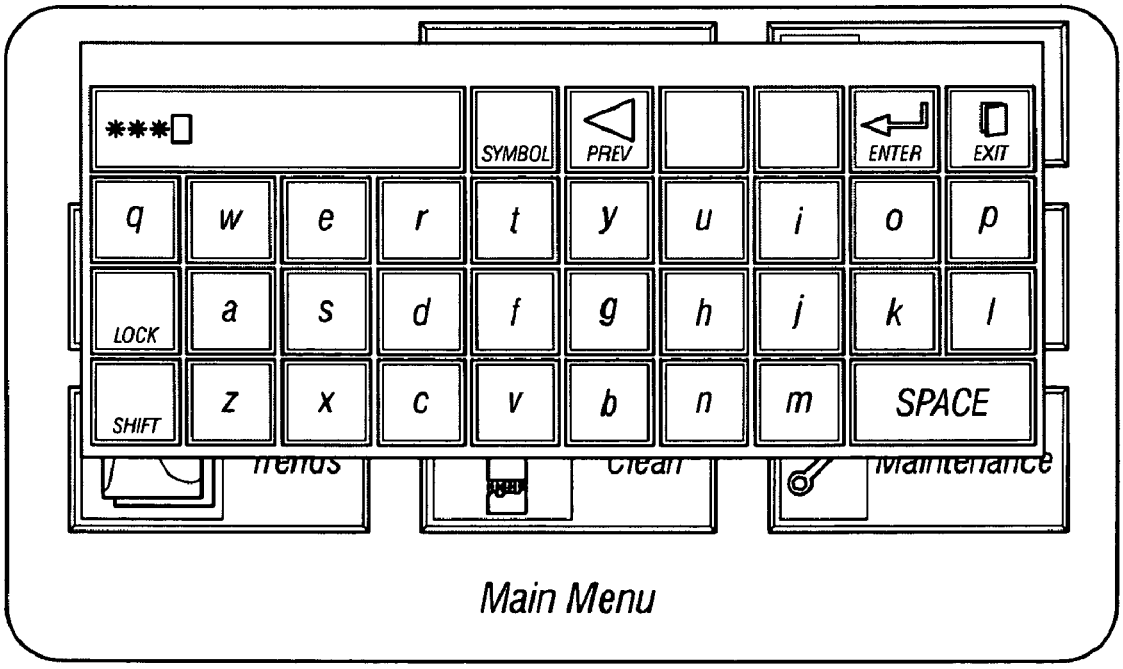
FIG. 30B is a view of a touch screen apparatus of the control system of FIG. 30A regarding password input to access the system.

FIG. 30B illustrates the system querying a user for a password so that the user can access restricted parts of the system.

Figure 30C:
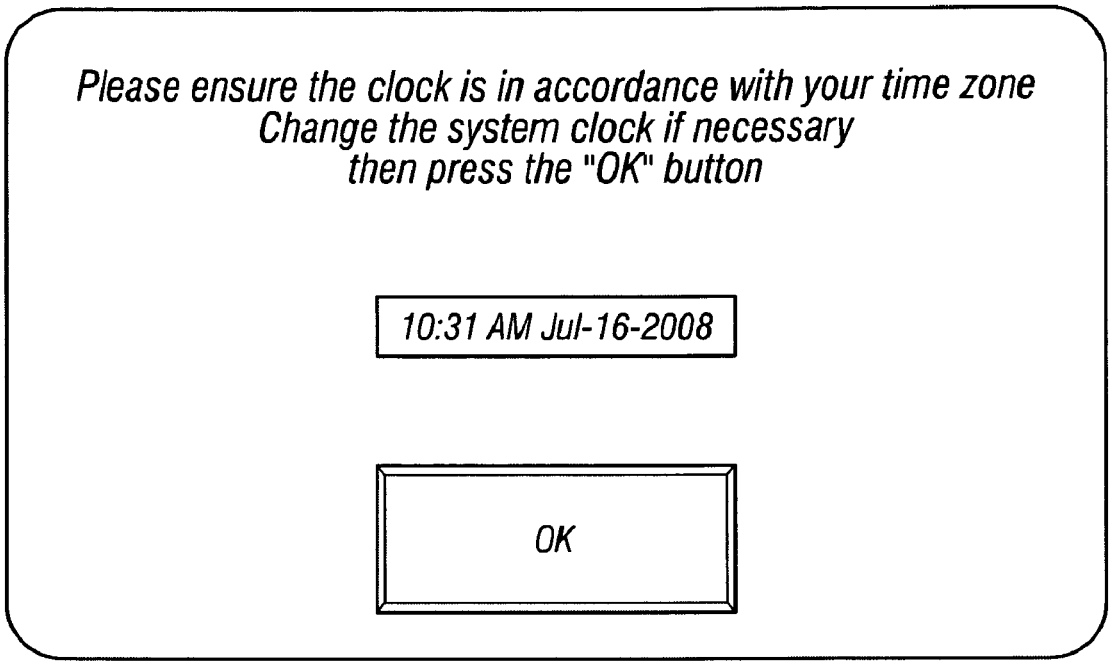
FIG. 30C is a view of a touch screen apparatus of the control system of FIG. 30A regarding correct clock setting.
Figure 30D:
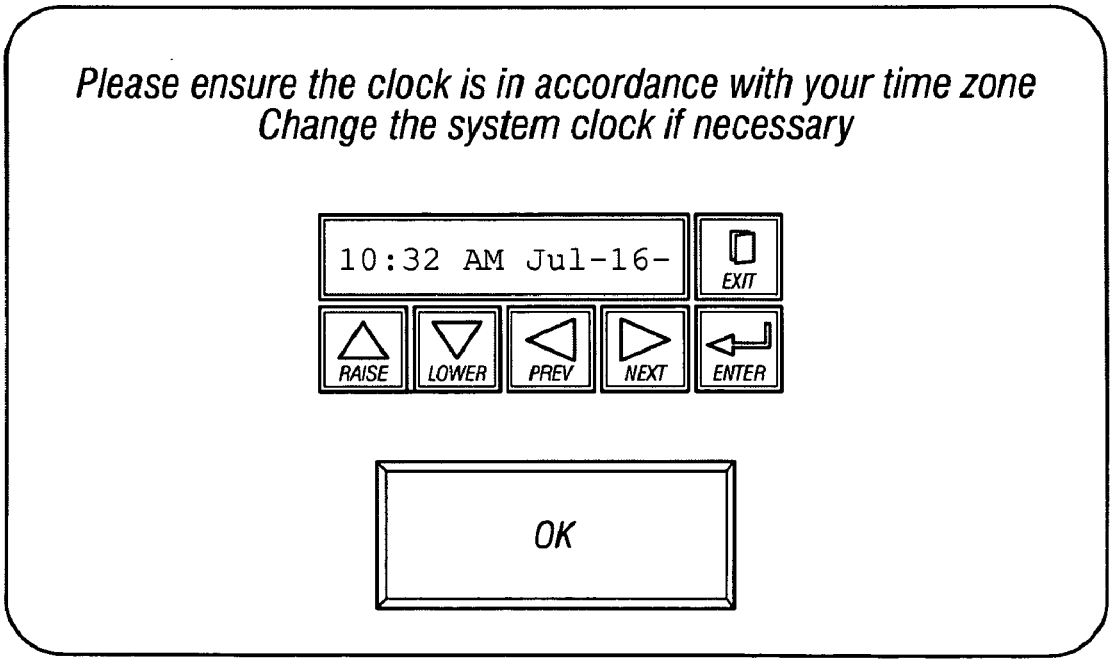
FIG. 30D is a view of a touch screen apparatus of the control system of FIG. 30A regarding settling the system clock.

FIG. 30C illustrates the system time and provides for selecting a change-time option. FIG. 30D illustrates a screen used to change the system time.

Figure 30E:
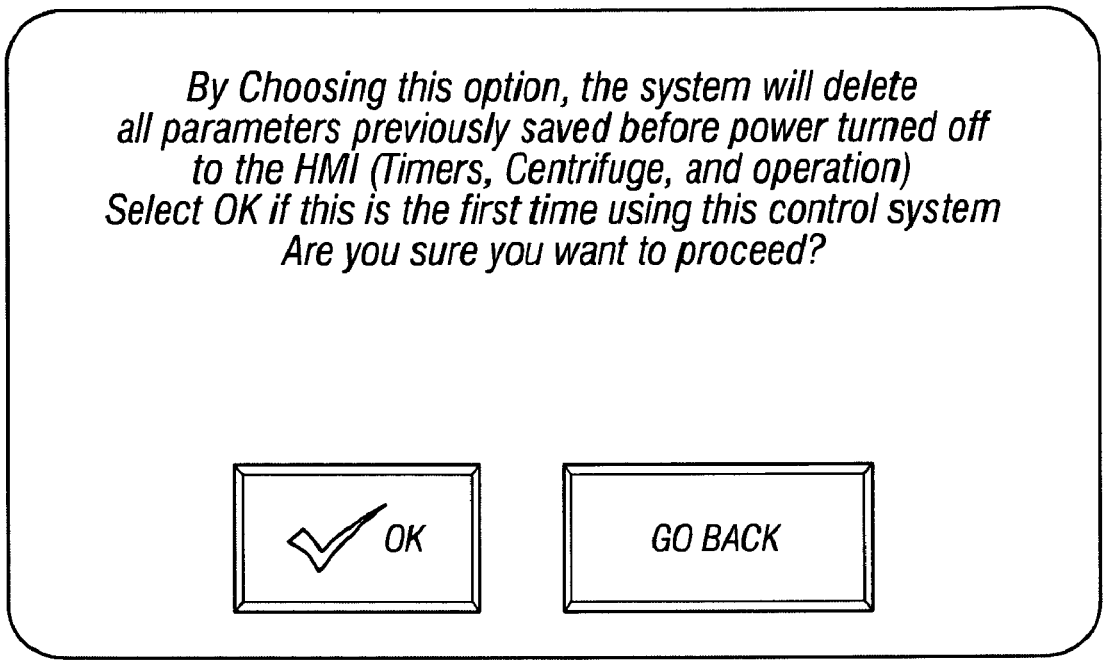
FIG. 30E is a view of a touch screen apparatus of the control system of FIG. 30A regarding proceeding with pre-set operational parameters or proceeding with new parameters.
Figure 30F:
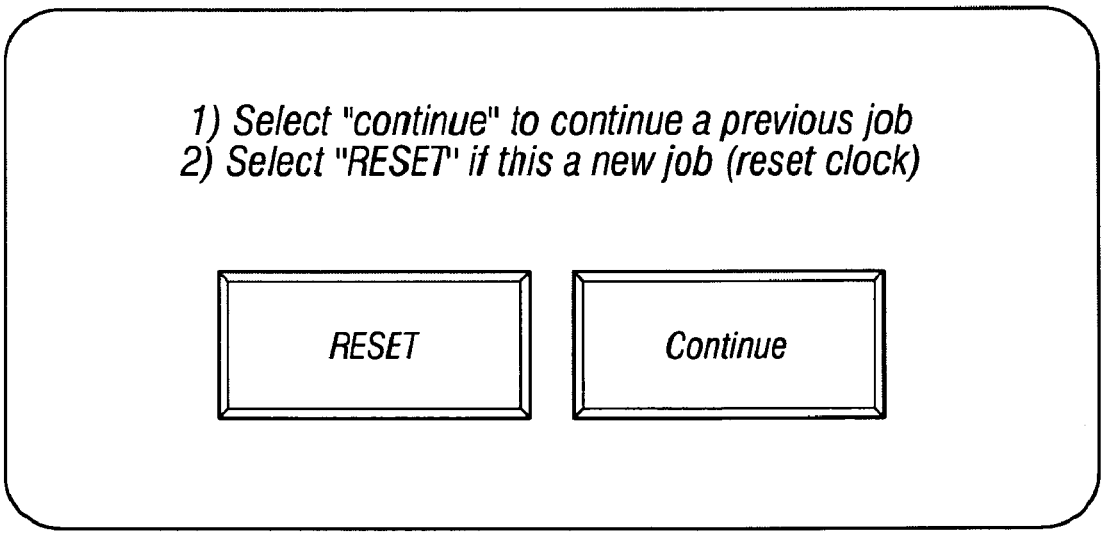
FIG. 30F is a view of a touch screen apparatus.

FIG. 30E illustrates a choice between proceeding with a new centrifuge and/or new operating parameters ("OK") in which the system will delete the parameters used for previous operations; or ("GO BACK") will allow previously used parameters to be operative. The touch screen of FIG. 30F (which also appears when the system is first powered on) allows an operator to reset ("RESET") the system (starting with the screen of FIG. 30A) with new input parameters or allows the operator to choose to continue ("CONTINUE") restoring previously-saved operating parameters.

Figure 31:
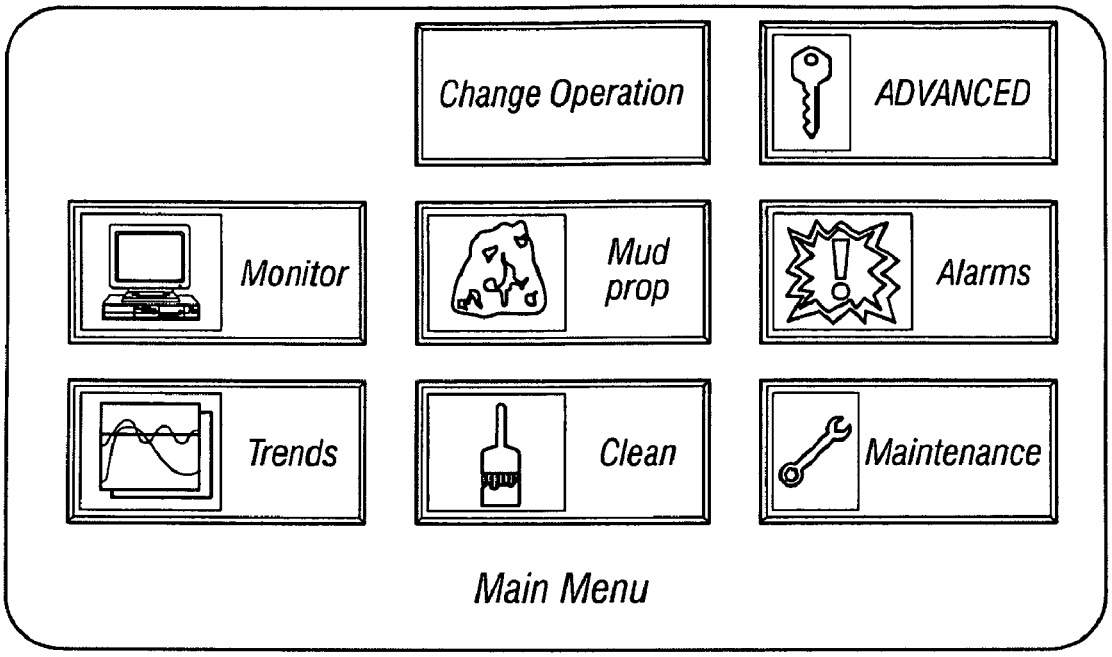
FIG. 31 is a view of a touch screen apparatus of the control system of FIG. 30A showing a Main Menu for controlling the system.

FIG. 31 presents a Main Menu that includes various choices:

"Change Operation": leads to subsequent screens regarding any desired change in system operation, including changes in equipment, task, operating parameters, and operation mode.

"Monitor": leads to subsequent screens which provide ongoing real-time displays of actual system operation mode, task, and parameters.

"Trends": leads to subsequent screens which show historical system operation data, e.g. previously logged information regarding torque, RPM's, gallons-per minute flow, differentials, etc.

"Advanced": a page that allows personnel, e.g. supervisors and engineers, to monitor additional functions and features of the VFD's and of the centrifuge, e.g. leading to the touch screen of FIG. 33B (and proceeding to this screen can be password protected).

"Maintenance": leads to subsequent screens which display items and parts monitored for regular maintenance and times and time periods for maintenance, and, in certain aspects, whether any maintenance alarm is active.

"Clean": provides an option of rotating the conveyor to clean the centrifuge of solids that are stuck which can cause high torque.

"Mud Prop": leads to a touch screen as in FIG. 31G which allows entry of (and then reference to) the properties of the particular drilling fluid ("mud") being processed and the amount of solids in the incoming mud ("% Solids Content In") and in the outgoing mud ("% Solids Content Out") as well as the other parameters indicated in FIG. 31G.

As shown in FIG. 31, the system can be programmed so that the screen portrayed in FIG. 31 (and any and every screen at any point in system operation) can display whether or not there is any active alarm. The alarm indicator may blink on and off and may be accompanied by additional system sight and/or sound alarm indicators (e.g., but not limited to, sirens, horns, blinking lights, etc.). Active alarms can include, among other things, an alarm for any maintenance that needs to be done.

Figure 31A:
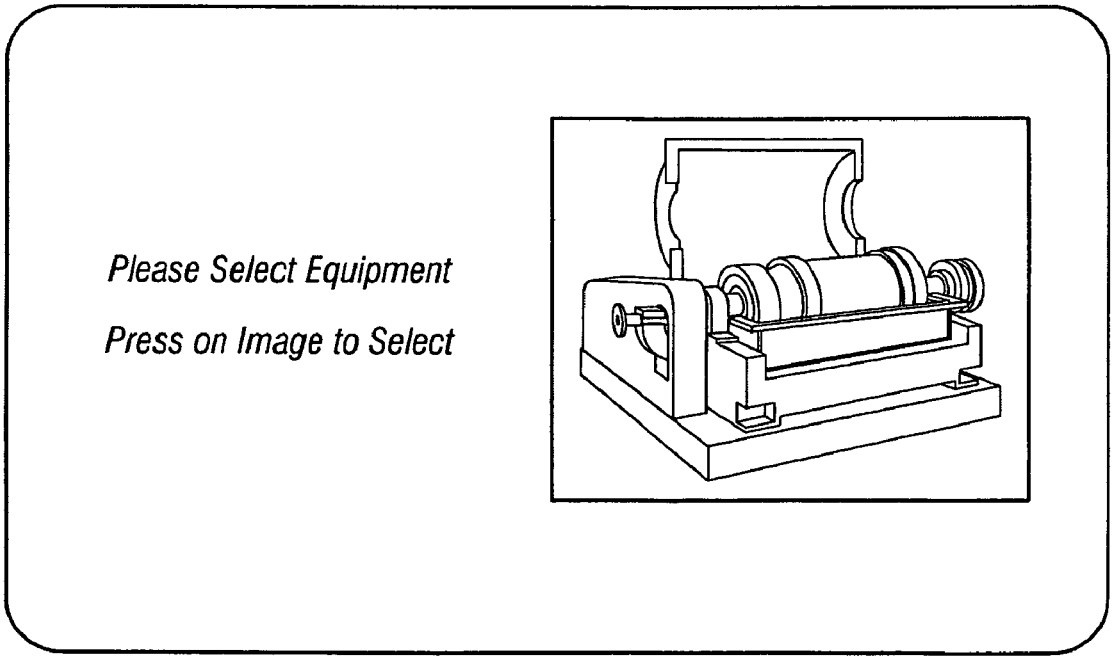
FIG. 31A is a view of a touch screen apparatus of the control system regarding selecting a particular make and model centrifuge to be controlled whose parameters are already pre-programmed into the control system.
Figure 31B:
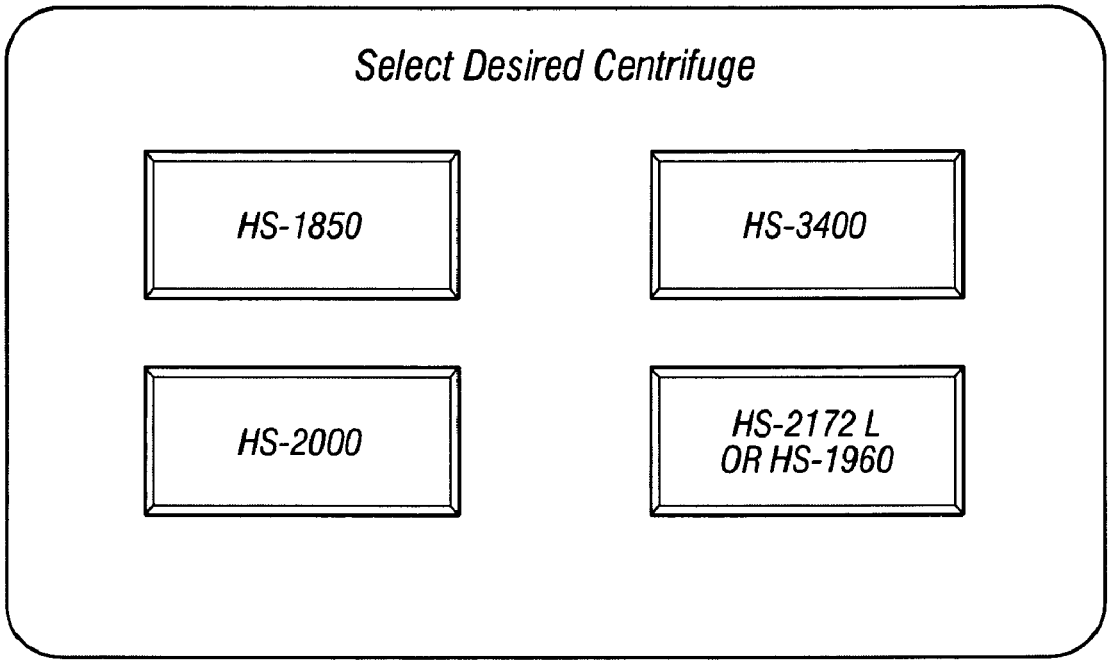
FIG. 31B is a view of a touch screen apparatus of the control system regarding certain specific centrifuges which can be controlled and shoe operational parameters are already in the system.

FIG. 31A illustrates operator selection of a particular centrifuge system to be controlled. FIG. 31B illustrates specific known centrifuges whose information and operational parameters are stored in memory of the touch screen apparatus and/or in memory of some other media of the control system and/or in a removable memory device usable with the touch screen apparatus, the control system apart from the touch screen apparatus, or both.

Figure 31C:
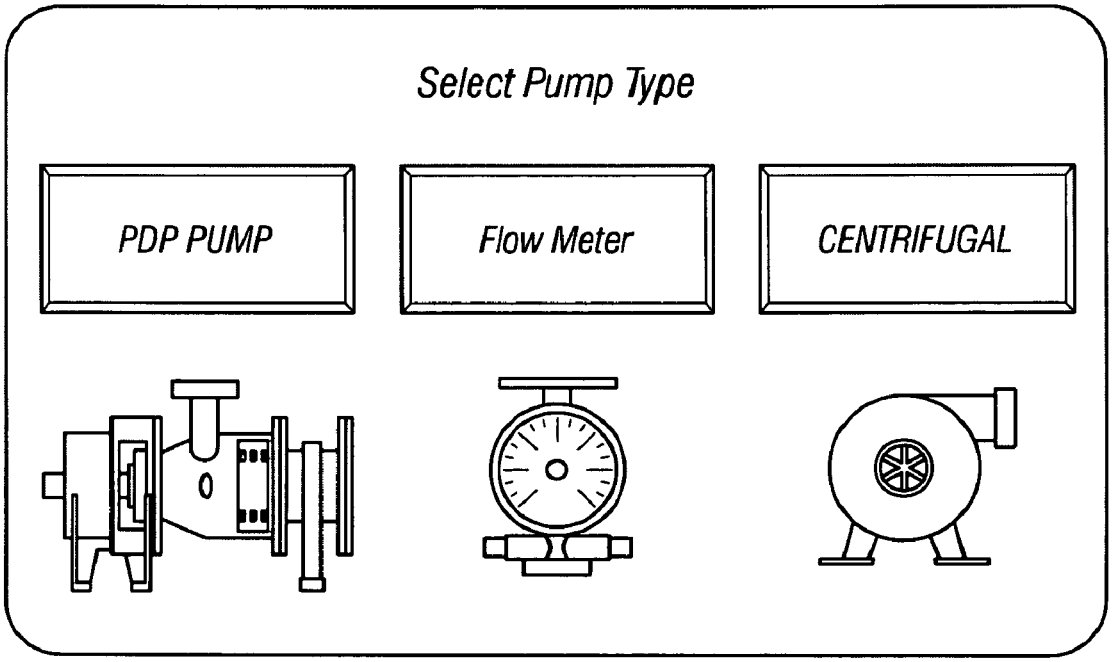
FIG. 31C is a view of a touch screen apparatus of the control system regarding selecting a type of pump in the centrifuge system to be controlled.
Figure 31D:
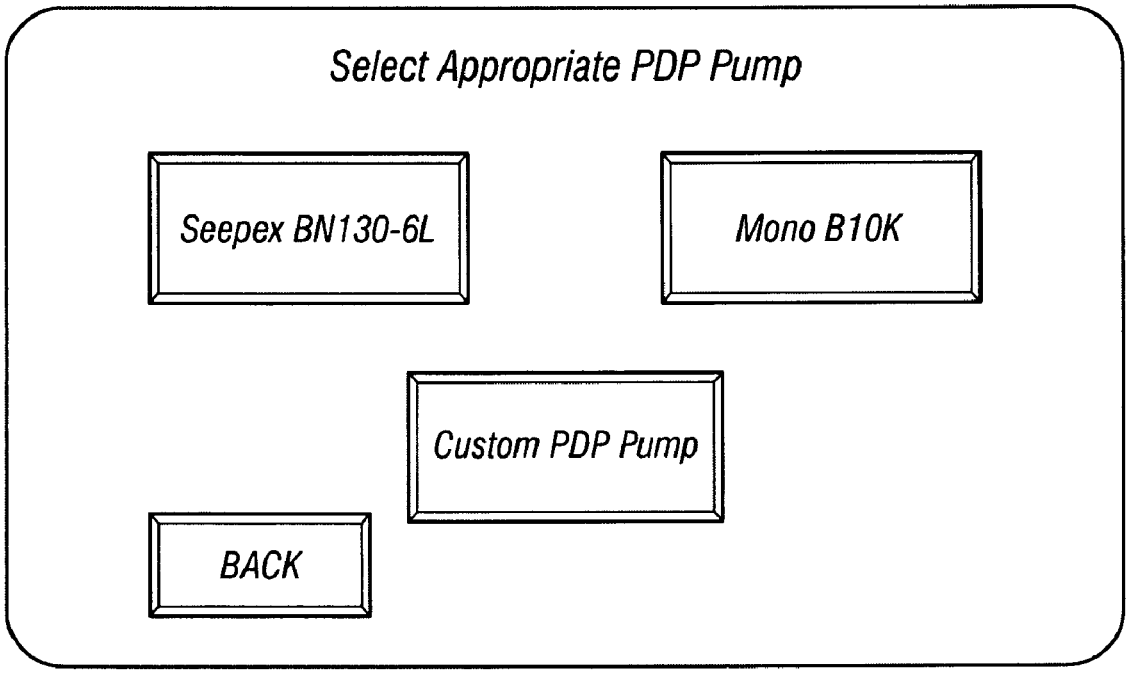
FIG. 31D is a view of a touch screen apparatus of the control system regarding selection of a specific pump.

FIG. 31C illustrates selection of a particular type of pump present in a particular centrifuge system, e.g. a PDP pump or a centrifugal pump (or selection of a flow meter). FIG. 31D illustrates specific pumps whose information and operational parameters are in the system (in any memory described above). The pump option will be bypassed if a flow meter is connected to the system.

Figure 31E:
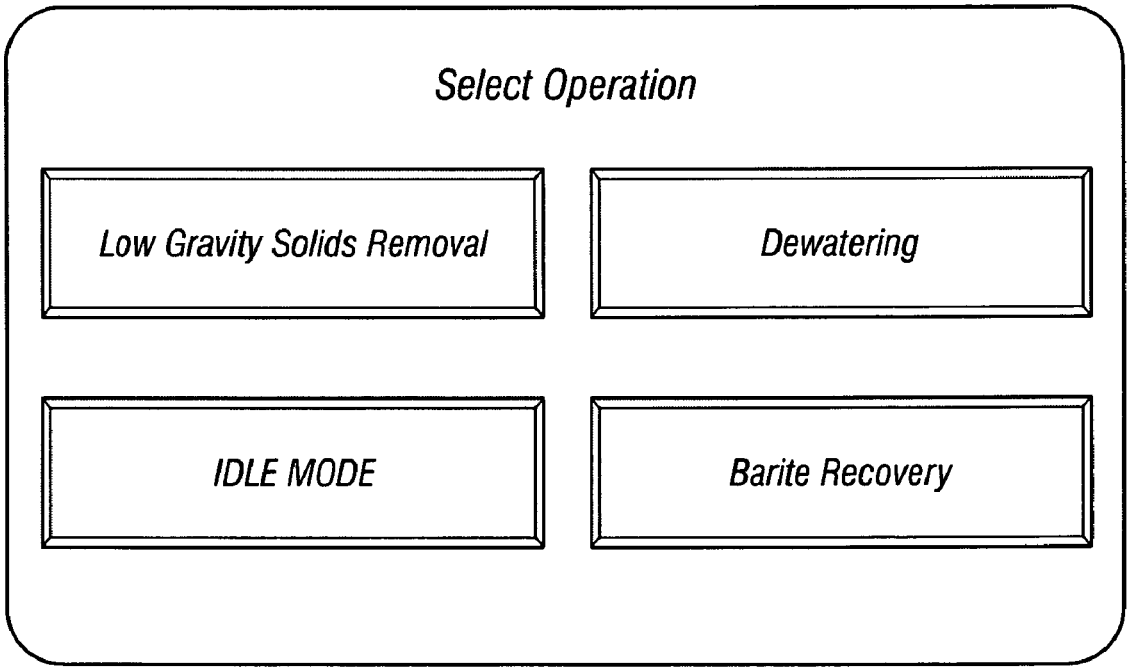
FIG. 31E is a view of a touch screen apparatus of the control system regarding selection of a particular type of task to be accomplished by the controlled centrifuge system or an "idle" operation mode.

FIG. 31E is a confirmation page regarding system activities made in previous selections and illustrates selection of various operational tasks and of operation in an idle mode. If idle mode is selected (FIG. 31E), the touch screen of FIG. 31F is displayed. If "YES" is selected, an operations screen (e.g. like that of FIG. 36A) is displayed. FIG. 31F queries the operator to insure that this selection is desired. In idle mode the bowl runs, e.g. at 600 rpm or less; the conveyor motor runs at 400 rpm or less; the conveyor motor runs in reverse and the pump is off. In certain aspects, the system is run in idle mode to preserve a wall cake on the centrifuge or to keep the centrifuge idling in a cold environment. Neither the bowl motor nor the conveyor motor is OFF in idle mode. When the operator activates the "YES" button of FIG. 31F, idling occurs almost instantaneously (i.e., on-the-fly).

Figure 32:
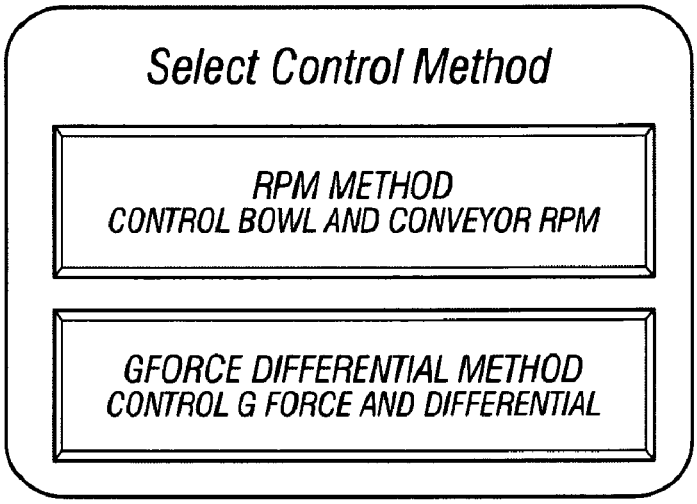
FIG. 32 is a view of a touch screen apparatus of the control system regarding selection of a method for controlling the centrifuge.

FIG. 32 illustrates optional selection of one of two methods for controlling G-force on the bowl of the centrifuge system. The "RPM METHOD" is a known method used for many years to control the G-force. It does so by controlling (e.g. by adjusting) the speed of the bowl and the speed of the conveyor—by controlling the speed of the bowl motor and the speed of the conveyor motor.

The other control method which can be chosen is the G-force differential control method (see discussion below regarding these control methods regarding FIGS. 36A-36D).

Figure 33A:
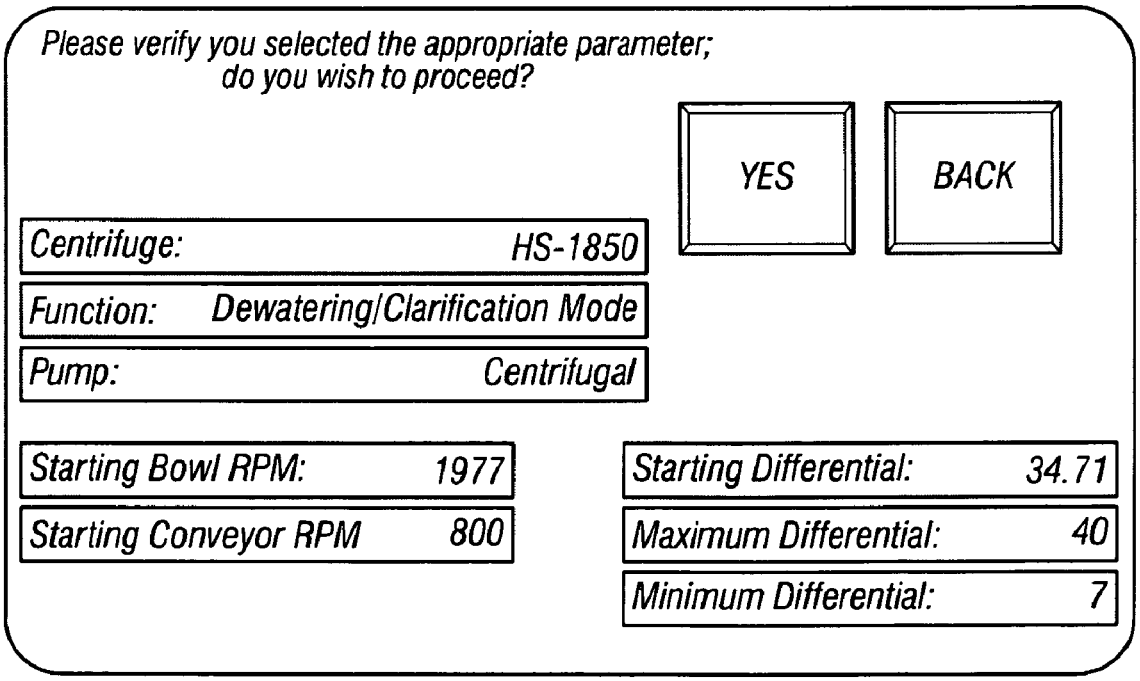
FIG. 33A is a view of a touch screen apparatus of the control system regarding verification of particular selections.

FIG. 33A is a screen which has the operator confirm various selections, e.g., centrifuge (specific), function (e.g. Dewatering/Clarification Mode), Pump (type, "Centrifugal"), starting bowl speed, starting conveyor speed, starting G-force differential, starting speed differential, maximum speed differential, and maximum G-force. If the operator wants to change something, "BACK" is chosen.

FIG. 33B illustrates various system devices and parts, states and parameters.

FIG. 34 illustrates various system parameters whose historical values and whose present value can be displayed, e.g. in graphical form on screen.

Figure 35:
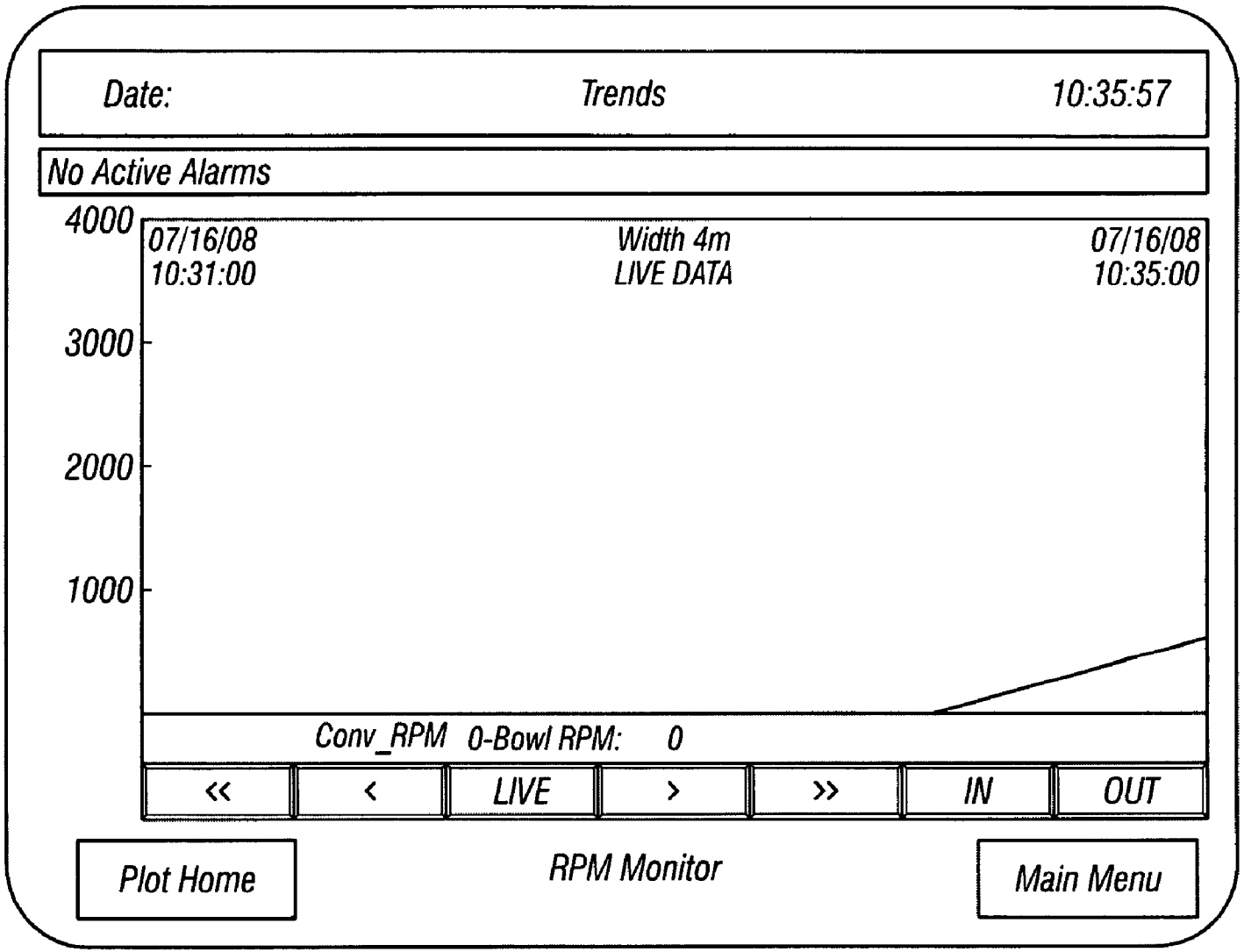
FIG. 35 is a view of a touch screen apparatus of the control system regarding graphical display of certain data about system operation.

FIG. 35 illustrates the display of real-time live data for the speed of the conveyor and of the bowl (pushing PLOT HOME returns an operator to the screen of FIG. 34.

Figure 36A:
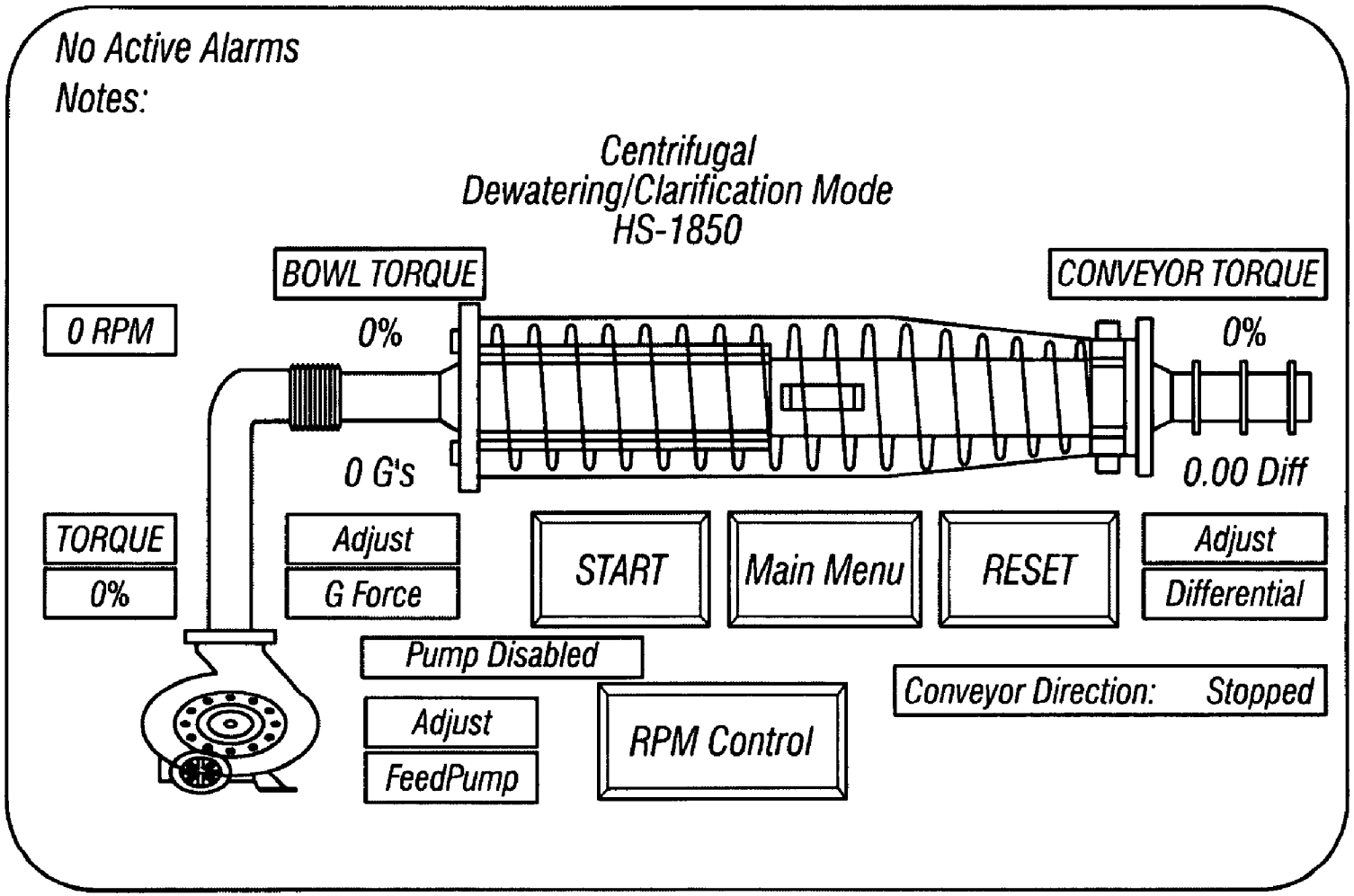
FIG. 36A is a view of a touch screen apparatus of the control system regarding centrifuge operation, status, and control with the system in a Dewatering Clarification Mode.

FIG. 36A is a screen display illustrating various system modes and parameters. The operator can choose to reset the system VFD's; adjust the G-force; adjust the speed differential; or adjust the rate of feed of the feed pump. The operator can start the centrifuge system; view the speed control, "RPM CONTROL", and change the speeds; or go to the system Main Menu. This screen also displays the specific centrifuge system being controlled and the chosen operational task. The "RPM CONTROL" button is for changing between the two different control methods—G-force differential control and RPM control.

Figure 36B:
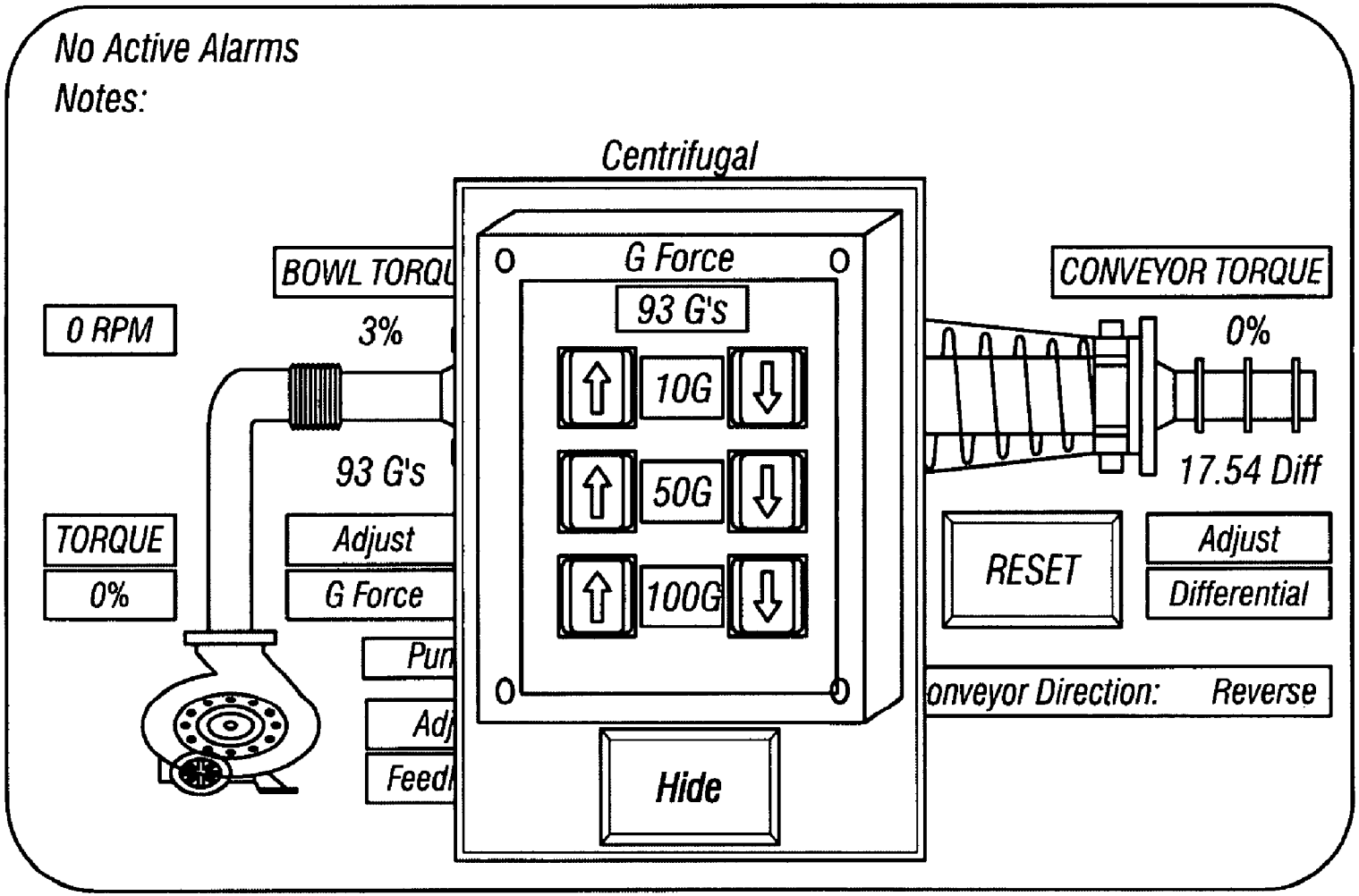
FIG. 36B is a view of a touch screen apparatus of the control system regarding selectively controlling the centrifuge system by adjusting the G-force, as G-force, on a bowl of the system.

FIG. 36B illustrates the operator having chosen "Adjust G Force" and the screen buttons which provide for the adjustment up or down with the current G-force (e.g. "93 G's") displayed.

Figure 36C:
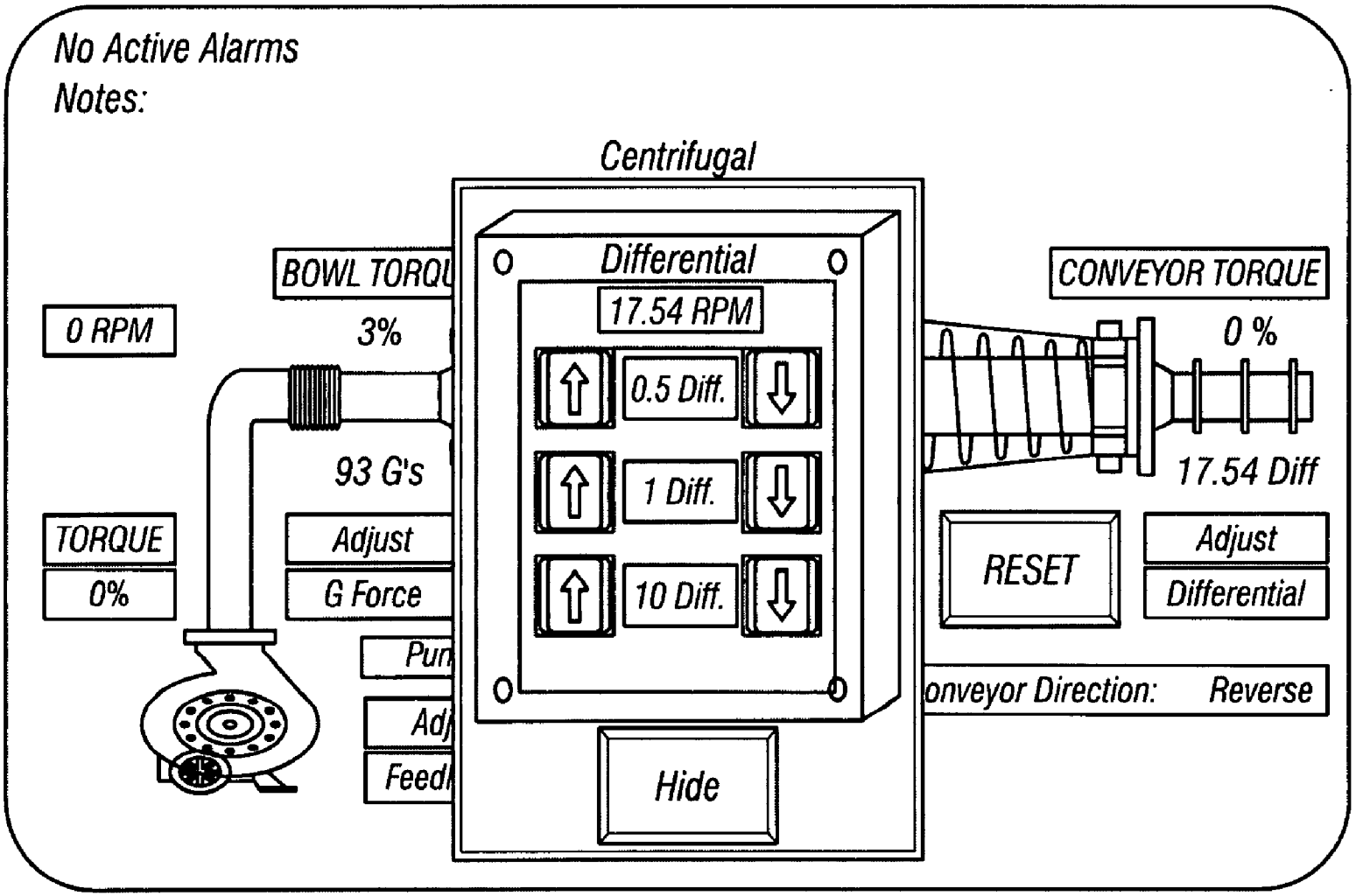
FIG. 36C is a view of a touch screen apparatus of the control system regarding selectively controlling the centrifuge system by adjusting a system speed differential.

FIG. 36C illustrates the operator having chosen "Adjust Differential" and the screen buttons which provide for the adjustment of the speed differential (with the current differential, e.g. "17.54 RPM").

Figure 36D:
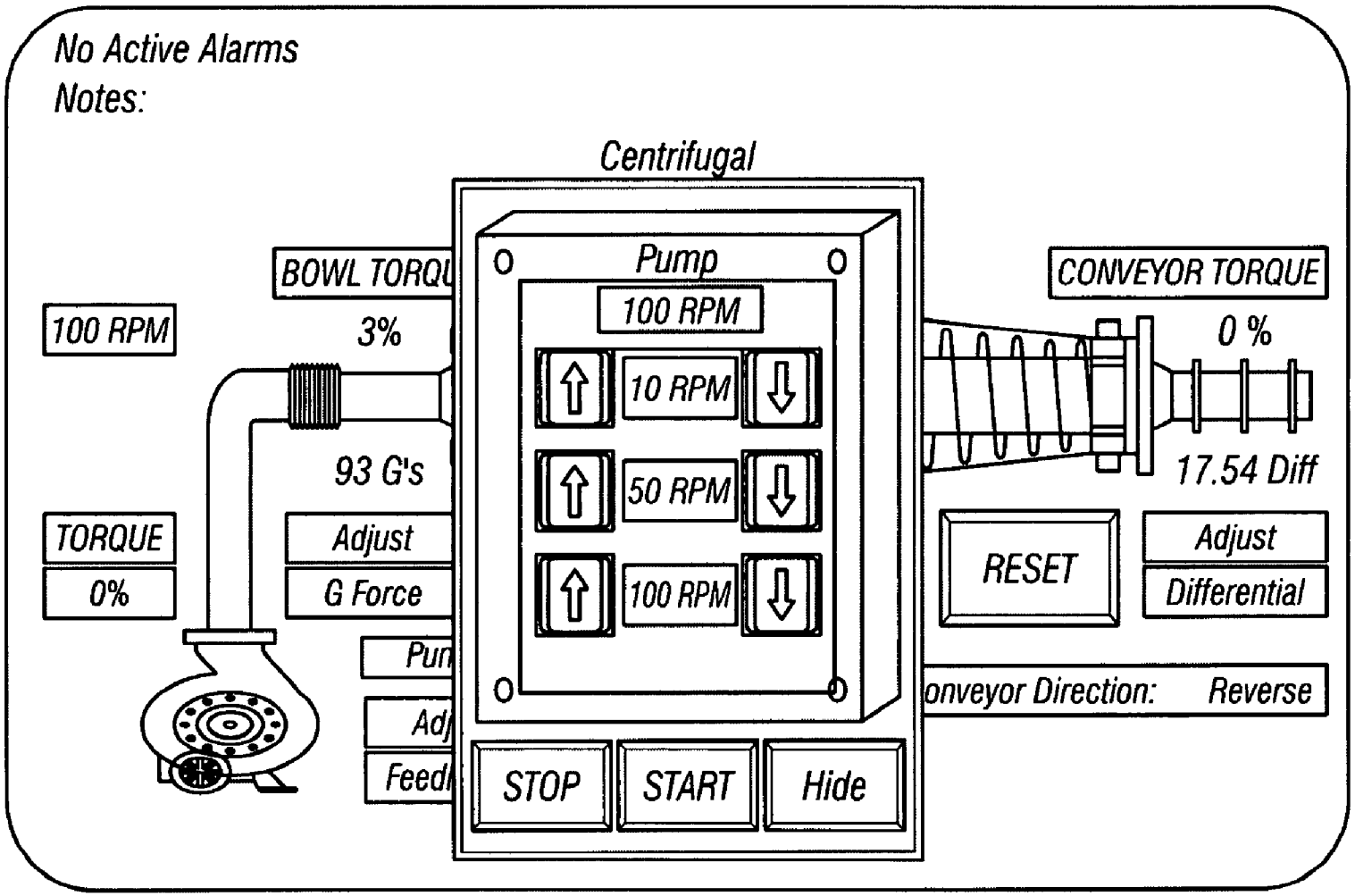
FIG. 36D is a view of a touch screen apparatus of the control system regarding adjusting speed of a system pump motor.

FIG. 36D illustrates the operator having chosen "Adjust Feed Pump" and the screen buttons which provide for adjusting the speed of the feed pump motor. This screen also permits stopping and starting of the feed pump with pre-set parameters. For a centrifugal pump only, pushing START renders operative a pre-set pump speed (e.g. as displayed on the screen of FIG. 33B). Pushing STOP stops the pump. Pushing HIDE hides the "Pump" sub-panel.

Figure 36E:
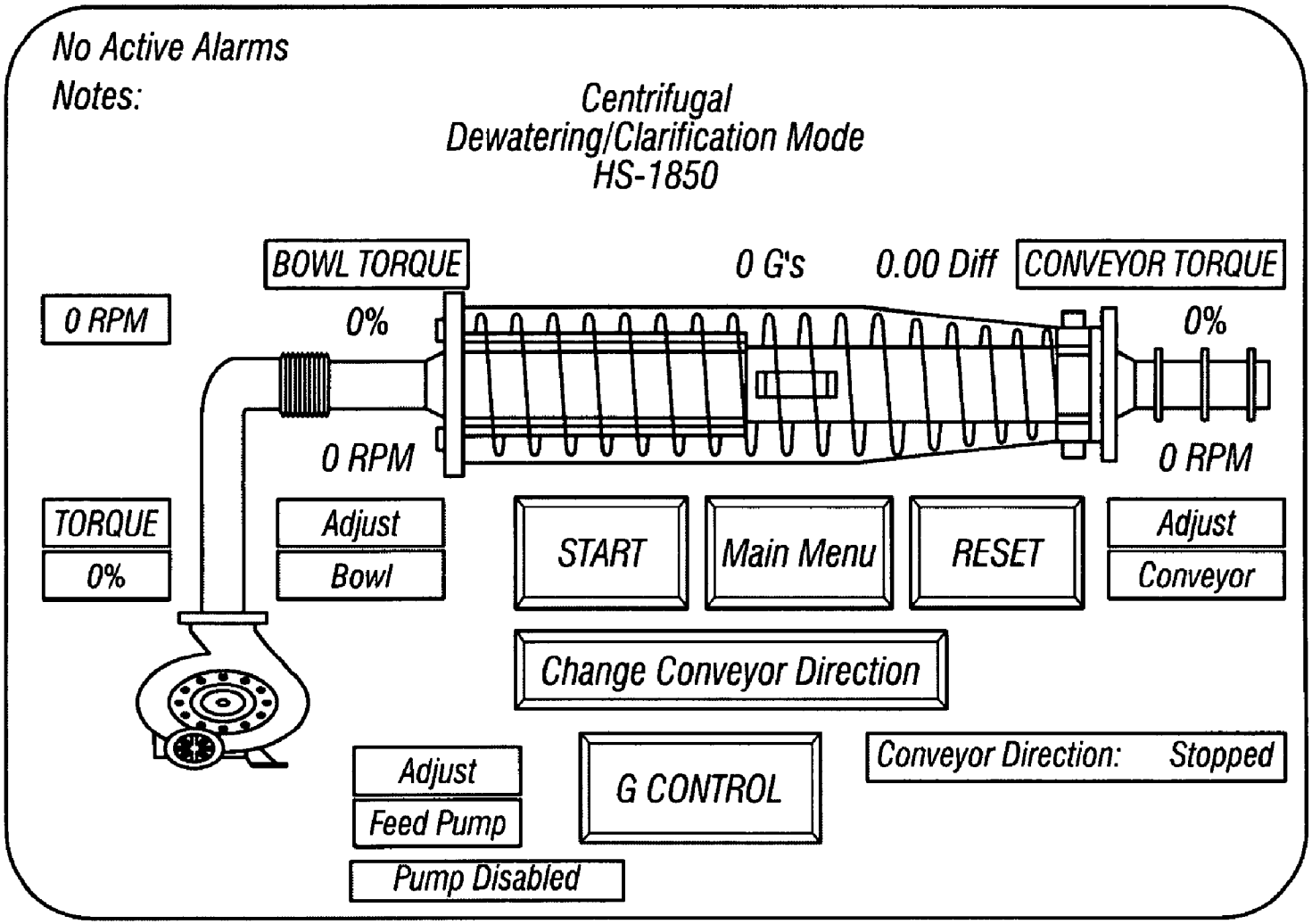
FIG. 36E is a view of a touch screen apparatus of the control system regarding system operation in a Dewatering Clarification Mode, presenting the option for changing direction of a system conveyor motor.

FIG. 36E is an operations page for controlling the system in the RPM method mode and illustrates a screen which provides for change of direction of the system's conveyor motor. The "G Control" button illustrates that an operator can switch, on-the-fly, from the RPM method to the G-force method (e.g. to a touch screen as in FIG. 36A). Via the screen of FIG. 32, the G-force mode can be initially selected (shown in FIG. 36A).

Figure 37:
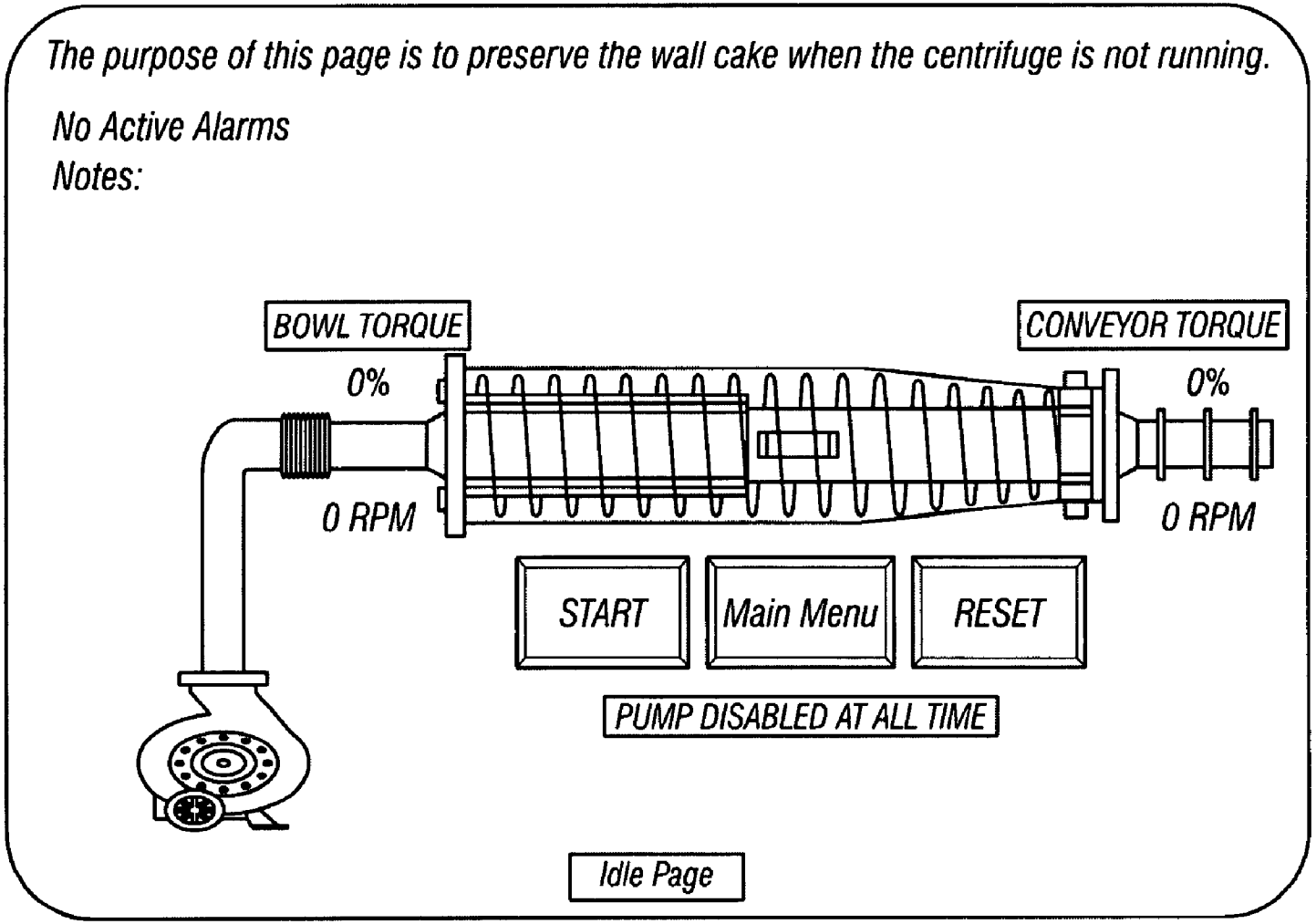
FIG. 37 is a view of a touch screen apparatus of the control system.
Figure 37A:
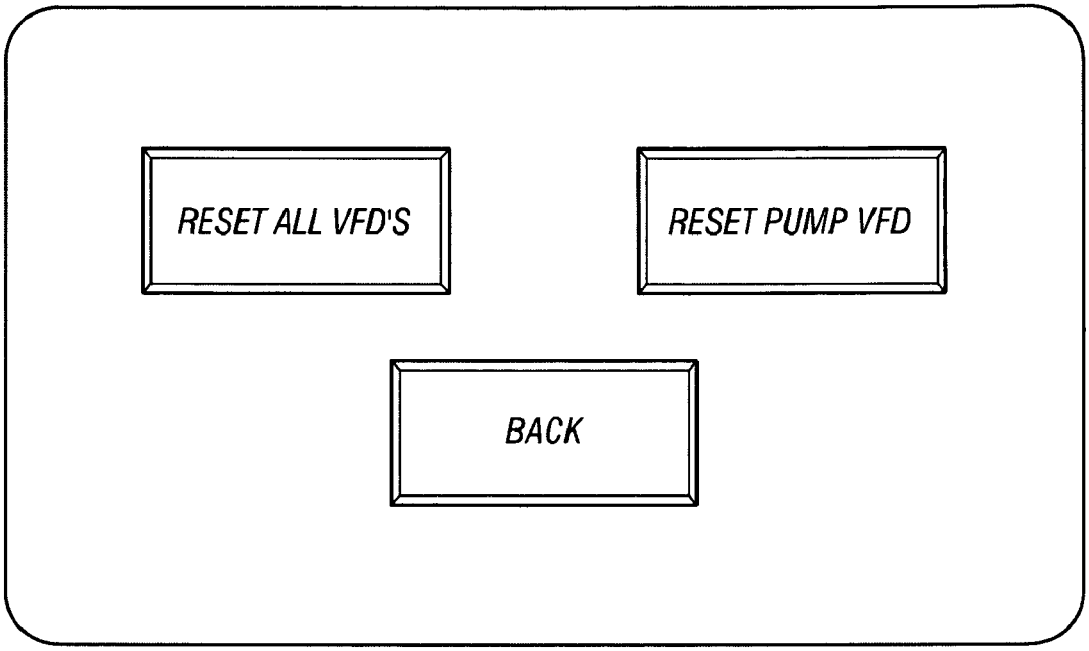
FIG. 37A is a view of a touch screen apparatus.

FIG. 37 illustrates the centrifuge system in idle mode with the pump off. An operator can get to this screen via the touch screen of FIG. 31E. If the operator presses RESET on the screen of FIG. 37, the touch screen of FIG. 37A is displayed. Via the screen of FIG. 37A an operator can reset all VFD's;

reset the pump VFD' or go back to a previous operations page. In the operation state shown in FIG. 37, the system is operating to avoid plugging of the centrifuge. If the operator pushes RESET, FIG. 37, the screen of FIG. 37A is displayed. If the operator pushes START, the centrifuge is started (e.g. with the bowl at 600 RPM and the conveyor motor at 400 RPM to preserve the wall cake) ("The purpose of this page is to preserve the wall cake when the centrifuge is not running").

Figure 38:
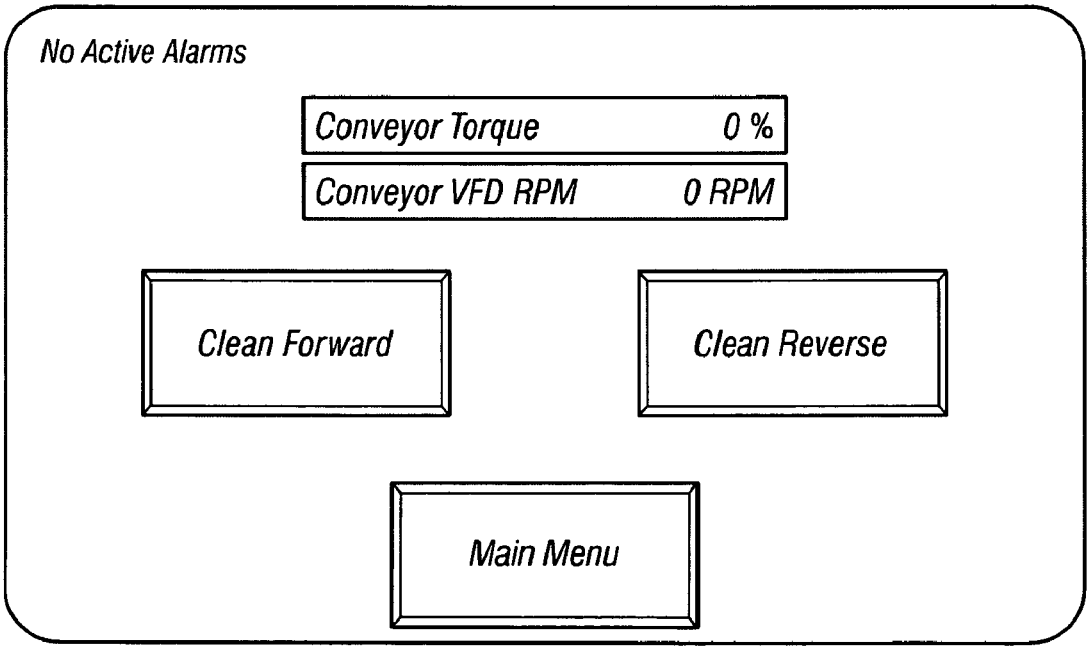
FIG. 38 is a view of a touch screen apparatus of the control system.

FIG. 38 illustrates the option to clean the centrifuge by controlling the conveyor motor in either direction ("Clean Forward" or "Clean Reverse").

FIG. 39 illustrates a maintenance program and maintenance status for various parts and items of the controlled centrifuge system. "Service" is pushed by an operator to indicate that the task has been done. Pushing "Later" will provide a future alert to the operator (e.g. within a pre-set number of hours).

FIG. 40 illustrates a method for shutting down the centrifuge system. It instructs the operator to first shut down the feed pump by pressing "STOP PUMP." It instructs the operator to wait until both bowl torque and conveyor torque are below a percentage of a pre-set maximum, e.g. below 40%. The real time torques are displayed as "BOWL TORQUE" and "CONVEYOR TORQUE." Then, once the torque parameters are satisfied, the operator presses "STOP CENTRIFUGE."

Figure 41:
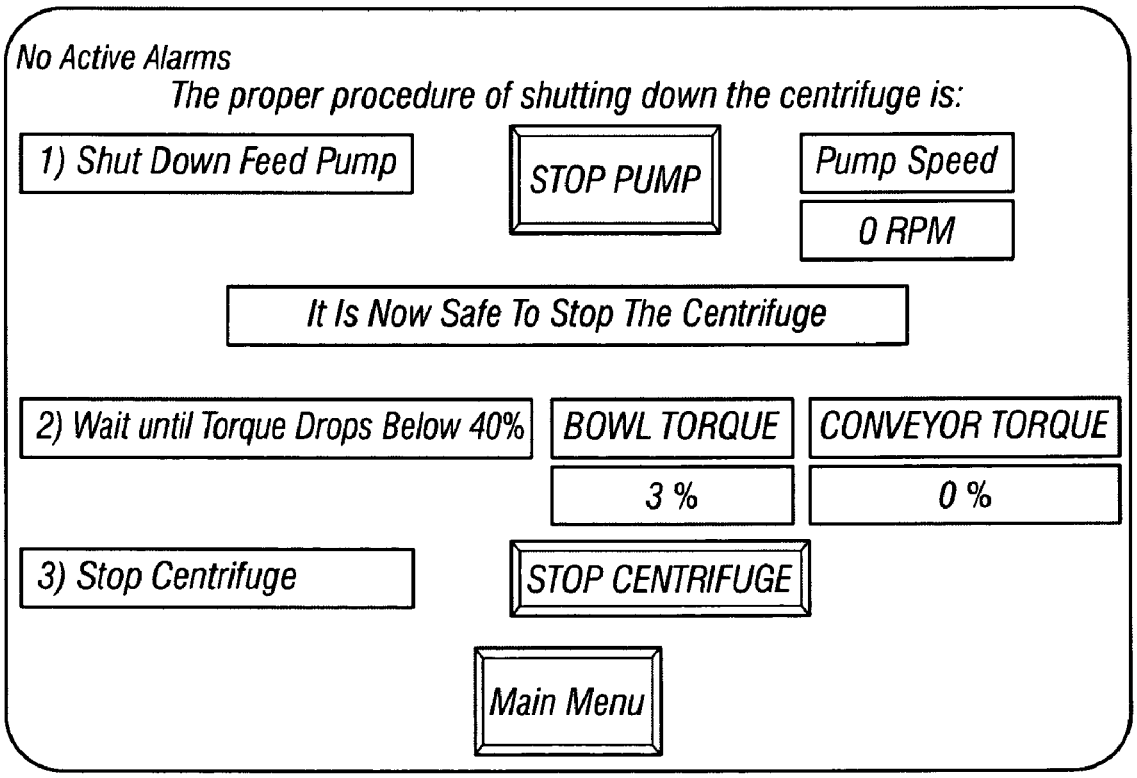
FIG. 41 is a view of a touch screen apparatus of the control system.

FIG. 41 illustrates a screen indicator that the pump is off, "PUMP SPEED 0 RPM," and that it is safe to stop the centrifuge.

Figure 42:
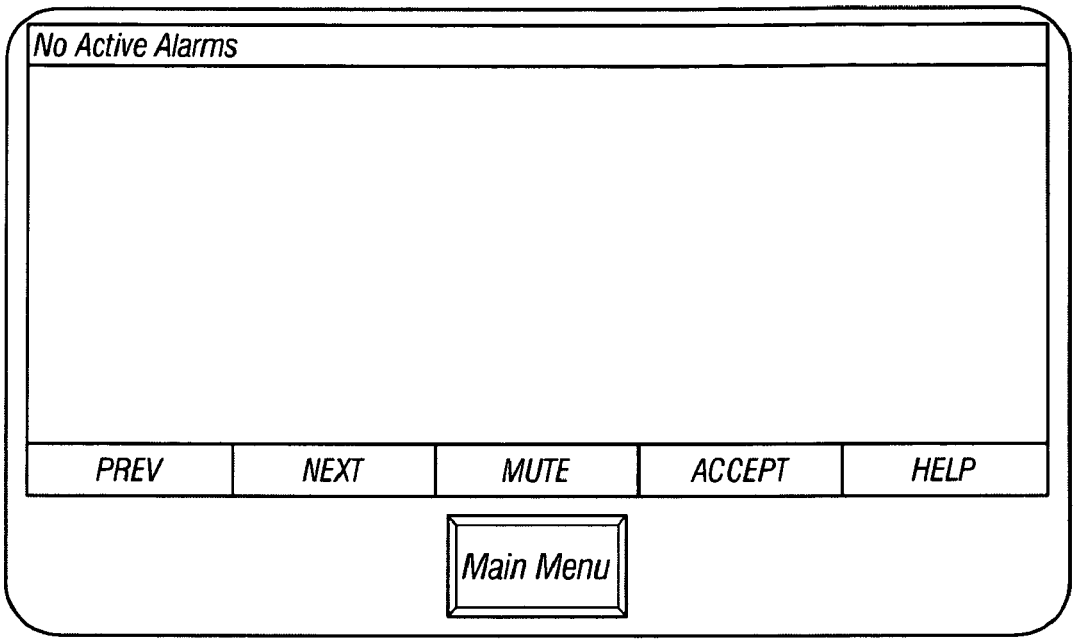
FIG. 42 is a view of a touch screen apparatus of the control system regarding the status of any system alarms.

FIG. 42 illustrates the status of on-going alarms, if any.

Figure 43:
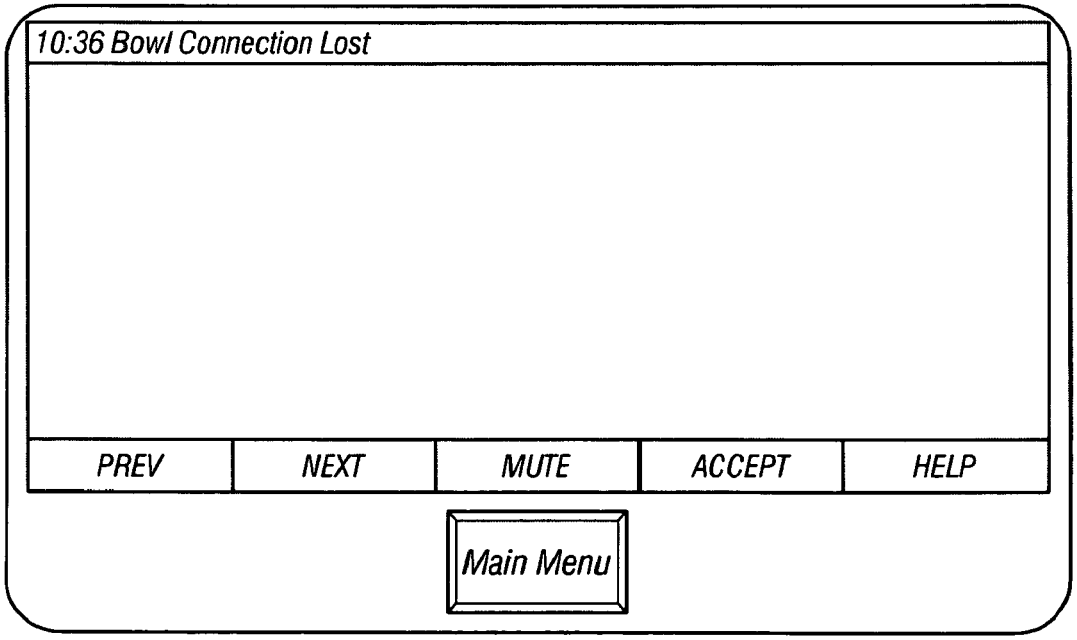
FIG. 43 is a view of a touch screen apparatus of the control system regarding loss of communication between the control system and the centrifuge system.

FIG. 43 illustrates that the touch screen apparatus either is no longer in communication with the centrifuge system due to operator choice or that, for some reason, (e.g. cable disconnection or breakdown) the connection with the centrifuge system has been lost or disabled.

For any individual step of any method according to the present invention disclosed herein, any steps of any such methods, and for any method according to the present invention, the step, steps and/or method are computer-based and/or computer implemented step, steps, and/or method via at least one programmed computer, e.g., but not limited to a touch screen apparatus computer or a control system computer. Each such step, steps, and/or method includes a corresponding computer program product embodied on a computer readable medium and/or a computer-readable storage medium on which is recorded a program for a computer to execute said step, steps and/or method and/or a computer readable medium, containing instructions that, when executed by a computer, implement said step, steps, and/or method.

The present invention, therefore, provides, in at least certain, but not necessarily all, embodiments a method for controlling a centrifuge system, the centrifuge system including: a bowl; a bowl motor system for rotating the bowl, rotation of the bowl resulting in a G-force applied to the bowl; a bowl variable frequency drive for driving the bowl motor; a conveyor rotatable within the bowl; a conveyor motor for rotating the conveyor; a conveyor variable frequency drive for driving the conveyor motor; a pump for pumping material to be centrifuged in the bowl; a pump motor for driving the pump; a pump variable frequency drive for driving the pump motor; a control system for controlling the bowl variable frequency drive, the conveyor variable frequency drive, and the pump variable frequency drive, the control system including computer apparatus; the computer apparatus configured to control the centrifuge system in a G-force differential control mode, the computer apparatus programmed with a pre-set maximum G-force to be applied to the bowl; the G-force differential control mode including controlling the G-force on the bowl as the bowl is rotated by the bowl motor system driven by the bowl VFD so that the G-force on the bowl does not exceed the pre-set maximum G-force; and said controlling of the G-force accomplished by one of adjusting the G-force on the bowl and adjusting the speed of the bowl, and, in one aspect, changing on-the-fly from a G-force mode to a speed mode. Such a method may have one or some, in any possible combination, of the following: adjusting the G-force from a first G-force to a second G-force, the adjusting including determining whether application of the second G-force will increase or decrease a bowl/conveyor-speed differential and, if the differential will be either increased beyond a pre-set limit or decreased beyond a pre-set limit, preventing application of the second G-force to the bowl, and if the bowl/conveyor-speed differential will not violate pre-set limits, allowing application of the second G-force to the bowl; determining whether the second G-force exceeds the pre-set maximum G-force or goes below a pre-set minimum and, if so, prohibiting application of the second G-force to the bowl and, if not, allowing the control system to proceed to determine if the second G-force can be applied to the bowl; calculating a first bowl/conveyor-speed differential, the first differential corresponding to the conveyor rotating in a reverse direction, and calculating a second bowl/conveyor-speed differential, the second differential corresponding to the conveyor motor rotating in a forward direction; providing a display to an operator indicating whether or not the second G-force will be applied to the bowl; controlling the G-force on the bowl including prohibiting the centrifuge from operation in a deadband; automatically changing direction of the conveyor motor so that the centrifuge will not operate in the deadband; avoiding operation in a deadband by changing the conveyor motor direction if conveyor torque exceeds by a preset amount a preset maximum conveyor torque or bowl torque exceeds by a pre-set amount a pre-set maximum bowl torque; insuring the pump motor is off before changing conveyor motor direction; wherein the conveyor motor applies a conveyor torque to the conveyor, the method further including monitoring the conveyor torque, if the conveyor torque exceeds a preset maximum conveyor torque by a first pre-set amount for a first pre-set time period, shutting down the pump, and/or if the conveyor torque exceeds the preset maximum conveyor torque by a second pre-set amount for a second pre-set time period, slowing down the pump motor by a pre-set amount monitoring bowl torque and if the bowl torque exceeds a preset maximum bowl torque by a first pre-set amount for a first pre-set time period, shutting down the pump, and/or if the bowl torque exceeds the preset maximum bowl torque by a second pre-set amount for a second pre-set time period, slowing down the pump motor by a pre-set amount; wherein the first pre-set amount is 50% and the second pre-set amount is 50%; wherein the first pre-set amount is 80% and the second pre-set amount is 90%; monitoring the pump variable frequency drive for faults and, if a pump variable frequency drive fault is detected, stopping the pump, monitoring the conveyor variable frequency drive for faults and/or, if a conveyor variable frequency drive fault is detected, stopping the bowl and stopping the conveyor, and/or monitoring the bowl variable frequency drive for faults and/or, if a bowl variable frequency drive is detected, stopping the bowl and stopping the conveyor; insuring that the bowl and the conveyor are rotating at a desired speed before the pump is activated; pre-setting in the control system an acceptable minimum speed for the bowl and an acceptable maximum speed for the conveyor, activating the feed pump if the bowl speed is above the pre-set acceptable minimum speed for the conveyor speed is above the pre-set acceptable speed for the conveyor, and the conveyor torque is less than or equal to an amount of a pre-set maximum allowable conveyor torque; stopping the centrifuge by stopping rotation of the bowl and stopping rotation of the conveyor; stopping the pump, and insuring bowl torque and conveyor torque are below pre-set levels before stopping of the centrifuge; when initially the conveyor motor is running in a first direction, the method further including changing the conveyor motor to run in a second direction opposite to the first direction; switching on-the-fly between controlling the G-force by adjusting the G-force on the bowl and controlling the G-force by adjusting the speed of the bowl; when initially a first G-force is applied to material within the bowl, the method further including changing the force applied to the material within the bowl to a second force different from the first G-force; wherein said changing the force is done on-the-fly; running the centrifuge system in an idle mode; selecting using the control system a specific model centrifuge to be controlled by the control system; selecting a specific language for operator-/control-system communication; network communications apparatus for providing communication between at least one of the variable frequency drive apparatuses and a site remote from a location of the centrifuge system, and the network communications apparatus for communicating with a computer system at the location of the centrifuge system for controlling at least one of the variable frequency drive apparatuses, communicating via the network communications apparatus with the computer system to control the centrifuge system; sensor apparatus connected to the centrifuge system for sensing a parameter indicative of operation of the centrifuge system for providing a signal corresponding to said parameter, control apparatus for receiving signals from the sensor apparatus for controlling the centrifuge system based on said signals, the centrifuge system on a drilling rig, the control apparatus for monitoring and analyzing a plurality of signals from the sensor apparatus and for transmitting signals indicative of information related to operation of the centrifuge system to a processor on the drilling rig, the processor including a set of health check rules for health checks comprising logical rules, inputs and outputs for defining events associated with the status of the centrifuge system, the processor for determining a severity code for each event and for reporting the events and severity codes to a central server, the events reported by the processor to the central server in a protocol defining a data structure, the data structure comprising a hierarchical tree node structure wherein results from application of the health check rules are a bottommost node of the tree node structure, and displaying the event severity codes on a display; the processor for providing to the central server the results as records containing node information regarding an appropriate location for the results in a tree node structure; the control apparatus runs the health checks in real time to provide results regarding on-going status of the centrifuge system to indicate a potential failure of the centrifuge system; the control apparatus for providing information regarding centrifuge system operation so that maintenance can be performed on the centrifuge system without shutting down drilling by the drilling rig; recording apparatus in communication with at least one on-board controller for at least one of the variable frequency drive apparatuses for recording personnel operator inputs thereto, the method further including producing a record identifying each personnel operator's inputs; wherein the centrifuge system includes load sensor apparatus for sensing load of the bowl motor and of the conveyor motor and for producing load signals indicative of said loads and pump controller apparatus for receiving said load signals and for controlling the pump in response thereto, the method further including controlling the pump in response to said load signals; wherein the pump controller shuts down the pump in response to load signals indicating the centrifuge system is jammed with material, thereby stopping flow of material to the bowl; and/or wherein the material includes drilling fluid and drilled cuttings.

The present invention, therefore, provides, in at least some, but not necessarily in all, embodiments, a computer readable medium containing instructions that when executed by a computer implement any method disclosed herein according to the present invention In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A method, comprising:

providing a centrifuge system, wherein the centrifuge system comprises:

a bowl, a bowl motor system that is adapted to rotate the bowl so as to apply a G-force thereto, a bowl variable frequency drive that is adapted to drive the bowl motor, a conveyor that is adapted to be rotated within the bowl, a conveyor motor that is adapted to rotate the conveyor, a conveyor variable frequency drive that is adapted to drive the conveyor motor, a pump that is adapted to pump material to be centrifuged in the bowl, a pump motor that is adapted to drive the pump, a pump variable frequency drive that is adapted to drive the pump motor, and a control system that is adapted to control the bowl variable frequency drive, the conveyor variable frequency drive, and the pump variable frequency drive, wherein the control system comprises a computer apparatus that is adapted to control the centrifuge system in a G-force differential control mode, and wherein the computer apparatus is programmed with a pre-set maximum G-force to be applied to the bowl; and controlling the centrifuge system in said G-force differential control mode by controlling the G-force on the bowl as the bowl is rotated by the bowl motor system so that the G-force on the bowl does not exceed the pre-set maximum G-force, wherein the G-force is controlled by one of adjusting the G-force on the bowl and adjusting the speed of the bowl.

2. The method of claim 1 further comprising adjusting the G-force from a first G-force to a second G-force, the adjusting comprising determining whether application of the second G-force will increase or decrease a bowl/conveyor-speed differential and, if the differential will be either increased beyond a pre-set limit or decreased beyond a pre-set limit, preventing application of the second G-force to the bowl, and if the bowl/conveyor-speed differential will not violate pre-set limits, allowing application of the second G-force to the bowl.

3. The method of claim 2 further comprising determining whether the second G-force exceeds the pre-set maximum G-force or goes below a pre-set minimum and, if so, prohibiting application of the second G-force to the bowl and, if not, allowing the control system to proceed to determine if the second G-force can be applied to the bowl.

4. The method of claim 2 further comprising calculating a first bowl/conveyor-speed differential, the first differential corresponding to the conveyor rotating in a reverse direction, and calculating a second bowl/conveyor-speed differential, the second differential corresponding to the conveyor motor rotating in a forward direction.

5. The method of claim 2 further comprising providing a display to an operator indicating whether or not the second G-force will be applied to the bowl.

6. The method of claim 2 further comprising avoiding operation in a deadband by changing the conveyor motor direction if conveyor motor speed is below a preset minimum.

7. The method of claim 1 further comprising controlling the G-force on the bowl including prohibiting the centrifuge from operation in a deadband.

8. The method of claim 7 further comprising automatically changing direction of the conveyor motor so that the centrifuge will not operate in the deadband.

9. The method of claim 8 further comprising insuring the pump motor is off before changing conveyor motor direction.

10. The method of claim 9 further comprising pre-setting in the control system an acceptable minimum speed for the bowl and an acceptable maximum speed for the conveyor, activating the feed pump if the bowl speed is above the pre-set acceptable minimum speed for the bowl, the conveyor speed is above the pre-set acceptable speed for the conveyor, and the conveyor torque is less than or equal to an amount of a pre-set maximum allowable conveyor torque.

11. The method of claim 1 wherein the conveyor motor applies a conveyor torque to the conveyor, the method further comprising monitoring the conveyor torque, if the conveyor torque exceeds the preset maximum conveyor torque by a second pre-set amount for a first pre-set time period, slowing down the pump motor by a pre-set amount if the conveyor torque exceeds a preset maximum conveyor torque by a second pre-set amount for a second pre-set time period, shutting down the pump.

12. The method of claim 11 further comprising monitoring bowl torque, if the bowl torque exceeds the preset maximum bowl torque by a first pre-set amount for a first pre-set time period, slowing down the pump motor by a pre-set amount if the bowl torque exceeds a preset maximum bowl torque by a second pre-set amount for a second pre-set time period, shutting down the pump.

13. The method of claim 12 further comprising stopping the pump, and insuring bowl torque and conveyor torque are below pre-set levels before stopping of the centrifuge.

14. The method of claim 11 wherein the first pre-set amount is 70% and the second pre-set amount is 80%.

15. The method of claim 11 wherein the first pre-set amount is 80% and the second pre-set amount is 90%.

16. The method of claim 1 further comprising monitoring the pump variable frequency drive for faults and, if a pump variable frequency drive fault is detected, stopping the pump, monitoring the conveyor variable frequency drive for faults and, if a conveyor variable frequency drive fault is detected, stopping the bowl and stopping the conveyor, and monitoring the bowl variable frequency drive for faults and, if a bowl variable frequency drive is detected, stopping the bowl and stopping the conveyor.

17. The method of claim 1 further comprising insuring that the bowl and the conveyor are rotating at a desired speed before the pump is activated.

18. The method of claim 1 further comprising stopping the centrifuge by stopping rotation of the bowl and stopping rotation of the conveyor.

19. The method of claim 1 wherein initially the conveyor motor is running in a first direction, the method further comprising changing the conveyor motor to run in a second direction opposite to the first direction.

20. The method of claim 1 further comprising switching on-the-fly between controlling the G-force by adjusting the G-force on the bowl and controlling the G-force by adjusting the speed of the bowl.

21. The method of claim 1 wherein initially a first G-force is applied to material within the bowl, the method further comprising changing the force applied to the material within the bowl to a second force different from the first G-force.

22. The method of claim 21 wherein said changing the force is done on-the-fly.

23. The method of claim 1 further comprising running the centrifuge system in an idle mode.

24. The method of claim 1 further comprising selecting using the control system a specific model centrifuge to be controlled by the control system.

25. The method of claim 1 further comprising selecting a specific language for operator-/control-system communication.

26. The method of claim 1 further comprising network communications apparatus for providing communication between at least one of the variable frequency drive apparatuses and a site remote from a location of the centrifuge system, and the network communications apparatus for communicating with a computer system at the location of the centrifuge system for controlling at least one of the variable frequency drive apparatuses, communicating via the network communications apparatus with the computer system to control the centrifuge system.

27. The method of claim 1 further comprising sensor apparatus connected to the centrifuge system for sensing a parameter indicative of operation of the centrifuge system for providing a signal corresponding to said parameter, control apparatus for receiving signals from the sensor apparatus for controlling the centrifuge system based on said signals, the centrifuge system on a drilling rig, the control apparatus for monitoring and analyzing a plurality of signals from the sensor apparatus and for transmitting signals indicative of information related to operation of the centrifuge system to a processor on the drilling rig, the processor including a set of health check rules for health checks comprising logical rules, inputs and outputs for defining events associated with the status of the centrifuge system, the processor for determining a severity code for each event and for reporting the events and severity codes to a central server, the events reported by the processor to the central server in a protocol defining a data structure, the data structure comprising a hierarchical tree node structure wherein results from application of the health check rules are a bottommost node of the tree node structure, and displaying the event severity codes on a display.

28. The method of claim 27 further comprising the processor for providing to the central server the results as records containing node information regarding an appropriate location for the results in a tree node structure.

29. The method of claim 28 wherein the control apparatus runs the health checks in real time to provide results regarding on-going status of the centrifuge system to indicate a potential failure of the centrifuge system.

30. The method of claim 29 further comprising the control apparatus for providing information regarding centrifuge system operation so that maintenance can be performed on the centrifuge system without shutting down drilling by the drilling rig.

31. The method of claim 30 further comprising recording apparatus in communication with at least one on-board controller for at least one of the variable frequency drive apparatuses for recording personnel operator inputs thereto, the method further comprising producing a record identifying each personnel operator's inputs.

32. The method of claim 1 wherein the centrifuge system includes load sensor apparatus for sensing load of the bowl motor and of the conveyor motor and for producing load signals indicative of said loads and pump controller apparatus for receiving said load signals and for controlling the pump in response thereto, the method further comprising controlling the pump in response to said load signals.

33. The method of claim 32 wherein the pump controller shuts down the pump in response to load signals indicating the centrifuge system is jammed with material, thereby stopping flow of material to the bowl.

34. The method of claim 1 wherein the material includes drilling fluid and drilled cuttings.

* * * * *